US007878777B2

(12) United States Patent
Iwanami et al.

(10) Patent No.: US 7,878,777 B2
(45) Date of Patent: Feb. 1, 2011

(54) SCROLL COMPRESSOR HAVING GROOVED THRUST BEARING

(75) Inventors: Shigeki Iwanami, Okazaki (JP); Sanemasa Kawabata, Kariya (JP); Tadashi Hotta, Okazaki (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 223 days.

(21) Appl. No.: 11/892,257

(22) Filed: Aug. 21, 2007

(65) Prior Publication Data

US 2008/0050260 A1 Feb. 28, 2008

(30) Foreign Application Priority Data

| | | |
|---|---|---|
| Aug. 25, 2006 | (JP) | 2006-228823 |
| Aug. 25, 2006 | (JP) | 2006-228942 |
| Aug. 25, 2006 | (JP) | 2006-228943 |
| Aug. 25, 2006 | (JP) | 2006-229764 |
| Sep. 29, 2006 | (JP) | 2006-268476 |
| Sep. 29, 2006 | (JP) | 2006-268521 |
| Dec. 1, 2006 | (JP) | 2006-325742 |

(51) Int. Cl.
*F03C 2/00* (2006.01)
*F03C 4/00* (2006.01)
*F04C 18/00* (2006.01)

(52) U.S. Cl. ..... 418/55.5; 418/55.1; 418/57; 418/94; 418/98; 384/123; 384/420

(58) Field of Classification Search ..... 418/55.1–55.6, 418/57, 94, 88; 384/121, 123, 368, 420
See application file for complete search history.

(56) References Cited

U.S. PATENT DOCUMENTS

| | | | | |
|---|---|---|---|---|
| 4,065,279 A | | 12/1977 | McCullough | |
| 4,637,786 A | | 1/1987 | Matoba et al. | |
| 4,696,630 A | * | 9/1987 | Sakata et al. | 418/55.5 |
| 4,734,020 A | | 3/1988 | Inaba et al. | |
| 4,772,188 A | | 9/1988 | Kimura et al. | |
| 4,874,302 A | * | 10/1989 | Kobayashi et al. | 415/55.3 |
| 4,892,420 A | * | 1/1990 | Kruger | 384/420 |
| 5,035,589 A | | 7/1991 | Fraser, Jr. et al. | |

(Continued)

FOREIGN PATENT DOCUMENTS

| | | |
|---|---|---|
| JP | A-53-35840 | 4/1978 |

(Continued)

OTHER PUBLICATIONS

Office Action issued by the German Patent Office on Mar. 19, 2010 in the corresponding German Patent Application No. 10 2007 039 628 9-15 (and English translation).

(Continued)

*Primary Examiner*—Theresa Trieu
(74) *Attorney, Agent, or Firm*—Posz Law Group, PLC

(57) ABSTRACT

A scroll compressor is disclosed. A plurality of grooves (85) communicating with each other are formed on a sliding surface of a thrust bearing (53) subjected to the axial force received by a movable scroll (32). The areas surrounded by the plurality of the grooves (85) make up a plurality of insular pressure receiving portions (83) independent of each other. The pressure receiving portions (83) represent at least one half of the area of the sliding surface.

19 Claims, 21 Drawing Sheets

U.S. PATENT DOCUMENTS

| | | | | |
|---|---|---|---|---|
| 5,211,550 | A | 5/1993 | Kawabe | |
| 5,240,332 | A | 8/1993 | Onishi et al. | |
| 5,422,524 | A | 6/1995 | Nakamura et al. | |
| 5,549,764 | A | 8/1996 | Biltgen et al. | |
| 6,135,737 | A | 10/2000 | Miura et al. | |
| 6,146,019 | A | 11/2000 | Andler et al. | |
| 7,185,620 | B2 | 3/2007 | Hofmann | |
| 7,458,158 | B2 * | 12/2008 | Luo et al. | 384/123 |
| 2002/0010051 | A1 | 1/2002 | Ushijima et al. | |
| 2003/0128903 | A1 | 7/2003 | Yasuda et al. | |
| 2004/0179968 | A1 | 9/2004 | Fukuhara et al. | |
| 2004/0190804 | A1 * | 9/2004 | John et al. | 384/420 |

FOREIGN PATENT DOCUMENTS

| | | | |
|---|---|---|---|
| JP | 57-131893 | A | 8/1982 |
| JP | A-61-8402 | | 1/1986 |
| JP | U-05-58887 | | 8/1993 |
| JP | A-06-313430 | | 11/1994 |
| JP | A-08-319959 | | 12/1996 |
| JP | A-09-317666 | | 12/1997 |
| JP | A-11-082335 | | 3/1999 |
| JP | 2000136782 | A * | 5/2000 |
| JP | A-2000-220582 | | 8/2000 |
| JP | A-2001-132757 | | 5/2001 |
| JP | 3426720 | | 5/2003 |
| JP | A-2004-019499 | | 1/2004 |
| JP | A-2004-324564 | | 11/2004 |
| JP | 2005-307949 | A | 11/2005 |
| JP | A-2006-220142 | | 8/2006 |

OTHER PUBLICATIONS

Office Action dated Sep. 21, 2010 issued in corresponding Japanese Patent Application No. 2006-228823 (and English translation).
Office Action dated Sep. 7, 2010 issued in corresponding Japanese Patent Application No. 2006-228942 (and English translation).
Office Action dated Sep. 21, 2010 issued in corresponding Japanese Patent Application No. 2006-229764 (and English translation).

* cited by examiner

SCROLL COMPRESSOR HAVING GROOVED THRUST BEARING

BACKGROUND OF THE INVENTION

1. Technical Field of the Invention

This invention relates to a scroll compressor.

2. Description of the Related Art

Generally, a scroll compressor includes a scroll fixed on a housing and a movable scroll arranged in opposed relation to the fixed scroll and adapted to revolve with respect to the fixed scroll on a rotary shaft, so that a fluid is compressed by the fixed scroll and the movable scroll. The movable scroll is subjected to the force in thrust direction by the pressure difference between the back surface of the movable scroll and the compressed fluid. This force in thrust direction is supported by a thrust bearing.

Since the movable scroll orbits, the sliding speed is lower in the case where the thrust bearing is used with the scroll compressor than in the case where the thrust bearing is used with a rotating device. As a result, it is difficult for the lubricating oil to form an oil film on the sliding surfaces, often resulting in seizure.

In a compressor included in a refrigeration cycle using a carbon dioxide refrigerant, the pressure of the compressed refrigerant is high enough to cause a large amount of force in thrust direction, so that forming an oil film on the sliding surfaces of the thrust bearing becomes a crucial problem.

Also, the scroll compressor has a large pressure-receiving area, which contributes to the problem of forming the oil film on the sliding surfaces, as described above.

A scroll compressor using carbon dioxide as a refrigerant for automotive vehicles is available, which has a thrust bearing with a pair of sliding surfaces formed of planar flat plates. In the case where an excessively large load is placed on the sliding surfaces, the oil film between the sliding surfaces becomes inconsistent and resulting in seizure.

Further, in the scroll compressor, the movable scroll orbits, compressing the fluid in the compression chamber, and therefore moves in a radial direction. Thus, the rotation moment around an axis perpendicular to the revolving axis acts (tilt moment) on the movable scroll and causes an offset thrust load, which results in more severe loading conditions.

Conventional scroll compressors incorporating various designs of the sliding surfaces have been proposed.

JP3426720B discloses a technique in which a multiplicity of minuscule oil pools having minuscule holes are formed on the sliding surface of the thrust bearing arranged on the back surface of the movable scroll and the lubricating oil is held by adsorption on the wall surface of the minuscule oil pools.

According to the technique described in JP3426720B, however, the lubricating oil is held by the wall surface of the holes of minuscule oil pools, and the minuscule oil pools are formed independently of each other. Thus, since the diameter and depth of each minuscule oil pool cannot be increased, the amount of the lubricating oil that can be held is limited. In the case where the compressor is operated with the lubricating oil failing to be supplied in minuscule oil pools for a long period of time, the lack of oil supply generates negative pressure on the sliding surfaces, resulting in that the sliding surfaces stick to each other, thereby resulting in a possible seizure.

The thrust bearing described in JP3426720B is arranged over the whole back surface of the movable scroll. With the movement of the thrust bearing due to the orbiting motion of the movable scroll, a part of the minuscule oil pools is displaced out of the mating side, resulting in that the area formed by the lubricating oil film is reduced.

Also, in a scroll compressor including a thrust bearing having a sliding surface of a movable scroll and a fixed sliding surface, a back pressure mechanism for applying pressure to the back of the shaft of the movable scroll to reduce the load imposed on the sliding surfaces has been proposed. This mechanism, however, requires a complicated control operation, and increases cost.

JP8-319959A discloses a scroll compressor with a plurality of taper land bearing mechanisms formed on the thrust bearing surface supporting the movable scroll, wherein the taper land bearing mechanism is formed with a multiplicity of tapered portions inclined in the direction of revolution and a multiplicity of circular land portions of predetermined height.

However, in the scroll compressor described in JP8-319959A, which is intended to form an oil film by a wedge effect on the sliding surfaces of the thrust bearing, the dimensions of the tapered portions and the land portions are not specified, and fluid lubrication is not necessarily obtained while in operation. Depending on operating conditions, a mixed lubrication or boundary lubrication may occur, often damaging the sliding surfaces of the thrust bearing due to friction and wear.

JP8-319959A lacks a description of the material and heat treatment of the bearing portion in order to secure wear resistance in the boundary or mixed lubrication region, which may occur when starting the compressor or "liquid back" (which is defined as a phenomenon in which a liquid-phase refrigerant is introduced into the scroll compressor together with a gas-phase refrigerant).

FIG. 26 is a plan view showing the sliding surface 134*a* of the movable scroll 132 of the conventional scroll compressor. This movable scroll 132 has a boss 135 at the central portion thereof coupled to an eccentric shaft (not shown), a sliding surface 134*a* on the outer periphery (hatched) and an inner peripheral non-contact surface 134*b* lower in level than the sliding surface 134*a*. An anti-rotation mechanism comprised of an Oldham ring (not shown) is often arranged on the back of the movable scroll due to the limited body size of the compressor. Therefore, a groove for establishing the anti-rotation mechanism is required to be arranged on the sliding surface of the housing or the movable scroll. In the prior art shown in FIG. 26, the key slots 142 are oblong and arranged in such a manner as to intrude into the area of the sliding surface 134*a*. Thus, the inner peripheral edge of the sliding surface 134*a* is segmented, and portions designated by a are formed at the corners adjacent to the key slots 142, and wear or seizure may occur at the parts a.

In the case where the tilt moment and the thrust load described above act on the movable scroll 132 in revolution, a precession is generated and the thrust load with the point of generation of the maximum thrust load moved along the circumferential direction acts on the sliding surface 134*a* while at the same time forming a high contact pressure portion along the inner peripheral edge of the sliding surface, resulting in that contact pressure rises at the parts a on the inner peripheral edge of the sliding surface with the pressure-receiving area reduced by the key slots 142, and also the parts a are disadvantageously adjacent to the key slots 142 deeper than the non-contact surface 134*b* for the oil supply operation.

SUMMARY OF THE INVENTION

In view of the aforementioned problems, an object of this invention is to provide a scroll compressor in which the wear of the sliding surface of the movable scroll is suppressed while at the same time preventing seizure.

Another object of this invention is to provide a scroll compressor having a thrust bearing sufficiently lubricated with an oil film formed by the lubricating oil even in the case where the compressor is operated with the supply of the lubricating oil suspended to the thrust bearing on the back surface of the movable scroll.

Still another object of this invention is to provide an easy-to-control, inexpensive scroll compressor in which fluid lubrication is established on the sliding surfaces of the thrust bearing.

A further object of this invention is to provide an easy-to-control, inexpensive scroll compressor in which the thrust bearing is formed of a bearing material with sliding surfaces less worn and performance not substantially reduced even in the case where the thrust bearing is used in a boundary or mixed lubrication region.

In order to solve the aforementioned problems, according to this invention, there is provided a scroll compressor comprising a fixed scroll (38) fixed on a housing (13), a movable scroll (32) arranged in opposed relation to the fixed scroll (38) and adapted to revolve with respect to the fixed scroll (38) on a rotary shaft (21) thereby to compress a fluid and a thrust bearing (53) for receiving the axial force received by the movable scroll (32), wherein the thrust bearing (53) includes a plurality of grooves (85) on the sliding surface and communicating with each other, and wherein the areas defined by the plurality of the grooves (85) communicating with each other constitute insular pressure receiving portions (83) independent of each other and representing at least one half of the area of the sliding surface.

As a result, even in the case where the compressor is out of operation with the lubricating oil not supplied to the sliding surfaces for a long period of time, the communication maintained between the plurality of the grooves (85) makes it difficult to generate negative pressure on the sliding surfaces, thereby reducing the sliding surfaces from being stuck to each other or resulting in seizure. Thus, a scroll compressor is provided having a thrust bearing sufficiently lubricated by forming an oil film of the lubricating oil.

Also, according to this invention, the plurality of the grooves (85) are arranged in a network pattern. As a result, the insular pressure receiving portions (83) defined by the grooves (85) are each surrounded by the grooves (85) over the entire periphery thereof, so that the lubricating oil can be introduced from all directions and an oil film can be formed by the revolving motion of the movable scroll (32).

Also, according to this invention, the insular pressure receiving portions (83) are each substantially circular in shape. In this invention, the expression "substantial circular" should be interpreted to include not only a circle in a strict sense of the word, but also an ellipse and a circle having a depression. With the revolving motion of the movable scroll (32), an oil film can be formed by attracting lubricating oil onto the insular pressure receiving portions (83) from all directions.

Also, according to this invention, the insular pressure receiving portions (83) are each polygonal. As a result, an oil film can be formed by attracting lubricating oil onto the pressure receiving portions (83) from each side of the polygon.

Also, according to the invention, the insular pressure receiving portions (83) are arranged in staggered fashion. As a result, the insular pressure receiving portions (83) can be arranged in high density, and the oil film can be formed in an increased size per unit area to support a heavy load.

According to this invention, the entire peripheral edge of each pressure receiving portion (83) is round or tapered. Thus, a satisfactory oil film can be formed by attracting the lubricating oil from the grooves (85) into the pressure receiving portions (83) by way of the round or tapered portions.

Also, according to this invention, the scroll compressor includes an oil separating means (63) for separating the lubricating oil from a fluid, and the lubricating oil is supplied to the thrust bearing (53) by the pressure difference between the lubricating oil separated by the oil separating means (63) and the portion at which the thrust bearing (53) is arranged. As a result, the lubricating oil can be positively introduced to the thrust bearing (53).

Also, according to this invention, the compressed fluid is carbon dioxide, and the pressure of the carbon dioxide discharged exceeds the critical pressure thereof.

Also, according to this invention, there is provided a scroll compressor comprising a fixed scroll (38) fixed on a housing (13), a movable scroll (32) arranged in opposed relation to the fixed scroll (38) and adapted to revolve with respect to the fixed scroll (38) on a rotary shaft (21) thereby to compress the fluid, a thrust bearing (53) arranged on the back of the movable scroll (32) for receiving the axial force and a lubricating oil supply means for supplying the lubricating oil to the thrust bearing (53), wherein the thrust bearing (53) includes a donut-shaped first member (53*a*) formed with a plurality of grooves (85) and a plurality of pressure receiving portions (83) defined by the plurality of the grooves (85) and a donut-shaped second member (53*b*) in sliding contact with the first member (53*a*), and wherein the plurality of the pressure receiving portions (83) are arranged only on radially outside the envelope (H) plotted by the inner peripheral edge (53*c*) of the second member (53*b*) by the relative motion of the first member (53*a*) and the second member (53*b*).

Even in the case where the movable scroll (32) moves by orbiting, the pressure receiving portions (83) formed on the first member (53*a*) are not displaced out of the second member (53*b*). As a result, while the compressor is operated with the supply of the lubricating oil suspended for a long time, the lubricating oil held by the plurality of the grooves (85) can form a satisfactory oil film.

Also, according to this invention, there is provided a scroll compressor comprising a fixed scroll (38) fixed on a housing (13), a movable scroll (32) arranged in opposed relation to the fixed scroll (38) and adapted to revolve with respect to the fixed scroll (38) on a rotary shaft (21) thereby to compress a fluid, a thrust bearing (53) arranged on the back surface (32*a*) of the movable scroll (32) for receiving the axial force and a lubricating oil supply means for supplying the lubricating oil to the thrust bearing (53), wherein the thrust bearing (53) includes a donut-shaped first member (53*a*) formed with a plurality of grooves (85) and a plurality of pressure receiving portions (83) defined by the plurality of the grooves (85) and a donut-shaped second member (53*b*) in sliding contact with the first member (53*a*), and wherein the plurality of the pressure receiving portions (83) are arranged only on radially inside the envelope plotted by the edge (53*c*) on the outer periphery of the second member (53*b*) by the relative motion of the first member (53*a*) and the second member (53*b*). As a result, a similar effect to the one described above is produced.

Also, according to this invention, a plurality of grooves (85) are arranged in a network pattern, and insular pressure receiving portions (83) are each defined by the grooves (85) between the plurality of the grooves (85).

As a result, the insular pressure receiving portions (83) are each surrounded over the entire outer periphery thereof by the grooves (85), so that the lubricating oil can be pulled in from all the directions and an oil film formed by the revolving motion of the movable scroll (32).

Also, according to the invention, the intersections (85*a*) of the plurality of the network grooves (85) have a larger groove width than the other parts. As a result, the lubricating oil can be extended sufficiently over the plurality of the grooves (85).

Also, according to the invention, the insular pressure receiving portions (83) are each substantially circular in shape and arranged in staggered fashion. In this invention, the expression "substantially circular" should be interpreted to include not only a circle but also a pentagon and a polygon having more sides with at least a curved corner.

As a result, the insular pressure receiving portions (83) can be arranged in high density, so that the size of the oil film formed per unit area can be increased to support a heavy load.

Also, according to this invention, there is provided a scroll compressor including an oil separating means (63) for separating the lubricating oil from a fluid, wherein the lubricating oil supply means supplies the lubricating oil to the thrust bearing (53) by the pressure difference between the lubricating oil separated by the oil separating means (63) and the portion (31) where the thrust bearing (53) is arranged. As a result, the lubricating oil can be led positively to the thrust bearing (53).

Also, according to this invention, the fluid compressed is carbon dioxide and the pressure of the carbon dioxide discharged exceeds the critical pressure thereof.

Also, according to this invention, there is provided a scroll compressor comprising a fixed scroll (38), a movable scroll (32) adapted to revolve with respect to the fixed scroll on a rotary shaft (21) thereby to compress the fluid, and a thrust bearing (53) for receiving the axial force received by the movable scroll (32), wherein the thrust bearing (53) includes a first sliding surface (100) having a plurality of insular pressure receiving portions (83) independent of each other defined by the grooves (85) and a second sliding surface (101) having a substantially flat portion in opposed relation to the pressure receiving portions (83) of the first sliding surface (100), wherein the first sliding surface (100) or the second sliding surface (101) is fixed on the movable scroll (32) and the pressure receiving portions (83) each include a sagged portion (83*b*) formed along the peripheral edge thereof and a flat portion (83*a*) inside the sagged portion (83*b*), wherein the standard deviation σ1 of the surface roughness of the first sliding surface (100) and the standard deviation σ2 of the surface roughness of the second sliding surface (101) are each not more than 0.08 μm, and wherein the ratio between the width W of the sagged portion and the effective radius R satisfies the relation $0.05 \leqq W/R \leqq 0.98$, where R is the effective radius of the pressure receiving portions (83) and W is the width of the sagged portion (83*b*) to assure that the height of the pressure receiving portions (83) is 1 μm lower than the flat portion (83*a*).

As a result, the oil film of the fluid is formed between the pressure receiving portions (83) and the portion of the second sliding surface (101) in opposed relation to the pressure receiving portions (83), and therefore, the thrust bearing (53) can be used while being lubricated with the fluid (hereinafter referred to as the state of hydrodynamic lubrication). In this scroll compressor, the control operation is not complicated or costly.

Also, according to this invention, as long as the ratio R/e between the effective radius R and the amount e in which the center of the movable scroll (32) is decentered from the axial center of the rotary shaft (21) holds the relation $0.8 < R/e \leqq 1$, the ratio between the width W and the effective radius R satisfies the relation $0.05 \leqq W/R \leqq 0.98$, while in the case where the ratio R/e between the effective radius R and the eccentricity e holds the relation $0.6 < R/e \leqq 0.8$, on the other hand, the ratio between the width W and the effective radius R satisfies the relation $0.1 \leqq W/R \leqq 0.85$. Also, in the case where the ratio R/e between the effective radius R and the eccentricity e holds the relation $0.4 < R/e \leqq 0.6$, the ratio between the width W and the effective radius R satisfies the relation $0.2 \leqq W/R \leqq 0.6$.

As a result, in each ratio between the eccentricity e of the movable scroll (32) and the effective radius R of the pressure receiving portions (83), the state of hydrodynamic lubrication of the thrust bearing as a slide bearing (53) can be positively established.

Also, according to this invention, there is provided a scroll compressor comprising a fixed scroll (38), a movable scroll (32) adapted to revolve with respect to the fixed scroll (38) on a rotary shaft (21) thereby to compress a fluid, the center of the movable scroll (32) being decentered a distance e from the axial center of the rotary shaft (21), and a thrust bearing (53) for receiving the axial force received by the movable scroll (32), wherein the thrust bearing (53) includes a first sliding surface (100) having a plurality of insular pressure receiving portions (83) independent of each other and each defined by the grooves (85) and a second sliding surface (101) having a substantially flat portion in opposed relation to the pressure receiving portions (83) of the first sliding surface (100), wherein the first sliding surface (100) or the second sliding surface (101) is fixed on the movable scroll (32) and the pressure receiving portions (83) each include a sagged portion (83*b*) formed along the peripheral edge of the pressure receiving portion (83) and a flat portion (83*a*) inside the sagged portion (83*b*), wherein the standard deviation σ1 of the surface roughness of the first sliding surface (100) and the standard deviation σ2 of the surface roughness of the second sliding surface (101) are each not more than 0.08 μm, and wherein an oil film parameter Λ expressed by Equation (1) below satisfies the relation $\Lambda \geqq 3$, $$\Lambda = \frac{1}{\sqrt{\sigma 1^2 + \sigma 2^2}} \gamma R \left[\frac{hin}{R}\right]^{\alpha} \left[\frac{\eta \cdot \omega}{\mathrm{Pave}}\right]^{\beta} \left[\frac{e}{R}\right]^{\beta} \tag{1}$$

where R is the effective radius of the pressure receiving portions (83), hin is the height of the sagged portion (83*b*) at the fluid inlet between the pressure receiving portions (83) and the second sliding surface (101), η is the kinematic viscosity of the fluid in operation, ω is the value obtained by dividing the sliding speed of the pressure receiving portions (83) with respect to the second sliding surface (101) by the eccentricity e, Pave is the average contact pressure of the pressure receiving portions (83), W is the width of the sagged portion (83*b*) to reduce the height of the pressure receiving portions (83) to a value 1 μm lower than the flat portion (83*a*), γ is the function of the effective radius R and the width W of the sagged portion, and α, β are the constants calculated by the elastohydrodynamic lubricaton theory in accordance with the lubrication conditions.

As a result, the oil film of the fluid is formed between the pressure receiving portions (83) and the portion of the second sliding surface (101) in opposed relation to the pressure receiving portions (83), and therefore, the thrust bearing (53) can be used in the state of hydrodynamic lubrication.

Also, according to this invention, as long as the ratio R/e between the effective radius R and the eccentricity e holds the relation $0.8 < R/e \leqq 1$, the ratio between the width W and the effective radius R satisfies the relation $0.05 \leqq W/R \leqq 0.98$, while in the case where the ratio R/e between the effective radius R and the eccentricity e holds the relation 0.6<R/ e≦0.8, on the other hand, the ratio between the width W and the effective radius R satisfies the relation 0.1≦W/R≦0.85. Also, in the case where the ratio R/e between the effective radius R and the eccentricity e holds the relation 0.4<R/e≦0.6, the ratio between the width W and the effective radius R satisfies the relation 0.2≦W/R≦0.6.

As a result, in each ratio between the eccentricity e of the movable scroll (32) and the effective radius R of the pressure receiving portions (83), the state of hydrodynamic lubrication of the thrust bearing as a slide bearing (53) is positively secured.

Also, according to this invention, the sliding speed of the pressure receiving portions (83) with respect to the second sliding surface (101) is not less than 0.5 m/sec, and the load of 0.5 to 20 MPa in average contact pressure is imposed on the pressure receiving portions (83) by the interposition of the fluid between the pressure receiving portions (83) and the second sliding surface (101). Thus, the kinematic viscosity of 0.1 to 10 cst is maintained for the fluid in operation.

As a result, the oil film of the fluid having a sufficient thickness is formed between the pressure receiving portions (83) on the first sliding surface (100) and the second sliding surface (101).

Also, according to this invention, the insular pressure receiving portions (83) are in the shape of a substantial circle, an ellipse, an oblong or a substantial polygon, and arranged in the form of staggered, regular grid, oblique grid or random form.

As a result, the insular pressure receiving portions (83) can be arranged in high density, and the size of the oil film that can be formed per unit area is increased to support a heavy load.

Also, according to this invention, the sagged portion (83*b*) is formed over the entire peripheral edge of the pressure receiving portions (83). As a result, the insular pressure receiving portions (83) can form an oil film with the fluid flowing in from the entire peripheral edge thereof.

Also, according to this invention, there is provided a scroll compressor comprising a fixed scroll (38), a movable scroll (32) adapted to revolve with respect to the fixed scroll (38) on a rotary shaft (21) thereby to compress a fluid, and a thrust bearing (53) for receiving the axial force received by the movable scroll (32), wherein the thrust bearing (53) includes a first sliding surface (100) and a second sliding surface (101) in opposed relation to the first sliding surface (100) and the first sliding surface (100) or the second sliding surface (101) is fixed on the movable scroll (32), and wherein each of the first sliding surface (100) and the second sliding surface (101) is formed of a steel material and the retained austenite amount in the neighborhood of the two sliding surfaces (100, 101) is not less than 5 volume %.

As a result, the wear resistance of the surface of each of the pair of the sliding surfaces (100, 101) is improved. Even in the case where the thrust bearing (53) is used in the boundary or the mixed lubrication region, therefore, the sliding surfaces (100, 101) are less worn, and the performance of the scroll compressor is not substantially reduced. Also, this scroll compressor is not complicated in control operation or costly.

In this specification, the description "the performance is not substantially reduced" means that the sliding surfaces (100, 101), if worn, are very small in abrasion loss, and the performance of the scroll compressor is not adversely affected.

Also, according to this invention, there is provided a scroll compressor, wherein the thrust bearing (53) includes a first sliding surface (100) having a plurality of insular pressure receiving portions (83) each defined by the grooves (85) and independent of each other and a second sliding surface (101) having a substantially flat portion in opposed relation to the pressure receiving portions (83) on the first sliding surface (100), wherein the pressure receiving portions (83) each include a sagged portion (83*b*) formed on the peripheral edge thereof and a flat portion (83*a*) inside the sagged portion (83*b*), and wherein the standard deviation σ1 of the surface roughness on the first sliding surface (100) and the standard deviation σ2 of the surface roughness on the second sliding surface (101) are each not more than 0.08 μm.

As a result, the oil film is easily formed and the state of hydrodynamic lubrication can be easily secured in the insular pressure receiving portions (83) defined by the grooves (85). Also, since the pair of the sliding surfaces (100, 101) are each small in surface roughness, the use in the boundary or the mixed lubrication region is accompanied only by a small abrasion loss of the sliding surfaces (100, 101), thereby improving the anti-seizure characteristic. Thus, the performance of the scroll compressor is not substantially deteriorated.

Also, according to this invention, the scroll compressor is used in such a manner that the fluid including the lubricant is supplied to the sliding surfaces (100, 101) of the thrust bearing (53), the sliding speed of the pressure receiving portions (83) with respect to the second sliding surface (101) is not less than 0.5 m/sec, the load of 0.5 to 20 MPa in average contact pressure is imposed on the pressure receiving portions (83), and the kinematic viscosity of the fluid in operation is maintained at 0.1 to 10 cst.

As a result, the state of hydrodynamic lubrication of the thrust bearing (53) is secured, and the wear generated on the sliding surfaces (100, 101) by the boundary or mixed lubrication at the time of starting or the liquid back is reduced.

Also, according to this invention, in each of the first sliding surface (100) and the second sliding surface (101), an area where the retained austenite amount is not less than 5 volume % extends to the depth of not less than 10 micrometers from the surface.

As a result, in each of the sliding surfaces (100, 101) of the thrust bearing (53), the portion with an improved wear resistance is formed to a predetermined depth from the surface thereof. Even in the case where the thrust bearing (53) is used in the boundary or mixed lubrication region and the sliding surfaces (100, 101) are worn, therefore, the function of the thrust bearing (53) is positively maintained for a predetermined period of time.

Also, according to this invention, there is provided a scroll compressor comprising a fixed scroll (38), a movable scroll (32) adapted to revolve with respect to the fixed scroll (38) on a rotary shaft (21) thereby to compress a fluid, and a thrust bearing (53) for receiving the axial force received by the movable scroll (32), wherein the thrust bearing (53) includes a first sliding surface (100) and a second sliding surface (101) in opposed relation to the first sliding surface (100), wherein the first sliding surface (100) or the second sliding surface (101) is fixed on the movable scroll (32), and wherein the hardness of the second sliding surface (101) is higher than that of the first sliding surface (100) and the difference in Vickers hardness between the two sliding surfaces (100, 101) is not less than 500 HV.

As a result, the wear resistance of the surface of each of the siding surfaces (100, 101) is improved, and therefore, even in the case where the thrust bearing (53) is used in the boundary or mixed lubrication region, the sliding surfaces (100, 101) are less worn, and the performance of the scroll compressor is not substantially reduced. Also, in this scroll compressor, the control operation is not complicated or costly.

Also, according to this invention, the thrust bearing (53) includes a first sliding surface (100) having a plurality of insular pressure receiving portions (83) independent of each other and defined by grooves (85) and a second sliding surface (101) having a substantially flat portion in opposed relation to the pressure receiving portions (83) of the first sliding surface (100), wherein the pressure receiving portions (83) each include a sagged portion (83*b*) formed along the peripheral edge of the pressure receiving portion (83) and a flat portion (83*a*) inside the sagged portion (83*b*), and wherein the standard deviation σ1 of the surface roughness of the first sliding surface (100) and the standard deviation σ2 of the surface roughness of the second sliding surface (101) are each not more than 0.08 μm.

As a result, the insular pressure receiving portions (83) are easily formed with an oil film while at the same time easily establishing the state of hydrodynamic lubrication. Also, the surface roughness of the pair of the sliding surfaces (100, 101) is small, and therefore, even in the case where the scroll compressor is used in the boundary or mixed lubrication region, the sliding surfaces (100, 101) are less worn and the anti-seizure characteristic improved, so that the performance of the scroll compressor is not substantially reduced.

Also, according to this invention, the scroll compressor is used in such a manner that a fluid containing the lubricating oil is supplied to the sliding surfaces (100, 101) of the thrust bearing (53), the sliding speed of the pressure receiving portions (83) with respect to the second sliding surface (101) is not less than 0.5 m/sec, the load of 0.5 to 20 MPa in average contact pressure is imposed on the pressure receiving portions (83), and the kinematic viscosity of the fluid in operation is maintained at 0.1 to 10 cst.

As a result, the state of hydrodynamic lubrication of the thrust bearing is secured on the one hand, and the second sliding surface (101) is less worn by the boundary or mixed lubrication at the time of starting the scroll compressor or liquid back.

Also, according to this invention, the second sliding surface (101) is increased in hardness by the hardening or film-forming process. As a result, the surface hardness of the second sliding surface (101) can be effectively improved.

Also, according to this invention, the hardness of the second sliding surface (101) is higher than that of the first sliding surface (100), and the difference in Vickers hardness between the two sliding surfaces (100, 101) is not less than 500 HV.

Also, according to this invention, the first sliding surface (100) and the second sliding surface (101) are each formed of a steel material, and the retained austenite amount in the neighborhood of the sliding surfaces (100, 101) is not less than 5 volume %.

Also, according to this invention, there is provided a scroll compressor comprising a fixed scroll (38) fixed on a housing (13), a rotary shaft (21) for transmitting the turning effort, a movable scroll (32) arranged in opposed relation to the fixed scroll (38) and orbited around a rotary shaft (21) by being coupled to the rotary shaft (21) through an eccentric shaft (37) decentered a predetermined distance from the rotary shaft (21) thereby to compress a fluid in collaboration with the fixed scroll (38), a bearing member (15) having a thrust support surface (15*e*) in opposed relation to the side plate (33) of the movable scroll (32) for axially supporting the side plate (33) along the axis of the rotary shaft (21), and an anti-rotation mechanism for preventing the rotation of the movable scroll (32), wherein the side plate (33) of the movable scroll (32) includes a sliding surface (34*a*) adapted to slide in contact with the thrust support surface (15*e*) and a non-contact surface (34*b*) not in contact with the thrust support surface (15*e*) inside the sliding surface (34*a*), the non-contact surface having groove portions (42), wherein the sliding surface (34*a*) and the groove portions (42) are in spaced relation or in contact with each other, and in the case where the sliding surface (34*a*) and the groove portions (42) are in contact with each other, the sliding surface (34*a*) is formed in such a manner that the portion of the area around the groove (42) adjacent to the groove portions (42) along the circumference thereof and the area adjacent to the groove portions (42) radially inside constitute a non-contact surface (34*b*) and also in such a manner that the contour line indicating the inner peripheral edge of the sliding surface (34*a*) is in point contact or smoothly converges with the contour line of the groove portions (42).

With this configuration, the shape of the inner peripheral edge of the sliding surface (34*a*) is gradually and smoothly changed, and therefore, the local increase in contact pressure due to the tilt moment is suppressed. Also, even in the case where the sliding surface (34*a*) is in contact with the groove portions (42), the contact range is limited to the radially outward end of the groove portions (42) thereby to suppress the generation of any part where the oil film is lacking. Also, the sliding surface (34*a*) can be formed to except the portion radially inside thereof where the thrust load is comparatively large. Thus, a sliding surface (34*a*) possessing a high anti-seizing property or high wear resistance is obtained.

Now, the aforementioned radially inside portion where the thrust load is comparatively large will be explained. In the scroll compressor, the tilt moment acts on the movable scroll, and therefore, the thrust load acting on both the sliding surface and the thrust support surface contains the reaction force against the tilt moment. The nearer to the center axis radially inside of the sliding surface (34*a*) the point of application is located, the larger the reaction force is.

Also, the anti-rotation mechanism is preferably an Oldham ring (36) having key portions (36*b*, 36*c*) axially protruded, and the groove portions (42) can be key slot portions (42) combined with the key portions (36*b*).

Also, according to this invention, the sliding surface (34*a*) can be formed in various shapes including a substantial ring, and a shape with the diameter of the inner peripheral edge increased in the direction in which the key slot portions are arranged. Also, in the case where the key slot portions (42) are each oblong long in radial direction, the inner peripheral edge of the sliding surface (34*a*) may be formed to converge with the oblong arc at the radially outer end of the key slot portions (42) as a tangential line (TL) tilted with respect to the longitudinal axis of the oblong.

Also, according to this invention, the sliding surface (34*a*) at least partially includes a plurality of insular sliding surfaces ($34a_2$, $34a_3$) in spaced relation to each other. As a result, the lubricating oil supplied to the sliding surface (34*a*) can be held in the grooves or gaps between the insular sliding surfaces ($34a_2$, $34a_3$), and therefore, the oil film can be maintained more strongly.

Also, according to this invention, there is provided a scroll compressor comprising a fixed scroll (38) fixed on a housing (13), a rotary shaft (21) for transmitting the turning effort, a movable scroll (32) arranged in opposed relation to the fixed scroll (38) and adapted to orbit around the rotary shaft (21) by being coupled to the rotary shaft (21) through an eccentric shaft (37) decentered a predetermined distance from the rotary shaft (21) thereby to compress a fluid in collaboration with the fixed scroll (38), a bearing member (15) having a thrust support surface (15*e*) in opposed relation to the side plate (33) of the movable scroll (32) for supporting the side plate (33) along the axis of the rotary shaft (21), and an anti-rotation mechanism for preventing the rotation of the movable scroll (32), wherein the surface of the bearing member (15) facing the movable scroll (32) includes a thrust support surface (15*e*) and a bearing member non-contact surface (15*g*) not in contact with the sliding surface (34*a*) inside the thrust support surface (15*e*), the bearing member non-contact surface (15*g*) having groove portions (42), wherein the thrust support surface (15*e*) and the grooves (42) are in spaced relation or in contact with each other, and the thrust support surface (15*e*), if in contact with the grooves (42), is formed in such a manner that the area adjacent to the grooves (42) circumferentially around the grooves (42) and the area adjacent to the grooves (42) radially inside the grooves (42) constitute the bearing member-side non-contact surface (15*g*) and also in such a manner that the contour line indicating the inner peripheral edge of the thrust support surface (15*e*) is in point contact or smoothly converges with the contour line of the grooves (42).

As a result, as in the case of the sliding surface (34*a*) described above, a thrust support surface (15*e*) possessing high anti-seizing property or high wear resistance can be obtained.

Incidentally, the reference numerals inserted in the parentheses attached to each means described above indicate an example of correspondence with the specific means included in the embodiments described later.

The present invention may be more fully understood from the description of preferred embodiments of the invention, as set forth below, together with the accompanying drawings.

DESCRIPTION OF THE PREFERRED EMBODIMENTS

First Embodiment

A first embodiment of the invention is described below with reference to FIGS. 1 to 7.

Figure 1:
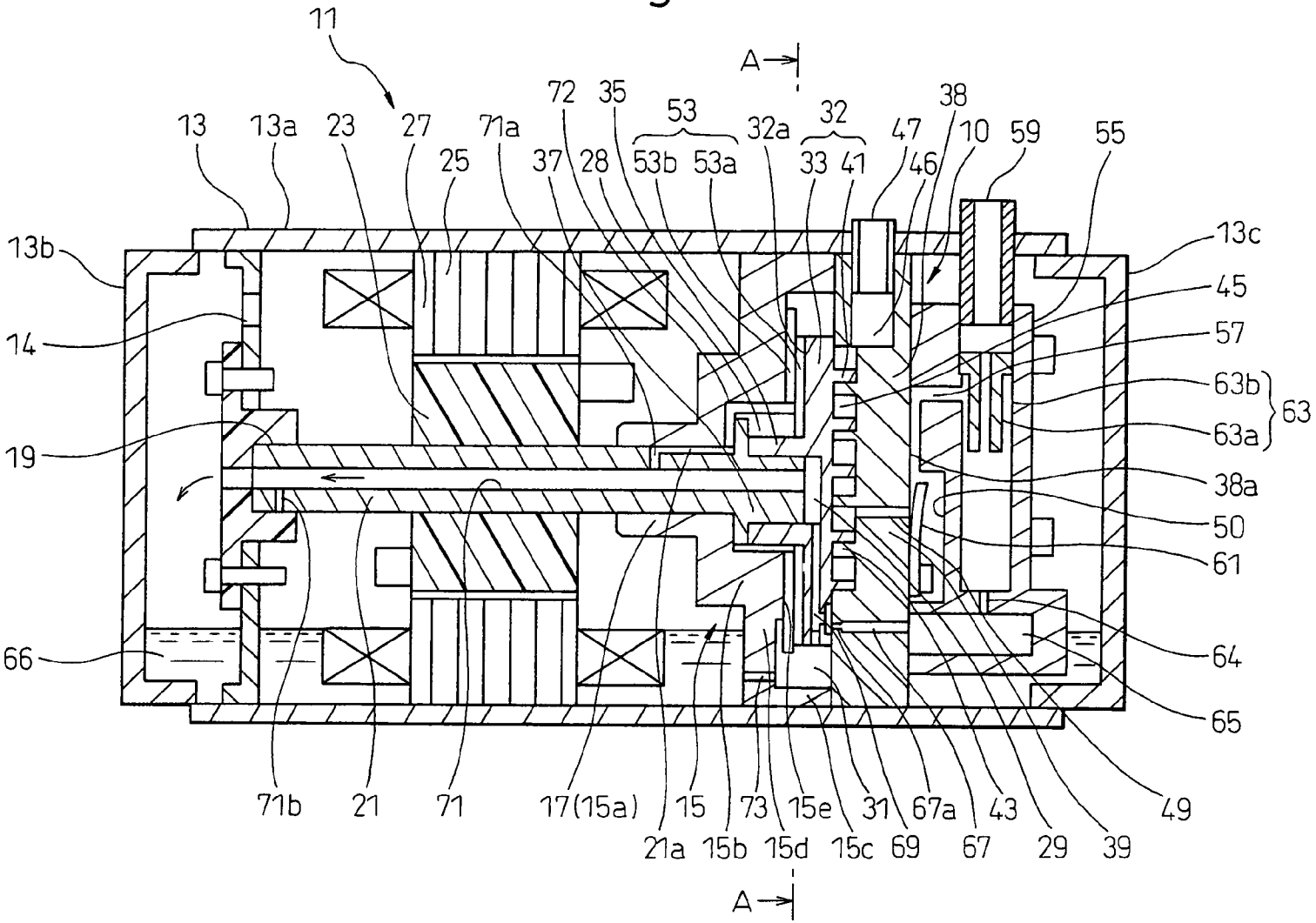
FIG. 1 is a longitudinal sectional view showing a scroll compressor according to a first embodiment.

FIG. 1 is a longitudinal sectional view showing a scroll compressor 11 according to this embodiment. This embodiment represents a compressor for a water heater in the refrigeration circuit which uses carbon dioxide as a refrigerant and in which the pressure of carbon dioxide discharged exceeds the critical pressure thereof. Nevertheless, the invention is not limited to this compressor.

The scroll compressor 11 according to this embodiment is a motor driven hermetic compressor having a closed container 13 accommodating a motor unit 27 and a compression mechanism 10.

The closed container 13 includes a cylindrical case 13*a*, a motor-side end case 13*b* assembled and a compression mechanism-side end case 13*c* at each end of the cylindrical case 13*a*.

The motor unit 27 includes a stator 25 fixed on the inner peripheral surface of the cylindrical case 13*a* and a rotor 23 fixed on the shaft 21 rotationally driven by the motor unit 27.

The compression mechanism 10 includes a middle housing 15 fixed at a position adjacent to the stator 25 in the cylindrical case 13*a*, a movable scroll 32 orbited by a crank mechanism 28 supported by a main bearing 17 arranged on the middle housing 15, and a fixed scroll 38 fixed on the cylindrical case 13*a* on the side of the middle housing 15 far from the stator 25 in opposed relation to the movable scroll 32 thereby to form a working chamber 45 described later.

The shaft 21 is supported substantially horizontally by a main bearing 17 and an auxiliary bearing 19 fixed on a discal support member 14 interposed between the stator 25 and the motor-side end case 13*b* in the cylindrical case 13*a*.

The movable scroll 32 includes a substantially discal movable-side plate 33, a movable-side spiral 41 erected in an involute curve toward the fixed scroll 38 from the end surface of the movable-side plate 33 and a boss 35 erected cylindrically toward the middle housing 15 from the end surface far from the movable-side spiral 41.

The fixed scroll 38 includes a fixed-side plate 39 fixed on the cylindrical case 13*a* and a fixed-side spiral 43 formed of a spiral groove arranged on the end surface of the fixed-side plate 39 nearer to the movable scroll 32.

The middle housing 15 assumes the form of a triple-step cylinder having a progressively larger diameter toward the fixed scroll 38 from the motor unit 27. The cylinder 15*a* having the smallest diameter near to the motor unit 27 makes up a main bearing 17, and the middle cylinder 15*b* makes up a crank chamber 29 for accommodating the crank mechanism 28. The cylinder 15*c* having the largest diameter near to the fixed scroll 38, on the other hand, forms a scroll housing 31 for accommodating the movable scroll 32 and fixed on the inner peripheral surface of the cylindrical case 13*a* by a fixing means such as shrink fitting.

The crank mechanism 28 is comprised of an eccentric shaft 37 arranged integrally at the end of the shaft 21 nearer to the compression mechanism 10 and the boss 35 of the movable scroll 32. The eccentric shaft 37 is decentered a given amount e (FIG. 2A) from the axial center of the main bearing 17 and the auxiliary bearing 19. This eccentricity e makes up the orbital radius of the movable scroll 32.

An Oldham coupling not shown is arranged on the end surface (hereinafter referred to as the disk-unit scroll-side end surface 15*e*) of the disk unit 15*d*, nearer to the movable scroll 32, connecting the large-diameter cylinder 15*c* and the middle cylinder 15*b* making up the middle housing 15 thereby to prevent the rotation of the movable scroll 32. As a result, the movable scroll 32 is permitted only to orbit. In the compression mechanism 10, the volume of the working chamber 45 formed by mesh between the movable-side spiral 41 and the fixed-side spiral 43 is reduced by the revolution of the movable scroll 32 with respect to the fixed scroll 38 thereby to compress the refrigerant supplied to the intake chamber 46 communicating with the outermost peripheral side of the fixed-side spiral 43.

Also, a thrust bearing 53 is arranged between the disk-unit scroll-side end surface 15*e* and the end surface of the movable scroll 32 formed with the boss 35 (hereinafter referred to as the movable scroll back surface 32*a*). This thrust bearing 53 is a slide bearing for sliding between the movable scroll back surface 32*a* and the disk-unit scroll-side end surface 15*e* under the axial force (in this embodiment, the force pushing the movable-side plate 33 from the fixed scroll 38 toward the disk unit 15*d*) received by the movable-side plate 33 due to the difference between the reaction force generated at the time of compression of the refrigerant and the force generated in thrust direction by the pressure on the movable scroll back surface 32*a*. This thrust bearing 53 is explained in detail later.

The intake chamber 46 is arranged on the side surface of the fixed-side plate 39 and connected with an intake tube 47 for introducing the refrigerant from the refrigerant circuit external to the closed container 13 through the cylindrical case 13*a*.

A discharge port 49 is formed axially through the fixed-side plate 39 at the central portion of the fixed-side spiral 43. The refrigerant compressed by the movable scroll 32 and the fixed scroll 38 is discharged into a discharge chamber 50 from the discharge port 49.

The discharge chamber 50 is comprised of a depression formed by the end surface (hereinafter referred to as the fixed scroll back surface 38*a*) on the side of the fixed-side plate 39 far from the movable scroll 32 and the end surface of the separator block 55, nearer to the fixed-side plate 39, fixed on the fixed scroll back surface 38*a*. Incidentally, the discharge chamber 50 has therein a discharge valve 61 for preventing the reverse flow of the refrigerant discharged.

The high-temperature high-pressure refrigerant discharged into the discharge chamber 50 is led to an oil separator 63 through a refrigerant path 57 extending upward from the discharge chamber 50.

The oil separator 63 is of centrifugal double-cylinder type and includes an inner cylinder 63*a* and an outer cylinder 63*b*.

The refrigerant path 57, after extending upward along the fixed scroll back surface 38*a* from the discharge port 50, is connected, substantially tangentially, to the space between the inner cylinder 63*a* and the outer cylinder 63*b* of the centrifugal oil separator 63. The refrigerant flowing into the space between the inner cylinder 63*a* and the outer cylinder 63*b* substantially in tangential direction revolves in the space between the inner cylinder 63*a* and the outer cylinder 63*b*. After the oil contained in the refrigerant is centrifugally separated, the refrigerant is sent to the refrigerant circuit external to the closed container 13 through the inner cylinder 63*a* and the discharge tube 59. According to this embodiment, the oil preferably comprises, as a main component, a lubricating oil composed of selected one of polyalkylene glycol, polyvinyl ether and polyol ester or any combination thereof.

Incidentally, the outer cylinder 63*b* of the oil separator 63 is comprised of a cylindrical hole formed in the separator block 55, and the inner cylinder 63*a* is fixed by a fixing means such as press fitting or a circlip into the cylindrical hole making up the outer cylinder 63*b*.

Also, the discharge chamber 59 is hermetically inserted into the upper end of the cylindrical hole making up the outer cylinder 63*b* through the wall of the closed container 13. Incidentally, the space between the separator block 55 and the compression mechanism-side end case 13*c* constitutes an atmosphere lower in pressure than the refrigerant discharged.

The oil separated by the oil separator 63 moves downward by gravitation along the inner wall surface of the outer cylinder 63*b*, and stored in a high-pressure oil storage 65 through a small-diameter hole 64 formed at the lower end of the cylindrical hole of the outer cylinder 63*b*.

The high-pressure oil storage 65 is arranged in the separator block 55, and located under the cylindrical hole making up the outer cylinder 63*b* and the discharge chamber 50. In order to increase the amount of the high-pressure oil that can be stored in the high-pressure oil storage 65, the separator block 55 is configured so that the lower portion thereof making up the high-pressure oil storage 65 is projected toward the compression mechanism-side case 13*c* more than the upper portion thereof corresponding to the cylindrical hole making up the outer cylinder 63*b*.

The oil stored in the high-pressure oil storage 65 is led to the oil path 69 in the movable-side plate 33 by way of the oil return path 67 through the fixed-side plate 39 under the fixed-side spiral 43. Incidentally, a small-diameter restrictor 67*a* is arranged at the outlet of the oil return path 67.

The inlet of the oil path 69 opens to the surface of the movable-side plate 33 having the movable-side spiral 41. This inlet is countersunk to secure a larger sectional area than the other parts of the oil path 69. The inlet of the oil path 69 is adapted to communicate intermittently with the outlet of the oil return path 67 by the orbiting motion of the movable scroll 32. Also, the outlet of the oil path 69 is open to the inner wall of the boss 35 to communicate with the space between the end portion of the shaft 21 and the bottom surface of the boss 35.

Incidentally, the oil stored in the high-pressure oil storage 65, though high in pressure due to the discharge pressure of the refrigerant, is reduced to the desired pressure level by the intermittent communication between the oil return path 67 and the oil path 69 due to the orbiting motion of the movable scroll 32 and the restrictor 67*a*.

The oil led to the space between the end portion of the shaft 21 and the bottom surface of the boss 35 flows into the oil path 71 formed axially through the shaft 21.

The oil that has passed through the oil path 71 is led between the motor-side end case 13*b* and the support member 14 in the closed container 13. The support member 14, the middle housing 15 and the fixed-side plate 39 have a gap, not shown, with the cylindrical case 13*a*. The oil that has been led between the motor-side end case 13*b* and the support member 14, therefore, is stored over the entire inner lower part of the closed container 13. The entire inner lower part of the closed container 13 makes up a low-pressure oil storage 66.

The oil stored in the low-pressure oil storage 66 reaches the scroll housing 31 through the oil return hole 73 formed in the lower part of the disk unit 15*d* of the middle housing 15.

The oil path 71 has arranged therein diametrical holes 71*a*, 71*b* branching from the oil path 71 at the parts thereof corresponding to the main bearing 17 and the auxiliary bearing 19.

The outlet of the diametrical hole 71*a* communicates with the shaft groove 21*a* arranged on the shaft 21, and the oil that has flowed into the diametrical hole 71*a*, after lubricating the main bearing 17, the crank mechanism 28 and the thrust bearing 53, reaches the scroll housing 31. An oil groove 72 for establishing communication between the diametrical hole 71*a* and the thrust bearing 53 is formed on the middle cylinder 15*b* above the shaft 21 to lead the oil to the thrust bearing 53 above the shaft 21.

The oil that has flowed into the diametrical hole 71*b*, on the other hand, after lubricating the auxiliary bearing 19, drops into the low-pressure oil storage 66 and reaches the scroll housing 31 through the oil return hole 73.

The oil return path 67, the oil paths 69, 71 and the diametrical hole 71*a* make up an oil supply means for supplying the oil to the thrust bearing 53 due to the pressure difference between the oil separated by the oil separator 63 and the portion where the thrust bearing 53 is arranged.

The oil that has reached the scroll housing 31 is supplied to the sliding surfaces of the movable scroll 32 and the fixed scroll 38, compressed together with the refrigerant in the working chamber 45, and separated from the refrigerant by the oil separator 63.

Next, the thrust bearing 53 according to the invention will be explained. The thrust bearing 53 according to the invention is comprised of a scroll-side plate 53*a* fixed on the movable scroll back surface 32*a* and a housing-side plate 53*b* fixed on the disk-unit scroll-side end surface 15*e*.

The scroll-side plate 53*a* is formed in the shape of a donut, of which central hole is penetrated by the boss 35. The end surface of the scroll-side plate 53*a* in sliding contact with the housing-side plate 53*b* is formed with substantially circular concavo-convex portions as shown in FIG. 2A.

Figure 2A:
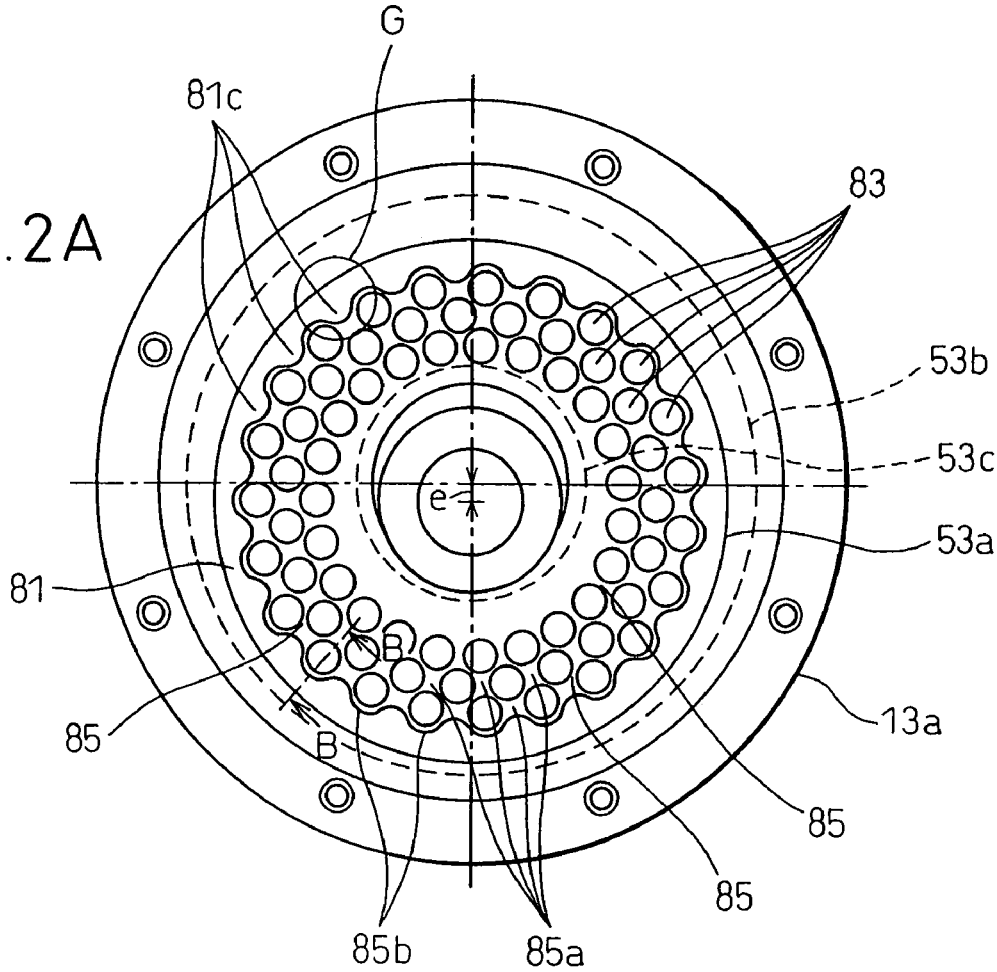
FIG. 2A is a diagram showing a movable-side sliding surface of the thrust bearing of the scroll compressor shown in FIG. 1.
Figure 2B:
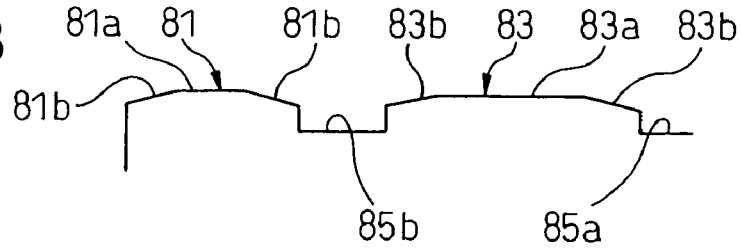
FIG. 2B is a sectional view taken along line B-B in FIG. 2A in such a manner that the cross section of the substantially circular concavo-convex surface is visible.
Figure 2C:
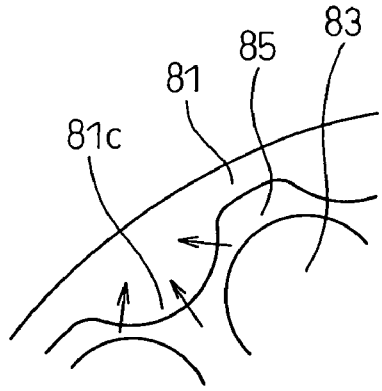
FIG. 2C is an enlarged view of the portion designated by the reference character G in FIG. 2A.

FIG. 2A is a sectional view taken along line A-A in FIG. 1 in such a manner that the end surface of the scroll-side plate 53*a* in sliding contact with the housing-side plate 53*b* is visible. FIG. 2B is a sectional view taken along line B-B in FIG. 2A in such a manner that the cross section of the substantially circular concavo-convex portions is visible, and FIG. 2C is an enlarged view of the portion designated by G in FIG. 2A. In FIG. 2A and FIG. 6 described later, the housing-side plate 53*b* indicated by dashed line and the radially inward edge 53*c* of the housing-side plate 53*b*, though invisible in the FIGS. 2A and 6, are shown in FIGS. 2A and 6 to indicate the relative positions thereof with the housing-side plate 53*a*.

The depressed parts of the substantially circular concavo-convex portions are comprised of a plurality of grooves 85. The plurality of the grooves 85, supplied with the oil by the oil supply means, are formed in a network pattern with intersections 85*a* having a larger groove width than the other parts. Also, the bottom surface roughness of each groove 85 shown in FIG. 2B is not less than 12.5 Rz and larger than the surface roughness of the pressure receiving portions 83 described later. Of all the plurality of the grooves 85, the groove 85*b* located on the outermost periphery (hereinafter referred to as the outermost peripheral groove 85*b*) makes a round in zigzag along the edge of the scroll-side plate 53*a*. Between the outermost peripheral groove 85*b* and the edge of the scroll-side plate 53*a*, an outer peripheral seal portion 81 is formed and kept in sliding contact with the housing-side plate 53*b* over the whole periphery thereby to reduce the amount of the lubricating oil flowing out from the sliding surfaces. The seal portion 81 has protrusions 81*c* curved to expand radially inward of the scroll-side plate 53*a* by the zigzag form of the outermost peripheral groove 85*b*. As shown in FIG. 2C, the protrusions 81*c*, like the pressure receiving portions 83 described later, have the function of forming an oil film by pulling in the oil from all the directions faced by the protrusions 81*c* due to the revolving motion of the movable scroll 32.

The protrusions surrounded by and formed between the plurality of the grooves 85 constitute the insular pressure receiving portions 83, which are formed substantially circular and arranged in staggered fashion conforming with the zigzag of the outermost peripheral grooves 85. For the purposes of exclusion of foreign matter and reducing the contact pressure, the diameter of the pressure receiving portions 83 is desirably not less than the orbital radius but less than twice the orbital radius, i.e. not less than e but less than 2e (e: amount of eccentricity of the movable scroll 32) on the one hand, and the area ratio of the pressure receiving portions 83 to the grooves 85 on the sliding surface of the scroll-side plate 53*a* is desirably not less than 50%. Also, the upper surface of the seal portion 81 and the pressure receiving portions 83 are smoothed as the sliding surface and substantially flush with each other. As shown in FIG. 2B, tapered portions or sagged roundish portions 81*b*, 83*b* are formed along the edge of the pressure receiving portions 83 to generate the wedge effect of the oil film, and the housing-side plate 53*b* is in sliding contact with the flat portions 81*a*, 83*a*.

Also, according to this embodiment, the thrust bearing 53 is formed with the concavo-convex portions on the scroll-side plate 53 fixed on the movable scroll 32, and therefore, the plurality of the grooves 85 making up the concavo-convex portions are moved relatively to the shaft 21 with the revolution of the movable scroll 32.

In the housing-side plate 53*b*, the surface in sliding contact with the scroll-side plate 53*a* is mirror-finished as a plane flat surface. The housing-side plate 53*b* thus assumes a donut-like form similar to the scroll-side plate 53*a*.

Figure 3:
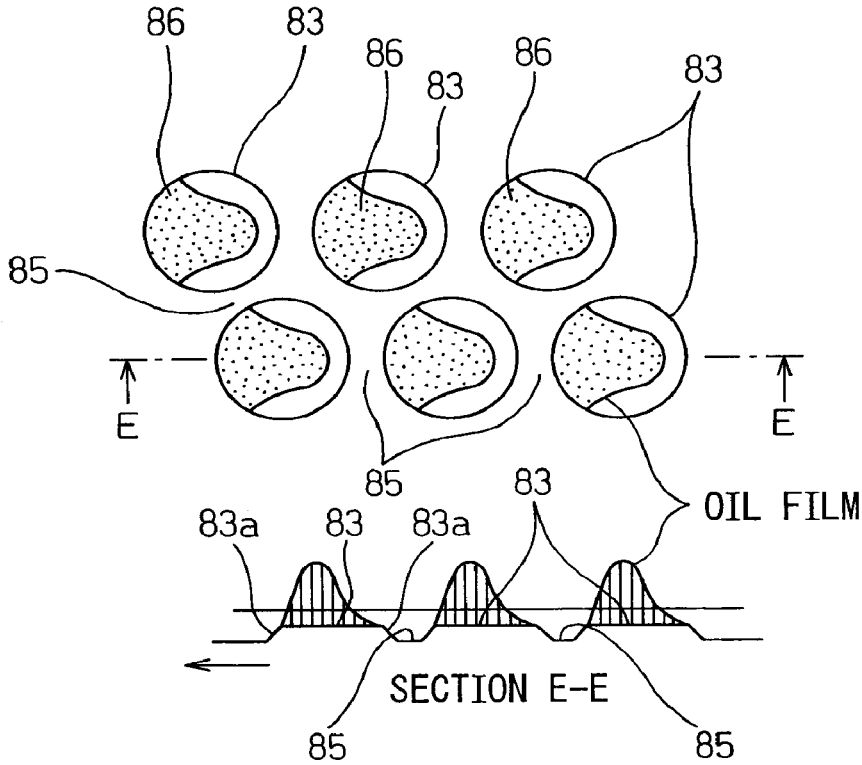
FIG. 3 is a diagram showing the manner in which the oil film is formed on the insular pressure receiving portions on the movable-side sliding surface shown in FIG. 2 and the pressure thereof.

With this configuration, the oil held in the grooves 85 forms an oil film 86, as shown in FIG. 3, on the pressure receiving portions 83 due to the wedge effect of the sagged portions and the tapered portions 81*b*, 83*b* formed around the pressure receiving portions 83 by the sliding contact between the scroll-side plate 53*a* and the housing-side plate 53*b*. This oil film 86 contains the refrigerant dissolved therein.

According to this embodiment, the bottom surface of the grooves 85 has a large degree of roughness, and therefore, the lubricating oil can be positively held on the rough surface. As a result, even in the case where the scroll compressor 11 is operated with the oil supply temporarily suspended to the sliding surfaces of the thrust bearing 53, the sliding surfaces can be sufficiently lubricated by the oil held on the bottom surface of the grooves 85.

Figure 7:
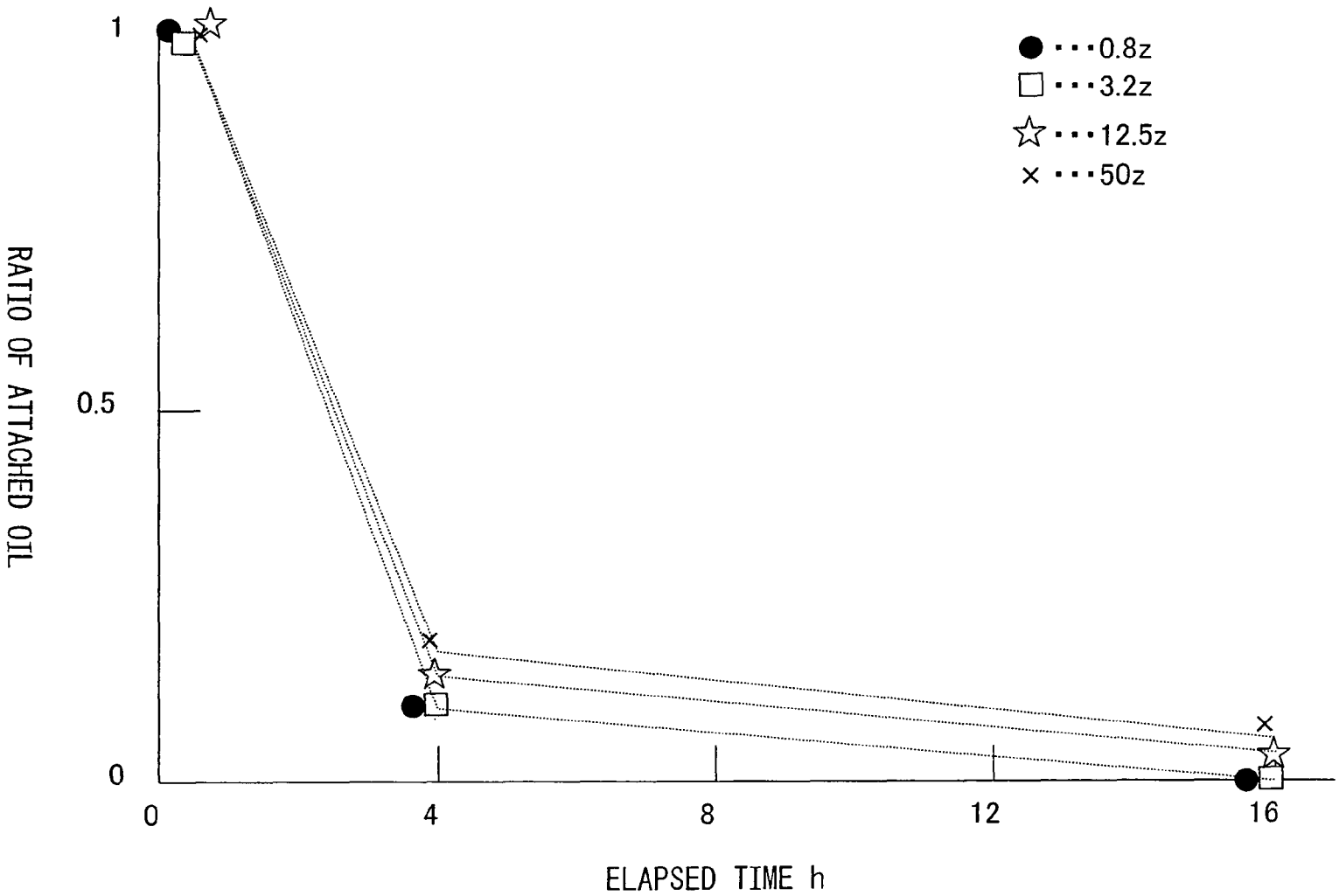
FIG. 7 is a diagram showing the relation between the roughness of the bottom surface of the grooves 85 and the amount of oil attached with the lapse of time.

FIG. 7 is a diagram showing the relationship between the degree of roughness of the bottom surface of the grooves 85 and the amount of oil attached with the lapse of time. In FIG. 7, circles, squares, asterisks and crosses are symbols referring to test pieces having different degrees of roughness of the bottom surface of the grooves 85. In order to measure the amount of oil attached, the grooves 85 of test pieces are left in vertical positions and a predetermined amount of the oil equivalent to the refrigerator oil during the operation of the compressor is applied. Then, the weight of the oil with the lapse of time is measured. As a measure of the characteristic to be satisfied by the compressor used for the water heater, the operation pattern of the water heater is assumed as eight hours in operation followed by 16 hours out of operation, and the amount of the oil attached recognizable (one thirties) upon the lapse of 16 hours is used. Although in the case of the roughness of less than 12.5 z, no oil was detected, in the case of the roughness of 12.5 z it has been found that the deposition of the oil in measurable amount can be confirmed and the oil film can be held effectively.

Also, according to this embodiment, a plurality of the grooves 85 communicating with each other are formed on the sliding surface of the thrust bearing 53 to store the oil, and the amount of the oil flowing out of the sliding surfaces is reduced by the seal portion 81. Even in the case where the scroll compressor 11 is operated with the oil supply temporarily suspended to the sliding surfaces, therefore, the sliding surfaces can be sufficiently lubricated with the stored oil.

Also, according to this embodiment, the plurality of the grooves 85 are formed in a network pattern and communicate with each other, and therefore, the oil can be supplied between the grooves in communication with each other. Thus, the seizure is less likely to occur which otherwise might be caused by the short supply of the oil.

If the grooves formed on the sliding surface are independent of each other, the oil would fail to be refilled and a negative pressure would occur on the sliding surfaces in the case where the oil flows out of the sliding surfaces with the oil supply suspended. Then, the sliding surfaces would stick to each other and develop the seizure. According to this embodiment, however, the grooves 85 communicate with each other and therefore the negative pressure is prevented from being generated.

Also, in view of the fact that the plurality of the grooves 85 are formed in a network pattern and the pressure receiving portions 83 surrounded by the grooves 85 are each in the shape of an island and defined by the grooves over the entire periphery thereof, the oil film 86 can be formed by the wedge effect from all the directions by the revolving motion of the movable scroll 32. Further, the width of the intersections 85*a* of the plurality of the network grooves 85 is larger than that of the remaining portions, and therefore, the oil can sufficiently cover all the plurality of the grooves 85.

Also, the pressure receiving portions 83 are each in the shape of a substantially circular island, and therefore, the lubricating oil can be introduced into the pressure receiving portions 83 from all the directions. Further, the pressure receiving portions 83, being formed in staggered fashion, can be arranged with high density. Thus, the oil film-forming part per unit area can be increased and a heavy load can be supported.

Also, the lubricating oil can be supplied to the portion of the thrust bearing above the shaft 21 due to the pressure difference between the oil separated by the oil separator 63 and the portion where the thrust bearing is arranged. Therefore, the lubricating oil can be led to the thrust bearing positively even in the scroll compressor with the shaft 21 supported in substantially horizontal direction.

Also, in view of the fact that the grooves 85 are formed on the scroll-side plate 53*a* fixed on the movable scroll 32, the grooves 85 are moved relatively to the shaft 21 with the revolution of the movable scroll 32. As a result, the oil held on the bottom surface of the grooves 85 is easily supplied in spray to the sliding surfaces.

Figure 4A:
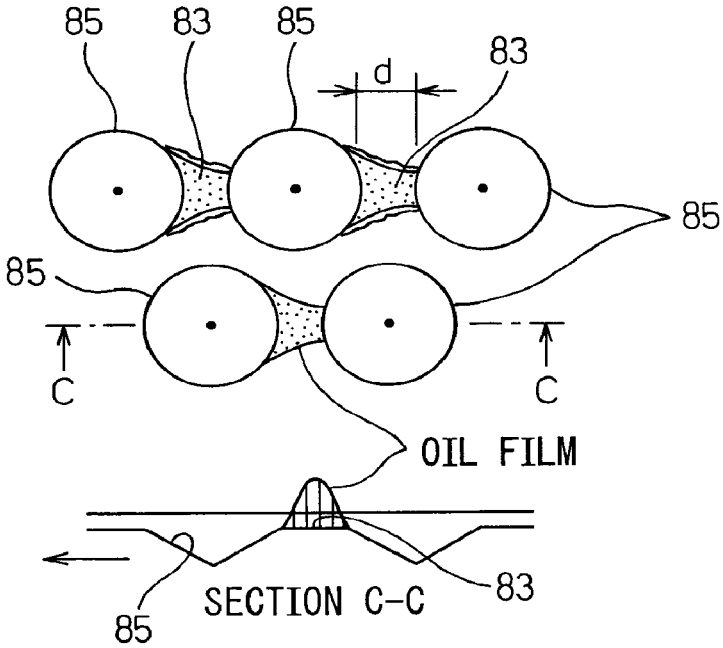
Fig.4A Prior art
FIGS. 4A and 4B are diagrams showing the manner in which the oil film is formed in the case where a multiplicity of circular grooves are formed as oil pools on the sliding surface of the thrust bearing and the pressure thereof.
Figure 4B:
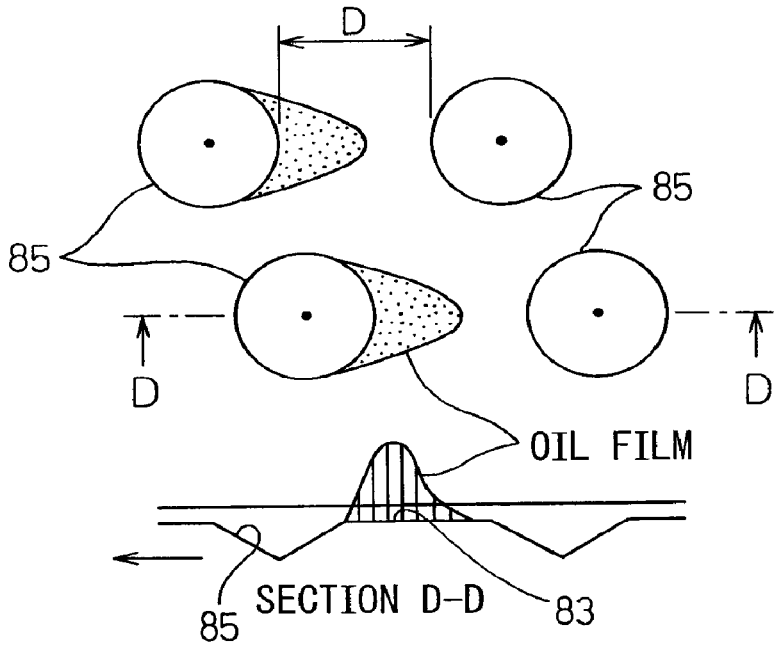
Fig.4B Prior art

Also, as shown in FIG. 4A, in the case where the grooves 85 are circular and the distance is short between adjacent grooves 85, the oil film formed would cover adjacent grooves 85 and lose the pressure. To cope with this problem, as shown in FIG. 4B, a method may be conceived in which the distance D between the adjacent grooves 85 is increased. This configuration, however, will reduce the portion where the oil film is formed, resulting in a lower supporting pressure.

In the thrust bearing 53 according to this embodiment, in contrast, as shown in FIG. 3, the insular pressure receiving portions 83 are formed in spaced and isolated relationship to each other, and the grooves 85 are formed continuously around the insular pressure receiving portions 83 arranged in spaced relation to each other. The insular pressure receiving portions 83, therefore, can be sufficiently supplied with the lubricating oil over a wide range from the surrounding grooves 85. As a result, even in the case where the insular pressure receiving portions 83 are arranged in proximity to each other with high density, the lubricating oil can be refilled on the sliding surfaces. This increases the area where the oil film is formed per unit area, and a heavy load can be supported, thereby providing a thrust bearing high in lubricity.

Figure 5:
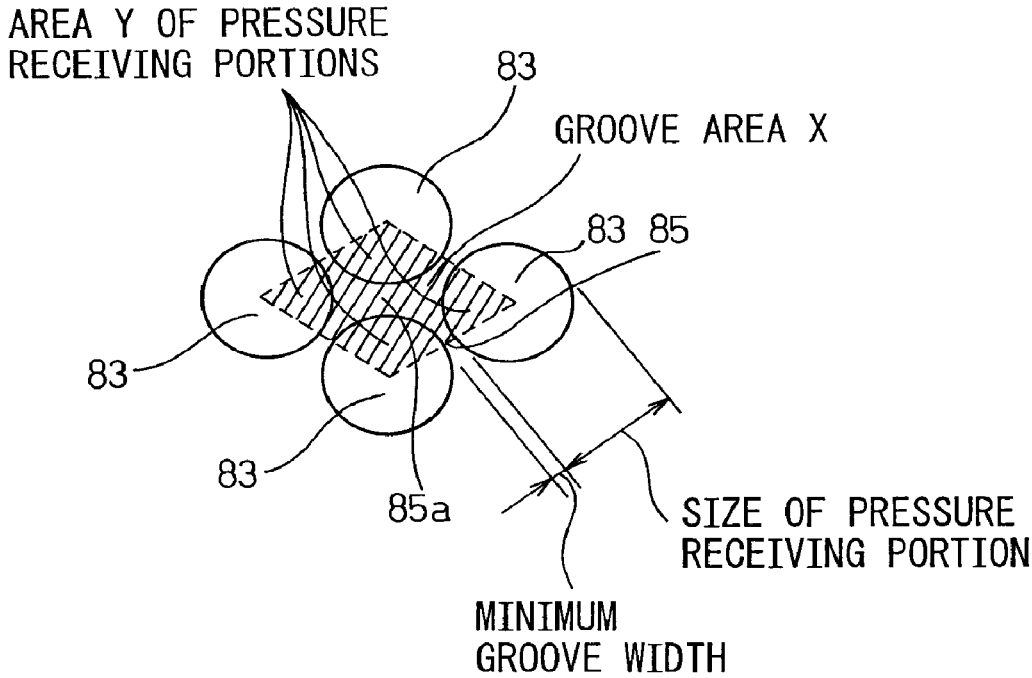
FIG. 5 is a diagram showing size of the area X of the grooves 85 of the four adjacent pressure receiving portions and the size of the area Y of the pressure receiving portion 83.
Figure 6A:
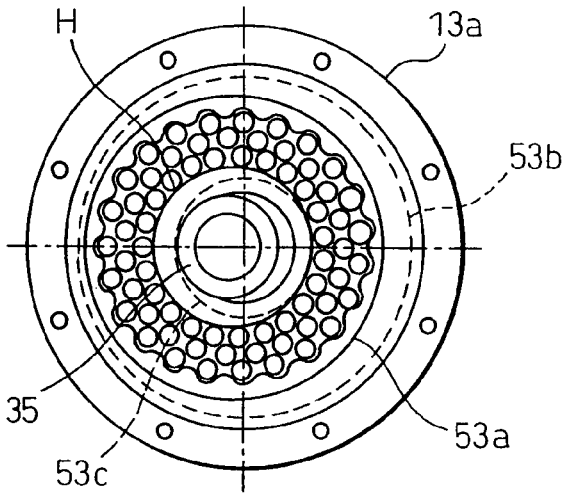
FIG. 6 is a diagram showing the manner in which the scroll-side plate 53*a* is moved in the cylindrical case 13*a* with the orbiting of the movable scroll 32.
Figure 6B:
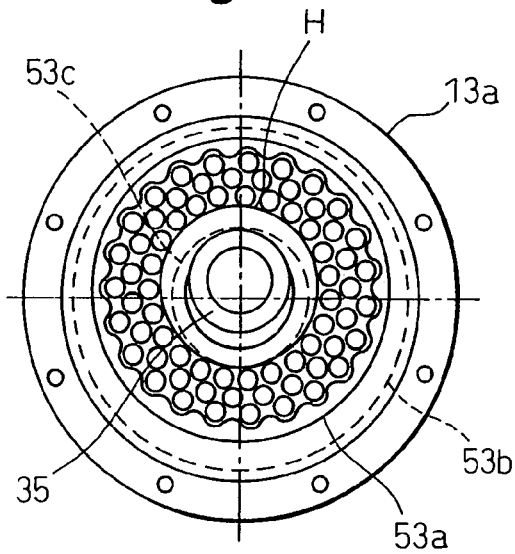
Figure 6D:
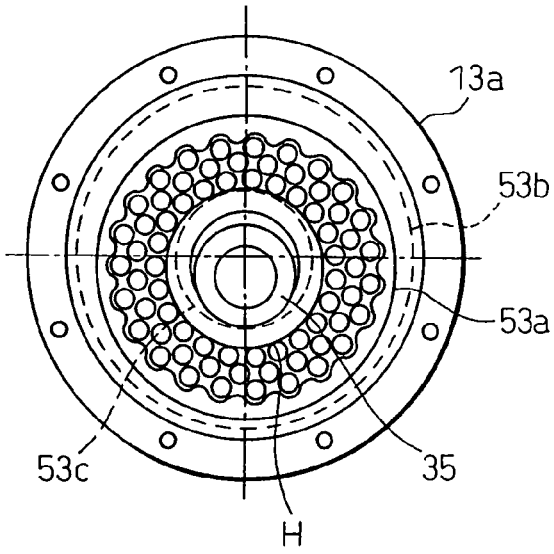
Figure 6C:
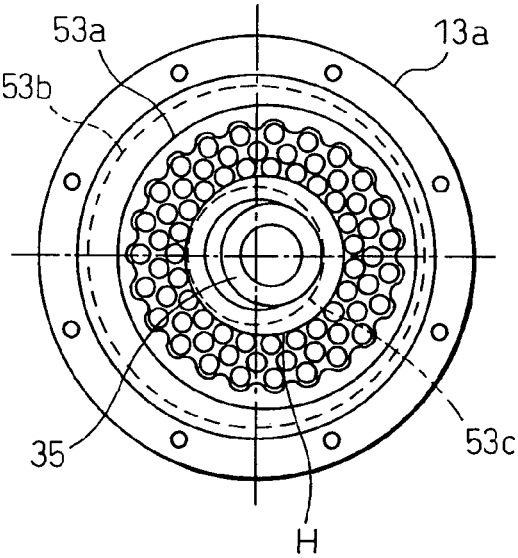

Also, as shown in FIG. 5, a square area formed by connecting the centers of the four adjacent pressure receiving portions 83 is designed in such an area ratio that the area Y of the pressure receiving portions 83 is larger than the area X of the grooves 85, 85*a*. Specifically, the minimum groove width is designed in a value smaller than the size of the pressure receiving portions 83.

Also, since the grooves 85 which are formed on the sliding surface 53*a* on the side of the movable scroll 32 and which hold the lubricating oil also move, the lubricating oil can be supplied to the sliding surfaces more uniformly.

Next, the relative positions of the pressure receiving portions 83 arranged on the scroll-side plate 53*a* and the housing-side plate 53*b* with the orbiting motion of the movable scroll 32 are explained with reference to FIG. 6. FIG. 6 is a diagram showing the manner in which the scroll-side plate 53*a* moves in the cylindrical case 13*a* with the orbiting of the movable scroll 32. With the orbiting motion of the movable scroll 32, the scroll-side plate 53*a* moves to the positions (a), (b), (c) and (d) in that order. Let H be the envelope plotted by the inner peripheral edge 53*c* of the housing-side plate 53*b* by the relative motions of the scroll-side plate 53*a* and the housing-side plate 53*b*. The plurality of the pressure receiving portions 83 are arranged only on radially outside the envelope H on the scroll-side plate 53*a*. As a result, even in the case where the movable scroll 32 moves by orbiting, the pressure receiving portions 83 are not displaced out of the housing-side plate 53*b*, and a sufficient oil film is formed by the oil held in the plurality of the grooves 85.

Incidentally, the envelope H according to this invention constitutes a circle larger by the revolution radius of the movable scroll 32 than the inner peripheral edge 53*c* of the housing-side plate 53*b*.

Second Embodiment

Figure 12:
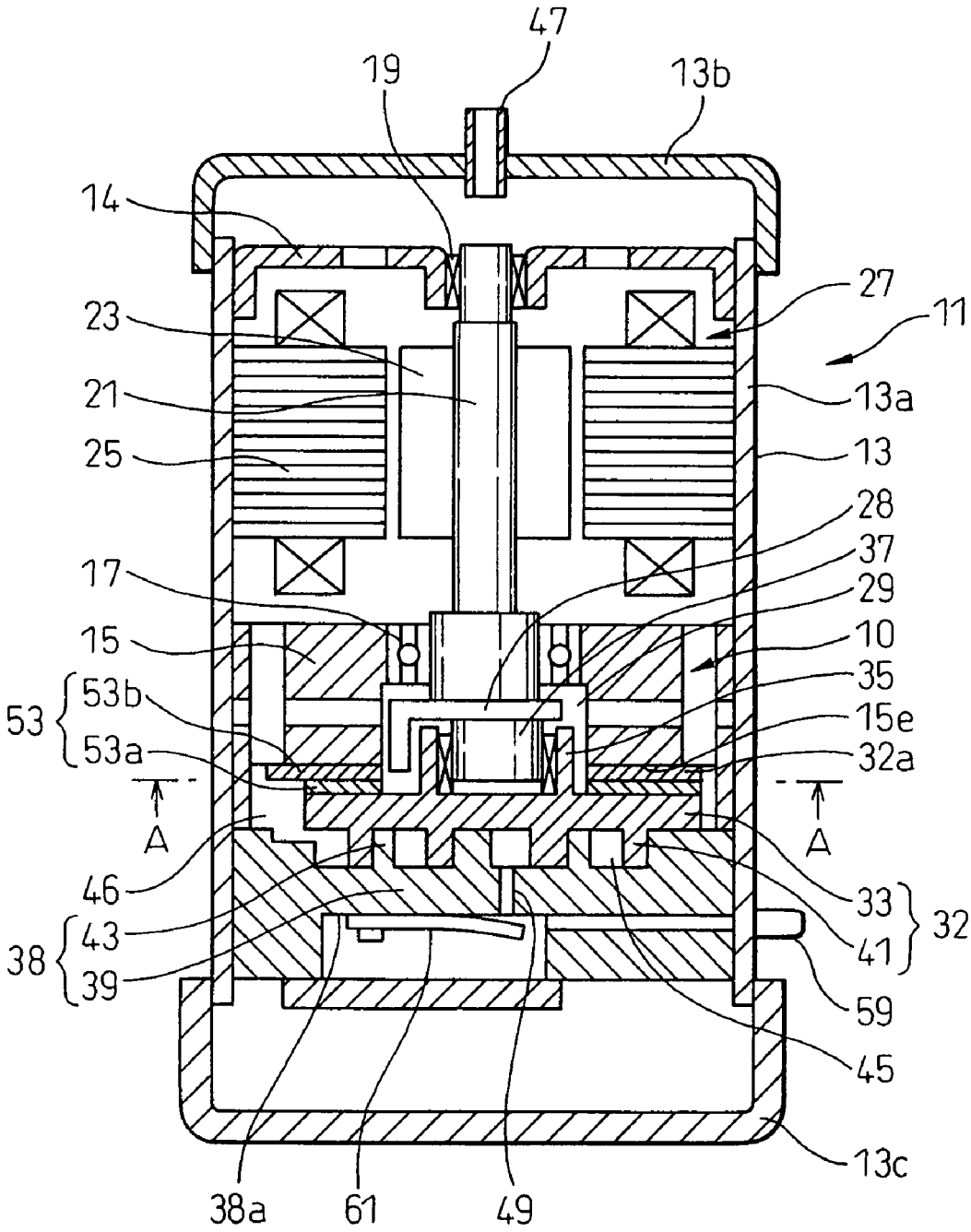
FIG. 12 is a longitudinal section view of a scroll compressor according to a second embodiment of the invention.

Although the shaft 21 is arranged in a horizontal direction in the first embodiment described above, the invention is not limited to this configuration, and applicable also to a compressor having the shaft 21 arranged vertically as shown in FIG. 12. In FIG. 12, the component parts identical with those of the first embodiment are designated by the same reference numerals, respectively.

In FIG. 12, the lubricating oil and the refrigerant flowing in from the intake tube 47 lubricate the auxiliary bearing 19 while at the same time being led to the motor chamber with the motor unit 27 arranged therein inside the closed container 13 through the opening formed in the support member 14. The refrigerant and the oil led to the motor chamber lubricate the main bearing 17 and the crank mechanism 28 on the one hand and the oil is supplied to the thrust bearing 53 through the vertical hole formed in the middle housing 15 and led to the intake chamber 46 on the other hand.

According to the aforementioned embodiments, the closed container 13 is comprised of three cases including the cylindrical case 13*a*, the motor-side end case 13*b* and the compression mechanism-side end case 13*c*. Nevertheless, the invention is not limited to this configuration, and any two of the three cases may be configured as a single part.

Also, according to the aforementioned embodiments, the fixed scroll 38 is fixed on the cylindrical case 13*a*. Nevertheless, the fixed scroll 38 may alternatively be fixed on the compression mechanism-side end case 13*c* or the middle housing 15.

Further, the support member 14, though fixed on the cylindrical case 13*a* according to the aforementioned embodiments, may alternatively be fixed on the motor-side end case 13*b*.

According to the aforementioned embodiments, the fixed-side spiral 43 is formed by the spiral groove formed on the end surface of the fixed-side plate 39. Nevertheless, the invention is not limited to this configuration, and the fixed-side spiral 43 may be erected from the end surface of the fixed-side plate 39 toward the movable scroll 38.

Also, according to the aforementioned embodiments, the eccentric shaft 37 is formed integrally with the end portion of the shaft 21. The invention, however, is not limited to this configuration, and the eccentric shaft 37 may be arranged displaceably with respect to the end portion of the shaft 21.

Also, according to the embodiments described above, the movable scroll back surface 32*a* is placed in a low-pressure atmosphere. The invention, however, is not limited to this configuration, and the pressure of the discharged refrigerant may be made to act on the movable scroll back surface 32*a* thereby to press the movable-side plate 33 against the fixed scroll. In this case, the movable-side plate 33 is pressed against the fixed scroll 38 from the disk unit 15*d* side, and therefore, the thrust bearing 53 may be arranged between the movable-side plate 33 and the fixed-side plate 39.

Also, according to the aforementioned embodiments, the thrust bearing 53 is comprised of the scroll-side plate 53*a* fixed on the movable scroll back surface 32*a* and the housing-side plate 53*b* fixed on the disk-unit scroll-side end surface 15*e*. The invention, however, is not limited to this configuration, and the movable scroll 32 may be formed directly with a plurality of the grooves 85 and the pressure receiving portions 83 for direct sliding contact. As another alternative, the thrust bearing 53 may be comprised of a single plate having a plurality of grooves or three or more plates.

Also, according to the embodiments described above, the pressure receiving portions 83 are each formed substantially in a circle and arranged in staggered fashion. The invention, however, is not limited to this configuration, and the pressure receiving portions 83 may alternatively be arranged in the shape of a cocoon or linearly. As another alternative, the plurality of the grooves 85 may be comprised of grooves radially extending from the center of the scroll-side plate 53*a* and annular grooves concentric with the scroll-side plate 53*a* in the form perpendicular to the radially extending grooves, or a plurality of spirally arranged grooves.

Also, according to the aforementioned embodiments, the scroll-side plate 53*a* fixed on the movable scroll is formed with concavo-convex portions so that the plurality of the grooves 85 may move relative to the shaft 21 with the revolution of the movable scroll 32. The invention, however, is not limited to this configuration, and without fixing the scroll-side plate 53*a* on the movable scroll 32, the grooves 85 may be configured to move relatively to the shaft 1 as the result of revolution of the movable scroll 32.

Also, according to the aforementioned embodiments, the outer peripheral seal portion 81, the pressure receiving portions 83 and the grooves 85, though formed on the scroll-side plate 53*a*, may alternatively be formed on the fixed-side sliding surface 53*b* of the scroll accommodation depression 31.

Also, according to the aforementioned embodiments, the oil supply means is employed by which the oil is supplied to the thrust bearing 53 due to the pressure difference between the oil separated by the oil separator 63 and the portion where the thrust bearing 53 is arranged. The invention, however, is not limited to this configuration, and any configuration can be employed in which the oil is led to the thrust bearing 53 and the oil supply means is not required to utilize the pressure difference.

Also, according to the embodiments described above, the plurality of the pressure receiving portions 83 are arranged only on radially outside the envelope H plotted by the inner peripheral edge of the housing-side plate 53*b* by the relative motion between the scroll-side plate 53*a* and the housing-side plate 53*b*. In the case where the outer diameter of the housing-side plate 53*b* is small and the scroll-side plate 53*a* is liable to be displaced out of the edge of the housing-side plate 53*b* with the revolution of the movable scroll 32, however, the pressure receiving portions 83 may be arranged only on radially inside the envelope (a circle smaller by the revolution radius than the outer diameter of the housing-side plate 53*b*) plotted by the outer peripheral edge of the housing-side plate 53*b*.

Figure 8:
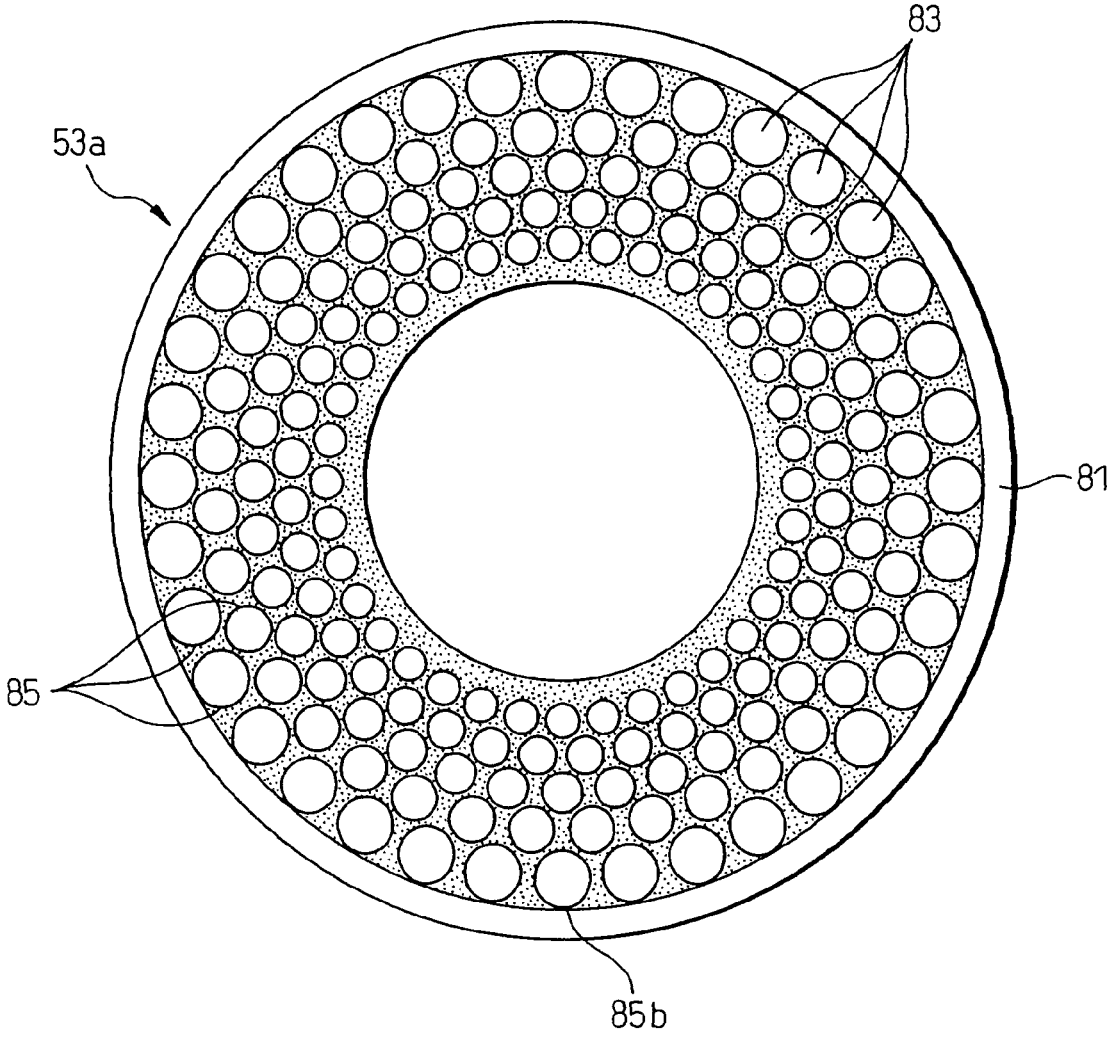
FIG. 8 is a diagram showing the sliding surface of the thrust bearing 53 comprised of the pressure-receiving unit 83 reduced in size progressively toward the inner peripheral side thereof.

Also, as shown in FIG. 8, the thrust bearing 53 may be comprised of the pressure receiving portions 83 progressively reduced in size toward the inner periphery. As a result, the pressure receiving portions 83 can be arranged with high density.

Figure 9:
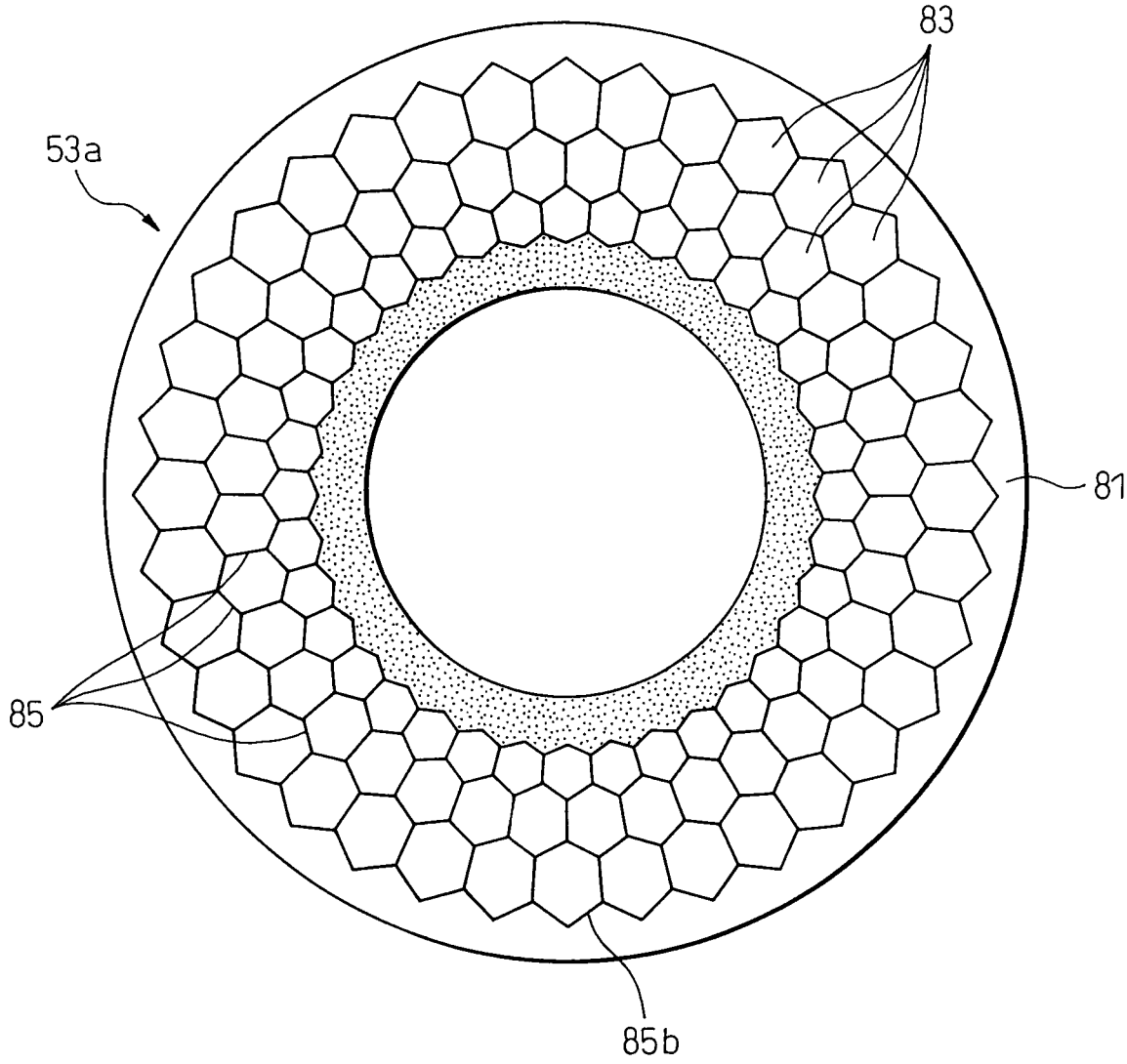
FIG. 9 is a diagram showing the sliding surface of the thrust bearing 53 configured in such a manner that the groove 8 assume a hexagonal pattern.
Figure 10:
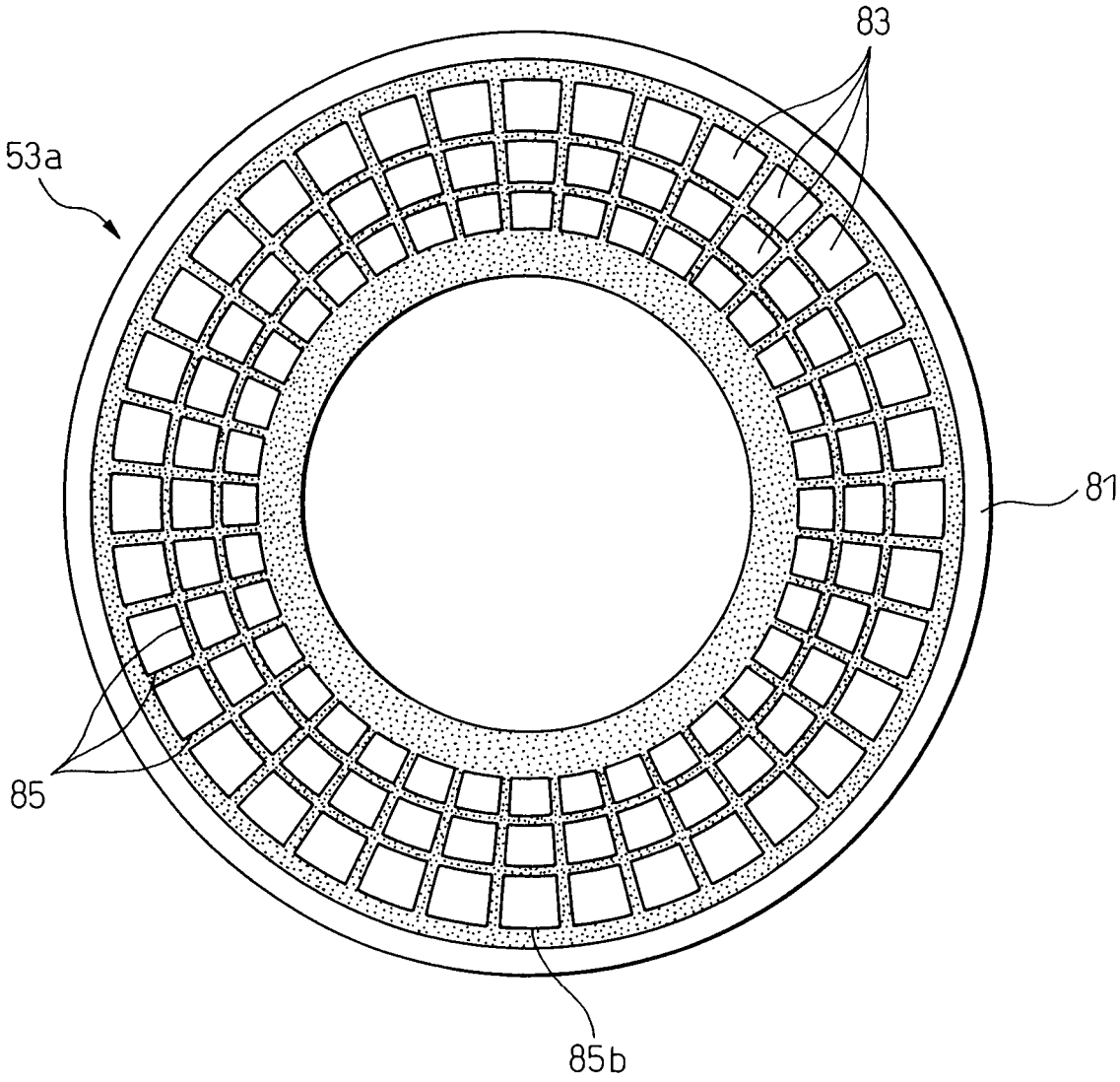
FIG. 10 is a diagram showing the sliding surface of the thrust bearing 53 configured in such a manner that the pressure receiving portions 83 are arranged in tiles.

Also, the thrust bearing 53 may be comprised of the grooves 85 in a hexagonal pattern as shown in FIG. 9. As another alternative, as shown in FIG. 10, the pressure receiving portions 83 may be arranged in tiles. In this case, the width of the grooves 85 may be unified. Further, in the case where the pressure receiving portions 83 are each formed as a polygon, the lubricating oil can be introduced from each side of the polygon thereby to form an oil film. Incidentally, in FIGS. 8 to 10, the same component parts as those in the first embodiment are designated by the same reference numerals, respectively.

Also, at the end portion of the pressure receiving portion 83 shown in FIGS. 9 and 10, a minuscule round "sagged" taper may be formed to generate the oil film effectively. Then, many edges on the diagonal lines of the polygon are removed, and therefore, the flat portions 81*a* in sliding contact with the mating member and formed with an oil film assume a substantially circular form with round corners as hatched in FIG. 11A.

Figure 11A:
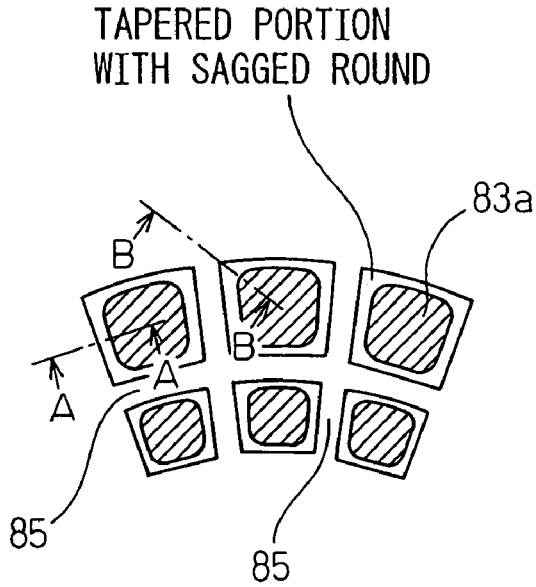
FIG. 11A is a diagram showing the area of a substantially circular flat portion having a tapered portion with curved corners in a polygonal island.
Figure 11B:
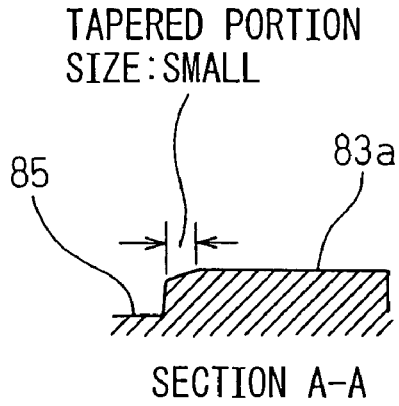
FIG. 11B is a sectional view taken along line A-A in FIG. 11A.
Figure 11C:
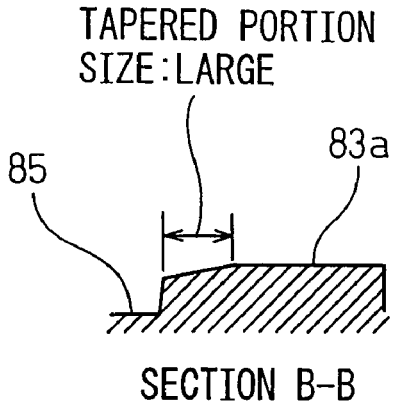
FIG. 11C is a sectional view taken along line B-B in FIG. 11A.

Incidentally, FIG. 11A is a diagram showing the rectangular insular pressure receiving portions 83 as viewed from above. FIG. 11B is a sectional view taken along line A-A in FIG. 11A, showing the area of the tapered portion displaced from the diagonal lines of the rectangular insular pressure receiving portions 83. FIG. 11C is a sectional view taken along line B-B in FIG. 11A, showing the area of the tapered portion on the diagonal lines of the rectangular insular pressure receiving portions 83. Also, the "sagged" round taper is formed specifically by barreling or wrapping.

Third Embodiment

Next, a third embodiment of the invention will be explained. The parts of the compressor not described below in the third embodiment are similar to the corresponding parts, respectively, of the compressor described in the first embodiment above.

Figure 13:
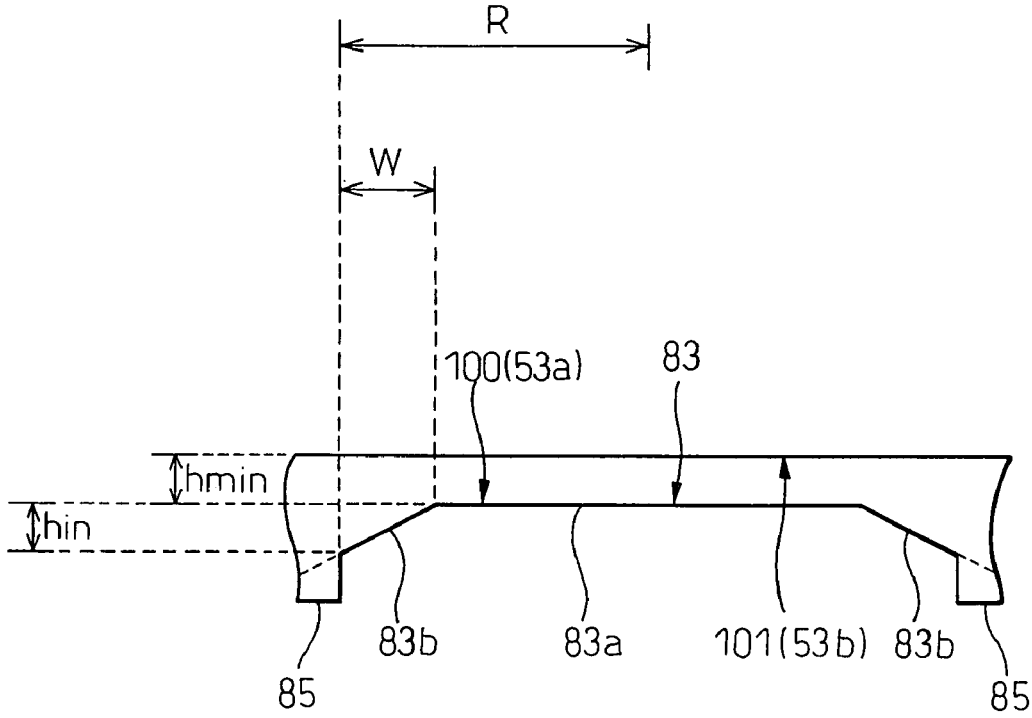
FIG. 13 is an enlarged sectional view showing the essential parts of the thrust bearing of FIG. 1.

According to this embodiment, the thrust bearing 53, as shown in FIG. 13, includes a pair of sliding surfaces 100 and 101. The first sliding surface 100 constitutes the surface of a scroll-side plate 53*a* in opposed relation to the housing-side plate 53*b*. The second sliding surface 101, on the other hand, constitutes the surface of the housing-side plate 53*b* in opposed relation to the scroll-side plate 53*a*.

As described above, the first sliding surface 100, as shown in FIG. 2A, is formed with a multiplicity of insular pressure receiving portions 83. In the second sliding surface 101, on the other hand, the portion thereof in opposed relation to the first sliding surface 100 is substantially flat, as shown in FIG. 13. According to this embodiment, the second sliding surface 101 is planar and flat in its entirety.

In this specification, the wording "substantially flat" means that the portion of the second sliding surface 101 opposed to the pressure receiving portions 83 is flat between the pressure receiving portions 83 and the particular portion to such a degree as to generate the pressure due to the wedge effect in the mixed fluid of the lubricating oil and the refrigerant interposed between the pressure receiving portions 83 and the particular portion.

As shown in FIG. 13, the surface of each pressure receiving portion 83 nearer to the second sliding surface 101 has a sagged portion 83*b* formed along the peripheral edge thereof and a flat portion 83*a* connected with the sagged portion 83*b* inside the latter. The sagged portion 83*b* is arranged along the peripheral edge of the pressure receiving portion 83 by way of which the mixed fluid flows in. According to this embodiment, the revolving motion of the movable scroll 32 acts to introduce the mixed fluid from the entire peripheral edge of each pressure receiving portion 83, and therefore, the sagged portion 83*b* is formed over the entire peripheral edge of the pressure receiving portion 83.

According to this embodiment, the pressure receiving portions 83 are substantially circular, and so are the flat portions 83*a*. The flat portions 83*a* and the second sliding surface 101 are opposed to each other substantially in parallel to each other.

The sagged portion 83*b* is located between the outer peripheral edge of the pressure receiving portion 83 and the flat portion 83*a*. The outer peripheral edge of the sagged portion 83*b* is coincident with the outer peripheral edge of the pressure receiving portion 83, while the inner peripheral edge of the sagged portion 83*b* is coincident with the outer peripheral edge of the flat portion 83*a*. In other words, each sagged portion 83*b* is sandwiched between large and small concentric circles of different sizes.

Each sagged portion 83*b* is formed in a taper. As shown in FIG. 13, the interval between the sagged portion 83*b* and the second sliding surface 101 monotonically increases from inside toward outside of the pressure receiving portion 83.

As shown in FIG. 13, according to this embodiment, the outer peripheral edge of the pressure receiving portion 83 rises substantially vertically from the grooves 85. Incidentally, the sagged portion 83*b* may be extended outward of the pressure receiving portion 83 and connected with the groove 85 as shown by dotted lines in FIG. 13.

The groove 85 shown in FIG. 13 may be replaced by other grooves 85*a*, 85*b*.

The effective radius R of the pressure receiving portion 83 with respect to the amount of eccentricity (orbital radius) e of the movable scroll 32 is desirably designed appropriately in accordance with specific applications of the scroll compressor 11. Especially, from the viewpoint of exclusion of foreign matter and reduction in contact pressure, the ratio R/e between the effective radius R and the eccentricity e desirably satisfies the relation $0.4 \leqq R/e \leqq 1.0$. From a similar viewpoint, the area ratio of the pressure receiving portions 83 to the grooves 85 on the first sliding surface 100 is desirably not less than 50%.

The effective radius R of the pressure receiving portion 83 is an indicator of the size of the portion of the pressure receiving portion 83 inward of the contour formed by the outer peripheral edge of the width W of the sagged portion 83*b*. The width W of the sagged portion 83*b* (FIG. 13) represents the length between the position of the sagged portion 83*b* where the height difference with the flat portion 83*a* of the first sliding surface 100 is 1 μm and the inner peripheral edge of the sagged portion 83*b*, as measured along the imaginary line passing through the center of the flat portion 83*a*.

According to this embodiment, the outer peripheral edge of the width W of the sagged portion 83*b* is coincident with the outer peripheral edge of the pressure receiving portion 83. Each pressure receiving portion 83 is substantially circular, and has the outer peripheral edge thereof coincident with that of the width W of the sagged portion 83*b*. Specifically, according to this embodiment, the plan view of the portion inside the contour formed by the outer peripheral edge of the width W of the sagged portion 83*b* is circular, and the effective radius R of the pressure receiving portion 83 is equal to the radius of the pressure receiving portion 83.

Figure 14A:
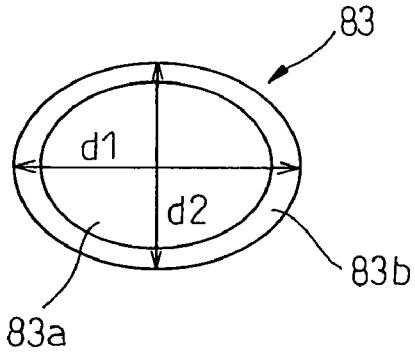
FIGS. 14A and 14B are diagrams for explaining the effective radius of the pressure receiving portions.
Figure 14B:
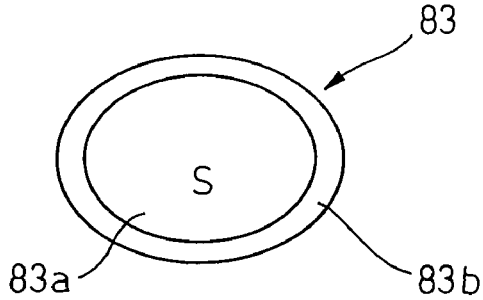

According to this embodiment, the pressure receiving portion 83 is circular. In the case where the pressure receiving portion 83 is oblong, elliptic or polygonal, however, as shown in FIG. 14A, the average value of the long diameter d1 and the short diameter d2 of the shape formed by the outer peripheral edge of the width W of the sagged portion 83*b* is regarded as the effective radius R. As an alternative, as shown in FIG. 14B, the equivalent radius of the circle having the same area S as the particular shape is regarded as the effective radius R. Specifically, the effective radius R is regarded as the equivalent radius of the circle having the same area S as the portion of the pressure receiving portion 83 inside the position of the sagged portion 83*b* where the difference of height with the flat portion 83*a* of the first sliding surface 100 is 1 μm.

FIG. 13 shows an example in which the width W is equal to the length between the outer and inner peripheral edges of the sagged portion 83*b*. Specifically, in this example, the difference of height between the outer peripheral edge of the sagged portion 83*b* and the flat portion 83*a* is 1 μm.

With regard to the height of the pressure receiving portion 83, the length between the flat portion 83*a* and the groove 85 as measured in the direction perpendicular to the flat portion 83*a* is desirably 0.1 to 0.5 mm to effectively generate the oil film on the one hand and to secure the exclusion of foreign matter and the load resistance of the pressure receiving portion 83 on the other hand. According to this embodiment, the grooves 85, 85*a*, 85*b* are formed to the same height.

From a similar point of view, the difference of height between the flat portion 83*a* and the outer peripheral edge of the sagged portion 83*b* is desirably such that the length measured in the direction perpendicular to the flat portion 83*a* is 0.5 to 5 μm.

The interval between the pressure receiving portions 83 is preferably 200 to 500% in terms of the percentage that the length between the centers thereof represents of the effective radius R in the circumferential direction of the scroll-side plate 53*a*. Also in the radial direction of the scroll-side plate 53*a*, 200 to 500% is preferable.

The thrust bearing 53 having the first and second sliding surfaces 100 and 101 assumes the state lubricated with the fluid under predetermined operating conditions due to the wedge effect of the pressure receiving portions 83.

Next, the state in which the thrust bearing 53 in the state lubricated with the fluid is further explained.

In the state where the thrust bearing 53 is lubricated with the fluid (hereinafter referred to as the state of hydrodynamic lubrication), the continuous oil film (not shown) due to the mixed fluid is formed between the first and second sliding surfaces 100 and 101. As shown in FIG. 13, therefore, the first and second sliding surfaces 100 and 101 are separated from each other by the oil film. In other words, the sliding surfaces 100 and 101 are out of contact with each other.

In FIG. 13, the minimum oil film thickness hmin is given as the thickness of the portion where the length between the pressure receiving portions 83 and the second sliding surface 101 is shortest. Specifically, the portion where the oil film thickness is minimum, is the flat portion 83*a*.

Also, in FIG. 13, the inlet oil film thickness hin is given as the height of the sagged portion 83*b* at the inlet where the mixed fluid flows in between the pressure receiving portions 83 and the second sliding surface 101. The oil film pressure begins to generate effectively from this inlet. In FIG. 13, the inlet oil film thickness hin is the length between the outer peripheral edge of the sagged portion 83*b* and the flat portion 83*a* of the first sliding surface 100.

Normally, the inlet oil film thickness hin is variable in the range of 0.1 to 4.0 μm depending on the operating conditions of the scroll compressor 11. Under typical operating conditions, hin is 1.0 μm.

Figure 15:
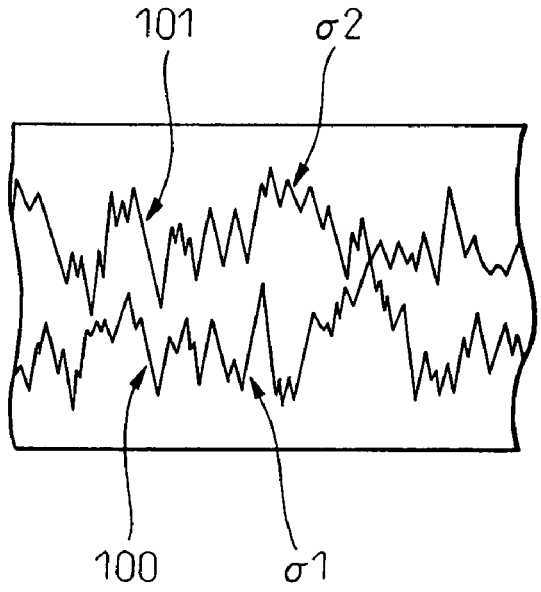
FIG. 15 is a further enlarged view of a part of FIG. 13.

FIG. 15 shows the manner, in enlarged form, in which the flat portion 83*a* of the pressure receiving portion 83 is in opposed relation to the second sliding surface 101. The first sliding surface 100 and the second sliding surface 101 have a surface roughness, respectively, and the thickness of the oil film existing between the sliding surfaces 100 and 101 changes with the surface roughness of the sliding surfaces 100 and 101.

With the increase in surface roughness of the sliding surfaces 100 and 101, the surface roughness transcends the thickness of the oil film capable of being formed, and the sliding surfaces are liable to contact each other.

From this viewpoint, the standard deviation σ1 of the surface roughness of the flat portion 83*a* of the first sliding surface 100 and the standard deviation σ2 of the surface roughness of the second sliding surface 101 are required to be not more than 0.08 μm, respectively.

In the case where the initial standard deviations σ1 and σ2 of the surface roughness of the sliding surfaces 100 and 101 are larger than 0.08 μm, the standard deviations σ1 and σ2 are reduced to not more than 0.08μ or preferably to not more than 0.04 μm by running-in before using the scroll compressor 11. Normally, the lower limit of the standard deviations σ1 and σ2 of the surface roughness after running-in is about 0.015 μm. At least after running-in, therefore, the standard deviations σ1 and σ2 are desirably 0.015 to 0.04 μm.

The composite surface roughness σc specified by Equation (2) below based on the standard deviations σ1 and σ2 below is used as an indicator of the surface roughness of the sliding surfaces 100 and 101.

$$\sigma c=\sqrt{\sigma 1^2+\sigma 2^2} \tag{2}$$

As long as the thrust bearing 53 is in the state of hydrodynamic lubrication, a continuous oil film exists between the flat portion 83*a* and the portion of the second sliding surface 101 in opposed relation to the flat portion 83*a*. For this purpose, the oil film parameter Λ for the sliding surfaces 100 and 101 specified by Equation (3) below satisfies the relation Λ≧3.

$$\Lambda = \frac{h\min}{\sqrt{\sigma 1^2+\sigma 2^2}} = \frac{1}{\sqrt{\sigma 1^2+\sigma 2^2}}\gamma R\left[\frac{hin}{R}\right]^{\alpha}\left[\frac{\eta\cdot\omega}{\mathrm{Pave}}\right]^{\beta}\left[\frac{e}{R}\right]^{\beta} \tag{3}$$

Equation (3) is determined from the lubricated state of the pressure receiving portions 83 of the sliding surfaces 100 and 101 and what is called an elastohydrodynamic lubricaton (EHL) theory. Incidentally, Equations (1) and (3) are identical with each other in substance.

The oil film parameter Λ, as shown in Equation (3), is the ratio of the minimum oil film thickness hmin to the composite surface roughness σc.

In the case where the oil film parameter Λ satisfies the relation Λ≧3, the minimum oil film thickness hmin is sufficiently larger than the composite surface roughness. Between the pressure receiving portions 83 and the second sliding surface 101, therefore, the continuous oil film always exists and the sliding surfaces 100 and 101 are separated from each other. Specifically, the state of hydrodynamic lubrication is established for the thrust bearing 53. This oil film is the EHL oil film or the fluid lubrication oil film.

In the case where the oil film parameter Λ satisfies the relation Λ<1, on the other hand, the pressure receiving portions 83 and the second sliding surface 101 are kept in contact with each other at a given point, and the sliding surfaces are in what is called a state of boundary lubrication. In the case where the oil film parameter Λ satisfies the relation 1≦Λ<3, on the other hand, the sliding surfaces are either in the partial EHL state or a state of mixed lubrication.

Equation (3) is further described below.

In Equation (3), $\eta$ is the kinematic viscosity on the sliding surfaces 100 and 101 of the thrust bearing 53 under the operating conditions of the mixed fluid.

The center of the movable scroll 32 is decentered a given amount e from the axial center of the rotary shaft 21, and $\omega$ is the value obtained by dividing the sliding speed of the pressure receiving portions 83 with respect to the second sliding surface 101 by the eccentricity e. The eccentricity e, which is the orbital radius of the movable scroll 32, is normally 2.5 to 5 mm.

The characters Pave designates the average contact pressure of the pressure receiving portions 83.

The characters $\alpha$ and $\beta$ designate constants calculated by the elastohydrodynamic lubricaton theory based on the lubrication conditions, and assuming that the inlet oil film thickness hin is 1 μm as shown in FIG. 13, $\alpha$ is about −0.4 while $\beta$ is about 0.7.

Figure 16:
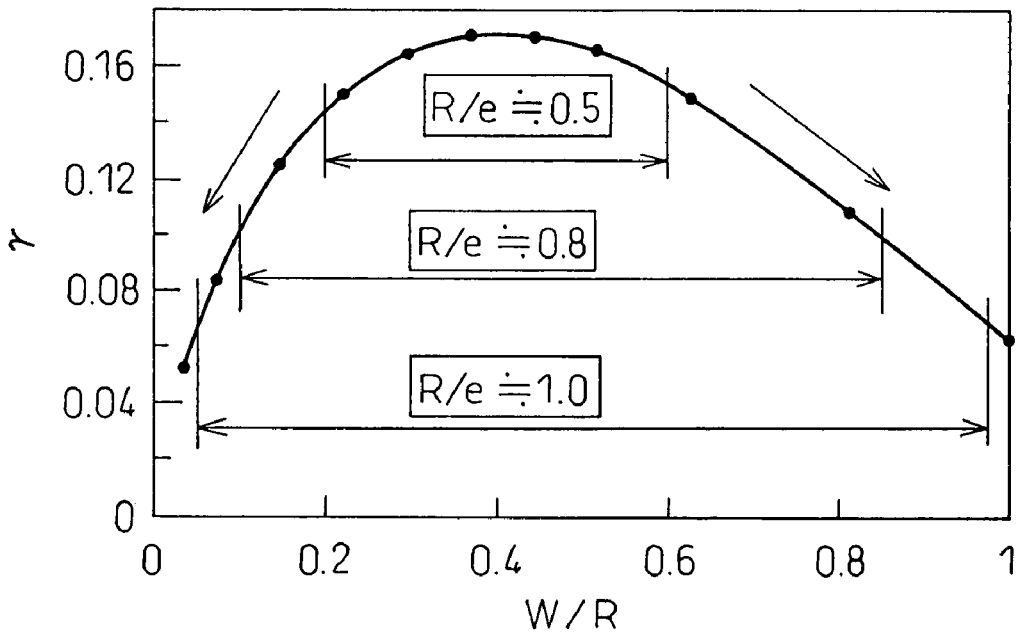
FIG. 16 is a diagram for explaining the relation between $\gamma$ and W/R.

Also, $\gamma$ is the function of the width W and the effective radius R, and has the relation shown in FIG. 16 with the ratio W/R between the width W of the sagged portion 83*b* and the effective radius R. The value $\gamma$ increases with W/R and decreases after reaching the peak as shown in FIG. 16.

From Equation (3), the oil film parameter $\Lambda$ is proportional to $\gamma$. Specifically, the oil film parameter $\Lambda$ increases with $\gamma$. This value $\gamma$, as shown in FIG. 16, is the function of W/R. Therefore, the thrust bearing 53 is desirably designed in such a manner that W/R assumes a value associated with the substantially peak value of $\gamma$.

Also, from Equation (3), the oil film parameter $\Lambda$ is the function of the ratio R/e between the effective radius R of the pressure receiving portions 83 and the eccentricity e. The ratio R/e is a value appropriately determined according to specific applications of the scroll compressor 11.

With R/e as a parameter, therefore, a desirable range of W/R exists in which the oil film parameter $\Lambda$ satisfies the relation $\Lambda \geqq 3$. The desirable range of W/R for the case in which the inlet oil film thickness hin shown in FIG. 13 is 1 μm is explained below.

In the case where the ratio R/e between the effective radius R and the eccentricity e is about unity, for example, the ratio between the width W of the sagged portion 83*b* and the effective radius R desirably satisfies the relation $0.05 \leqq W/R \leqq 0.98$. In this case, the fact that R/e is about unity means that R/e is in the range of $0.8 < R/e \leqq 1.0$.

Also, in the case where the ratio R/e between the effective radius R and the eccentricity e is about 0.8, the ratio between the effective radius R and the width W of the sagged portion 83*b* desirably satisfies the relation $0.1 \leqq W/R \leqq 0.85$. In this case, the fact that R/e is about 0.8 means that R/e is in the range of $0.6 < R/e \leqq 0.8$.

Further, in the case where the ratio R/e between the effective radius R and the eccentricity e is about 0.5, the ratio between the effective radius R and the width W of the sagged portion 83*b* desirably satisfies the relation $0.2 \leqq W/R \leqq 0.6$. In this case, the fact that R/e is about 0.5 means that R/e is in the range of $0.4 < R/e \leqq 0.6$.

These facts indicate that the oil film parameter $\Lambda$ satisfies the relation $\Lambda \geqq 3$, and therefore, the state of hydrodynamic lubrication is established for the thrust bearing 53. FIG. 16 shows the range of W/R in which the oil film parameter $\Lambda$ satisfies the relation $\Lambda \geqq 3$. In each value of R/e, the oil film parameter $\Lambda$ fails to satisfy the relation $\Lambda \geqq 3$ in the area where W/R is large and small. This is due to the reason described below.

With the decrease in the width W of the sagged portion 83*b* and the resulting decrease in W/R, the wedge effect is reduced and so is the minimum oil film thickness hmin, which in turn reduces the oil film parameter $\Lambda$. With the increase in the width W of the sagged portion 83*b* and the resulting increase in W/R, on the other hand, the flat portion 83*a* is reduced and therefore the oil film pressure generated is liable to be lost. This reduces the minimum oil film thickness hmin, thereby reducing the oil film parameter $\Lambda$.

Also, like in the pressure receiving portions 83, the state of hydrodynamic lubrication is desirably established between the seal portion 81 and the second sliding surface 101.

The state of hydrodynamic lubrication of the thrust bearing 53 is further explained below.

As described above, in order to positively secure the state of hydrodynamic lubrication of the thrust bearing 53, according to this embodiment, the scroll compressor 11 is operated preferably in such a manner that the mixed fluid containing the lubricating oil and the refrigerant is supplied to the sliding surfaces 100 and 101 of the slide bearing 53, the sliding speed of the pressure receiving portions 83 with respect to the second sliding surface 101 is set to not less than 0.5 m/sec, and the mixed fluid is interposed between the pressure receiving portions 83 and the second sliding surface 101. Thus, preferably, the load with the average contact pressure Pave of 0.5 to 20 MPa is exerted on the pressure receiving portions 83, and the kinematic viscosity of the mixed fluid under the operating conditions is maintained at 0.1 to 10 cst. The lubricating oil is desirably contained in the oil described above.

The operating conditions of this scroll compressor 11 are further explained. In the scroll compressor 11 according to this embodiment, the mixed fluid is supplied to the sliding surfaces 100 and 101 of the thrust bearing 53 by the oil supply means.

Also, as the result of orbiting of the movable scroll 32, the first sliding surface 100 fixed on the movable scroll 32 slides with respect to the second sliding surface 101 fixed on the middle housing 15. This sliding speed with respect to the second sliding surface 101 is preferably not less than 0.5 m/sec, or more preferably 0.6 to 5 m/sec.

Also, the load is imposed toward the second sliding surface 101 on the pressure receiving portions 83 of the thrust bearing 53 due to the difference between the reaction force of the compressed refrigerant and the force in the direction of thrust under the pressure from the movable scroll back surface 32*a*. The average contact pressure of the pressure receiving portions 83 due to this load is preferably 0.5 to 20 MPa, or more preferably, 2 to 15 MPa.

Further, the mixed fluid preferably has the kinematic viscosity of 0.1 to 10 cst, or more preferably, 4 to 10 cst on the sliding surfaces 100 and 101 of the thrust bearing 53 under the aforementioned operating conditions of the scroll compressor 11, where 1 cst is equal to about $1 \times 10^{-6}$ $m^2$/sec.

According to this embodiment, the scroll compressor 11 is used under the aforementioned operating conditions, so that an oil film is formed between the pressure receiving portions 83 and the portion of the second sliding surface 101 in opposed relation to the pressure receiving portions 83. Then, the pressure is generated in the oil film and supports the load generated on the sliding surfaces, thereby making it possible to use the thrust bearing 53 in the state of hydrodynamic lubrication. As a result, the wear of the thrust bearing 53 is prevented, and the scroll compressor 11 can be used while maintaining the performance thereof for a long time.

With the scroll compressor 11 according to this embodiment, the thrust bearing 53 has the continuous oil film formed between the pressure receiving portions 83 and the second sliding surface 101 in opposed relation to the pressure receiving portions 83, and therefore, can be used in the state of hydrodynamic lubrication. This scroll compressor is not complicated in the control operation and not high in cost.

Also, according to this embodiment, the ratio R/e between the effective radius R of the pressure receiving portions 83 and the orbital radius e of the movable scroll 32 is designed in accordance with a specific application on the one hand, and the ratio between the width W and the effective radius R is set in a predetermined range on the other hand thereby to positively establish the state of hydrodynamic lubrication of the thrust bearing 53.

Also, according to this embodiment, the roughness of the bottom surface of the grooves 85 is so large that the lubricating oil can be positively held on this rough surface. As a result, even in the case where the scroll compressor 11 is operated with the oil supply suspended temporarily to the sliding surfaces of the thrust bearing 53, the sliding surfaces can be sufficiently lubricated by the oil held on the bottom surface of the grooves 85.

Also, the plurality of the grooves 85 are formed in a network pattern, and the pressure receiving portions 83 each surrounded by the grooves 85 assume the shape of an island. Each of the pressure receiving portions 83, therefore, is surrounded by the grooves over the entire periphery thereof, with the result that the oil film 86 can be formed by the wedge effect from all the directions with the revolving motion of the movable scroll 32. Further, the groove width at the intersections 85*a* of the plurality of the network grooves is larger than that of the other portions, and therefore, the oil can be supplied sufficiently to the plurality of the grooves 85.

Also, the pressure receiving portions 83, which are each in the shape of a substantially circular island and formed in staggered fashion, can be arranged with a high density. Thus, the size of the oil film forming portion per unit area is increased and a heavy load can be supported.

Also, the grooves 85 are formed on the scroll-side plate 53*a* fixed on the movable scroll 32, and therefore, move relative to the shaft 21 with the revolution of the movable scroll 32. As a result, the oil held on the bottom surface of the grooves 85 is easily supplied to the sliding surfaces as a spray.

Next, with reference to FIG. 6, an explanation is given about the relative positions of the pressure receiving portions 83 arranged on the scroll-side plate 53*a* and the housing-side plate 53*b* with the orbiting of the movable scroll 32. FIG. 6 is a diagram showing the manner in which the scroll-side plate 53*a* moves in the cylindrical case 13*a* with the orbiting of the movable scroll 32. With the orbiting of the movable scroll 32, the scroll-side plate 53*a* moves to the positions (a), (b), (c) and (d) in that order. Let H be the envelope plotted by the inner peripheral edge 53*c* of the housing-side plate 53*b* due to the relative motion of the scroll-side plate 53*a* and the housing-side plate 53*b*. The plurality of the pressure receiving portions 83 are arranged only on radially outside the envelope H on the scroll-side plate 53*a*. As a result, even in the case where the movable scroll 32 is moved by orbiting, the pressure receiving portions 83 are not displaced out of the housing-side plate 53*b*, and a sufficient oil film is formed by the oil held in the plurality of the grooves 85.

According to this embodiment, the envelope H constitutes a circle larger by the revolving radius of the movable scroll 32 than the inner peripheral edge 53*c* of the housing-side plate 53*b*.

The preferred embodiments of the invention are explained above, and this invention is not limited to these embodiments.

Each pressure receiving portion 83, though circular according to this invention, may alternatively be, for example, oblong, elliptic, triangular, rectangular or otherwise polygonal.

Also, according to this embodiment, the sagged portion 83*b* is formed over the entire peripheral edge of the pressure receiving portions 83. Nevertheless, the sagged portion 83*b* may be formed only along the peripheral edge where the mixed fluid flows in. Also, the sagged portion 83*b*, though formed in a taper in this embodiment, may alternatively be formed in a curve.

According to this embodiment, the pressure receiving portions 83 are arranged in staggered fashion. Nevertheless, the invention is not limited to this configuration, and the pressure receiving portions 83 may alternatively be arranged in a regular grid, an oblique grid or at random.

Also, according to this embodiment, the outer peripheral seal portion 81, the pressure receiving portions 83 and the grooves 85 are formed on the scroll-side plate 53*a*. Nevertheless, the invention is not limited to this configuration, and they may be formed on the fixed-side sliding surface 53*b* of the scroll accommodation depression 31. In other words, the second sliding surface 101 may be fixed on the movable scroll 32.

According to this embodiment, the oil supply means is employed whereby the oil is supplied to the thrust bearing 53 due to the difference between the pressure of the oil separated by the oil separator 63 and the pressure of the portion where the thrust bearing 53 is arranged. Nevertheless, the invention is not limited to this configuration, and any configuration may be employed in which the oil is led to the thrust bearing 53 without using the pressure difference.

The operational effects of the scroll compressor according to the invention are further explained below.

The scroll compressor 11 shown in FIG. 1 is fabricated and the wear resistance of the thrust bearing 53 evaluated. The following evaluation conditions are used.

The standard deviations $\sigma 1$ and $\sigma 2$ of the surface roughness of the first and second sliding surfaces 100 and 101 are about 0.02 μm. The effective radius of the pressure receiving portions 83 is about 2.25 mm. The inlet oil film thickness hin is 1 μm. The kinematic viscosity of the mixed fluid under the operating conditions is 4 to 8 cst. The value obtained by dividing sliding speed of the pressure receiving portions 83 by the amount of eccentricity c is 260 to 314 l/sec. The average contact pressure Pave of the pressure receiving portions 83 is 6 to 10 MPa. The width W of the sagged portions 83*b* is about 1 mm. The eccentricity e is 2.5 mm. The oil film parameter $\Lambda$ is 4 to 6.

The result of the wear resistance evaluation shows that the sliding surfaces 100 and 101 of the thrust bearing 53 are not worn even after movement for 3700 hours. This indicates that the state of hydrodynamic lubrication of the sliding surfaces 100 and 101 is maintained during the period of the wear resistance evaluation.

Fourth Embodiment

Next, a fourth embodiment of the invention will be explained. Incidentally, the parts of the compressor not described below in the fourth embodiment are similar to the corresponding parts, respectively, of the compressor described in the first embodiment.

Figure 17:
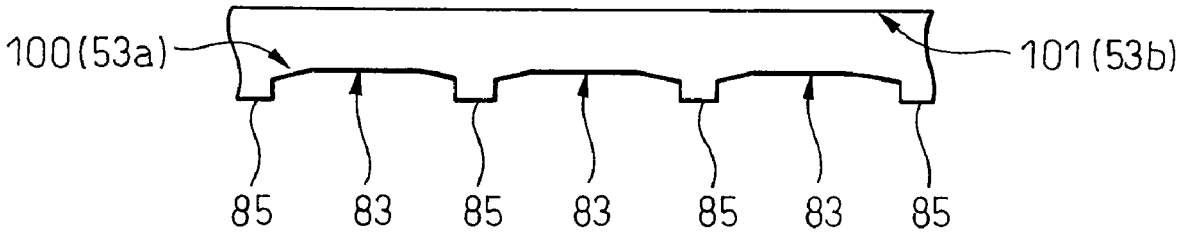
FIG. 17 is schematic diagram showing, in an enlarged form, the essential parts of the sliding surfaces of the thrust bearing.

According to the fourth embodiment, the thrust bearing 53 has a pair of sliding surfaces 100 and 101, as shown in FIG. 17. The first sliding surface 100 constitutes the surface of the scroll-side plate 53*a* in opposed relation to the housing-side plate 53*b*. The second sliding surface 101 makes up the surface of the housing-side plate 53*b* in opposed relation to the scroll-side plate 53*a*.

As described above, the first sliding surface 100 is formed with a multiplicity of insular pressure receiving portions 83. Also, the portion of the second sliding surface 101 in opposed relation to the pressure receiving portions 83 of the first sliding surface 100 is substantially flat as shown in FIG. 17. According to this embodiment, the second sliding surface 101 is a planar flat surface in its entirety.

The grooves 85 shown in FIG. 17 may be replaced by the grooves 85*a*, 85*b*.

As shown in FIG. 17, the surface of each pressure receiving portion 83 nearer to the second sliding surface 101 has a sagged portion 83*b* formed along the peripheral edge thereof and a flat portion 83*a* connected to the sagged portion 83*b*. The sagged portion 83*b* is arranged on the peripheral edge of the pressure receiving portion 83 where the mixed fluid flows in. According to this embodiment, the mixed fluid is introduced from the entire peripheral edge of the pressure receiving portion 83 with the revolving motion of the movable scroll 32, and therefore, the sagged portion 83*b* is formed over the entire peripheral edge of the pressure receiving portion 83.

On the first and second sliding surfaces 100 and 101, the state of hydrodynamic lubrication is easily established by the wedge effect of the pressure receiving portions 83. At the time of starting the scroll compressor 11 or liquid back, however, the boundary or mixed lubrication may occur.

The "liquid back" is a phenomenon in which a liquid-phase refrigerant is introduced into the scroll compressor 11 together with a gas-phase refrigerant from the intake tube 47, and the particular liquid-phase refrigerant flows in to the sliding surfaces 100 and 101. The liquid-phase refrigerant dilutes the lubricating oil on the sliding surfaces 100 and 101, and therefore, the boundary or the mixed lubrication is liable to occur on the sliding surfaces.

The first sliding surface 100 and the second sliding surface 101 each have a surface roughness, and the thickness of the oil film existing between the sliding surfaces 100 and 101 changes with the surface roughness of the two sliding surfaces 100 and 101.

The surface roughness of the sliding surfaces 100 and 101, if large, overcomes the thickness of the oil film to be formed, and the sliding surfaces easily come into contact with each other.

From this viewpoint, the standard deviation $\sigma 1$ of the surface roughness on the flat portion 83*a* of the first sliding surface 100 and the standard deviation $\sigma 2$ of the surface roughness on the second sliding surface 101 are preferably not larger than 0.08 μm.

In the case where the standard deviations $\sigma 1$ and $\sigma 2$ of the initial surface roughness of the sliding surfaces 100 and 101 is larger than 0.08 μm, the standard deviations $\sigma 1$ and $\sigma 2$ of the surface roughness are desirably reduced to not more than 0.08 μm or preferably to not more than 0.04 μm by running-in before using the scroll compressor 11. Normally, the lower limit of the standard deviations $\sigma 1$ and $\sigma 2$ of the surface roughness after the running-in is about 0.015 μm. At least after the running-in, therefore, the standard deviations $\sigma 1$ and $\sigma 2$ are preferably 0.015 to 0.04 μm.

The pressure receiving portions 83 preferably have the aforementioned relation between the diameter thereof and the orbital radius e. Also, the length of the sagged portion 83*b* of the pressure receiving portions 83 as measured along the imaginary line passing through the center of the flat portion 83*a* is preferably 5 to 98% of the radius of the pressure receiving portion 83, or more preferably, 30 to 50% to effectively secure the wedge effect on the mixed fluid.

The intervals between the pressure receiving portions 83 in terms of the length of the line between the centers thereof is preferably 200 to 500% of the diameter of the pressure receiving portion 83 along the circumferential direction of the scroll-side plate 53*a*. Similarly, it is preferably 200 to 500% along the radial direction of the scroll-side plate 53*a*.

The first sliding surface 100 and the second sliding surface 101 of the thrust bearing 53 are each formed of a steel material. In other words, the scroll-side plate 53*a* and the housing-side plate 53*b* are each formed of a steel material.

Examples of the steel material making up the sliding surfaces 100 and 101 preferably include a high-carbon chromium bearing steel, alloy steel for machine construction, cold-rolled steel plate, nickel-chromium steel, nickel-chromium-molybdenum steel, chromium steel, chromium-molybdenum steel, manganese steel for machine construction, manganese chromium steel and other various steel materials specified by JIS such as the steel with a guaranteed hardenability for machine construction.

More specifically, the high-carbon chromium bearing steel is preferably conforming with SUJ2, SUJ3 or SUJ4. Also, the carbon steel for machine construction is preferably SCr415, SCr420, SCr440, SCM415, SCM420, SNCM420, SCM435, SCM440 or SNCM630. Also, the cold-rolled steel plate is preferably SPCC, SPCD, SPCE or SPCEN.

The steel material making up the sliding surfaces 100 and 101 has the austenite phase as one of the Fe—C phases of steel. The austenite phase exists as a multiplicity of crystal particles in the neighborhood of the sliding surfaces 100 and 101, and is preferably distributed among the other Fe—C phases (for example, martensite phase). This austenite phase is what is called the retained austenite not converted to martensite after hardening of the steel material.

In the neighborhood of the sliding surfaces 100 and 101, the other Fe—C state than austenite is preferably the martensite phase for the most part.

The above-mentioned steel material preferably has one or a plurality of elements selected from the group of C, N, Mn, Ni and Pd as elements generating austenite phase. By adjusting the content of the elements generating austenite phase in the steel material, a predetermined amount of retained austenite can be obtained.

According to this embodiment, the austenite phase is distributed in the neighborhood of the sliding surfaces 100 and 101 of the thrust bearing 53, and therefore, the abrasion loss of the sliding surfaces is reduced. The reason is described below.

The thrust bearing 53 is used in the boundary or the mixed lubrication region at the time of activation or "liquid back". Therefore, the sliding surfaces 100 and 101 are partially or wholly in contact with each other, and the austenite phase of the contacted portions thereof is rapidly strain-hardened. This strain hardening occurs in a part of the crystal particles of the austenite phase. As a result, the hardened part of the crystal particles is not easily worn on the one hand, and the austenite phase not strain-hardened around the particular portion forms a cushion to prevent the wear of the sliding surfaces 100 and 101.

Also, even in the case where foreign matter such as dust intrudes between the sliding surfaces 100 and 101 and the boundary or mixed lubrication occurs, the sliding surfaces 100 and 101 are similarly prevented from being worn.

The retained austenite amount in the neighborhood of the sliding surfaces 100 and 101 is not less than 5 volume %, preferably 5 to 40 volume % or more preferably 5 to 20 volume %.

The fact that the retained austenite amount is not less than 5 volume % effectively reduces the wear of the sliding surfaces 100 and 101. The retained austenite amount of the sliding surfaces 100 and 101 may change due to the rise of the temperature of the sliding surfaces or the stress acting on the sliding surfaces while the scroll compressor 11 is in operation. At the time of fabrication of the scroll compressor 11, therefore, the retained austenite amount in the neighborhood of the sliding surfaces 100 and 101 is set to a value which is maintained at not less than 5 volume % over the entire service life of the scroll compressor 11.

In the case where the retained austenite amount is 40 volume % or more, on the other hand, the hardness of the sliding surfaces 100 and 101 is reduced and the abrasion loss is increased undesirably. This is due to the low hardness of the austenite phase as compared with the martensite phase.

The areas of the first and second sliding surfaces 100 and 101 where the retained austenite amount is not less than 5 volume % extend to a depth not less than 10 μm or preferably 10 to 200 μm from the surface. Further, the areas where the retained austenite amount is not less than 5 volume % may cover the whole of the scroll-side plate 53*a* and the housing-side plate 53*b*.

In the case where the running-in operation is performed before using the scroll compressor 11, for example, the areas of the first and second sliding surfaces 100 and 101 where the retained austenite amount is not less than 5 volume % after running-in are preferably not less than 10 μm deep from the surface.

The retained austenite amount on each of the two sliding surfaces 100 and 101 can be measured by using a well-known method. For example, the peak ratio between a (ferrite) phase and γ (austenite) phase obtained by X-ray measurement can be used.

In order to obtain the two sliding surfaces 100 and 101 having the retained austenite amount in the aforementioned range in the neighborhood of the surface, the steel material is preferably subjected to the hardening process, tempering process, carburizing process, nitriding process or carbonitriding process. The well-known conditions can be used for heat treatment.

In each of the processes described above, first, the scroll-side plate 53*a* and the housing-side plate 53*b* are preferably machined to the shape of a predetermined size from a steel material, and then finish machined.

The carburizing process includes the solid carburizing process, liquid carburizing process, gas carburizing process and the vacuum carburizing process as well known.

In place of the carburizing process, the steel material may be preferably subjected to the nitriding process. A well-known nitriding process uses ammonia or nitride. The nitrogen content in the neighborhood of the sliding surfaces 100 and 101 after the nitriding process is preferably in the range described above.

Further, in order to execute the nitriding process together with the carburizing process on the steel material, the carbonitriding process is preferably used. In the carbonitriding process, for example, the steel material is subjected to the nitriding process in the carburizing atmosphere.

In the process for increasing the content of carbon or nitrogen in the neighborhood of the steel material surface, the retained austenite amount in the neighborhood of the surface is adjusted to the aforementioned range on the one hand and the hardness in the neighborhood of the steel material surface is increased while at the same time maintaining the internal mildness on the other hand. Therefore, this process is desirable for improving the wear resistance and fatigue resistance of the scroll-side plate 53*a* and the housing-side plate 53*b* formed of the steel material.

In the scroll compressor 11 according to this embodiment, the thrust bearing 53 contains the austenite phase of a predetermined content in the neighborhood of the sliding surfaces 100 and 101, and therefore, the wear resistance is improved. Even in the case where the sliding bearing 53 is used in the boundary or the mixed lubrication region at the time of activating or "liquid back" of the scroll compressor 11, therefore, the sliding surfaces 100 and 101 are less worn, and the performance of the scroll compressor is not substantially deteriorated. Also, this scroll compressor requires no complicated control operation and is not high in cost.

Also, according to this embodiment, the sliding surfaces 100 and 101 of the thrust bearing 53 each have a portion to a predetermined depth from the surface thereof where the austenite phase is hardened for an improved wear resistance. Even in the case where the thrust bearing 53 is used in the boundary or the mixed lubrication region and the sliding surfaces 100 and 101 are worn, therefore, the functions of the thrust bearing 53 can be positively maintained for a predetermined length of time.

Also, according to this embodiment, the surface roughness of the sliding surface pair 100 and 101 is so low that the use in the boundary or the mixed lubrication region is accompanied by only a small wear of the sliding surfaces 100 and 101 for an improved anti-seizure property.

Also, according to this embodiment, the bottom surface of the grooves 85 has a large roughness, and therefore, the lubricating oil can be positively held on the rough surface. Even in the case where the scroll compressor 11 is operated with the oil supply to the sliding surfaces of the thrust bearing 53 suspended temporarily, therefore, the sliding surfaces can be sufficiently lubricated by the oil held on the bottom surface of the grooves 85.

Also, in view of the fact that the plurality of the grooves 85 are formed in a network pattern and the pressure receiving portions 83 surrounded by the grooves 85 are each formed in the shape of an island. Thus, the pressure receiving portions 83 are each surrounded by the grooves over the entire periphery thereof, and an oil film 86 can be formed by the wedge effect from all the directions as the result of the revolving motion of the movable scroll 32. Further, the intersections of the plurality of the grooves 85 have a larger width than the remaining portions, and therefore, the oil can be supplied to a sufficiently extent over the plurality of the grooves 85.

Also, the pressure receiving portions 83, which are formed substantially in the shape of an island and arranged in staggered fashion, can be arranged in high density. As a result, the size of the oil film portion per unit area can be increased to support a heavier load.

Also, the grooves 85, being formed on the scroll-side plate 53*a* fixed on the movable scroll 32, move relatively to the shaft 21 with the revolution of the movable scroll 32. As a result, the oil held on the bottom surface of the grooves 85 is readily supplied to the sliding surfaces in spray.

Next, with reference to FIG. 6, an explanation is given concerning the relative positions of the pressure receiving portions 83 arranged on the scroll-side plate 53*a* and the housing-side plate 53*b* with the orbiting motion of the movable scroll 32. FIG. 6 is a diagram showing the manner in which the scroll-side plate 53*a* moves within the cylindrical case 13*a* with the orbiting of the movable scroll 32. With the orbiting motion of the movable scroll 32, the scroll-side plate 53*a* takes the positions (a), (b), (c) and (d) in that order. Let H be the envelope plotted by the inner peripheral edge 53*c* of the housing-side plate 53*b* in accordance with the relative motion of the scroll-side plate 53*a* and the housing-side plate 53*b*. The plurality of the pressure receiving portions 83 are arranged only on radially outside the envelope H on the scroll-side plate 53*a*. Even in the case where the movable scroll 32 moves by orbiting, therefore, the pressure receiving portions 83 are not displaced out of the housing-side plate 53*b*, and a sufficient oil film is formed by the oil held by the plurality of the grooves 85.

Incidentally, the envelope H according to this embodiment is a circle larger than the inner peripheral edge 53*c* of the housing-side plate 53*b* by an amount equal to the radius of revolution of the movable scroll 32.

Fifth Embodiment

Next, the scroll compressor 11 according to a fifth embodiment of the invention is explained. The fifth embodiment is different from the fourth embodiment in the configuration of the sliding surfaces 100 and 101 and similar to the fourth embodiment in the other points.

In the scroll compressor 11 according to the preferred fifth embodiment of the invention, the hardness of the second sliding surface 101 of the thrust bearing 53 is higher than that of the first sliding surface 100. Also, the Vickers hardness of the two sliding surfaces 100 and 101 is not less than 500 HV, or preferably, not less than 700 HV.

The Vickers hardness of the first sliding surface 100 is preferably 700 to 850 HV, while the Vickers hardness of the second sliding surface 101 is preferably 1500 to 2500 HV.

The thrust bearing 53 according to this embodiment is explained further below.

The scroll-side plate 53*a* and the housing-side plate 53*b* making up the thrust bearing 53 are preferably formed of a steel material like in the embodiments described above.

The housing-side plate 53*b* constituting the second sliding surface 101 may be formed of a steel material as it is or a steel material increased in hardness by the hardening or film-forming process. The steel material forming the second sliding surface 101, if used as it is for the second sliding surface 101, is preferably higher by at least 500 HV in Vickers hardness than the steel material forming the first sliding surface 100.

In the case where the hardness in the neighborhood of the second sliding surface 101 is increased by the surface treatment such as hardening, the depth from the surface of the particular portion increased in hardness, i.e. the area at least 500 HV higher in Vickers hardness than the first sliding surface 100 is preferably not less than 10 μm or more preferably 10 to 200 μm. Further, the Vickers hardness of the whole housing-side plate 53*b* may be different from that of the first sliding surface 100 by not less than 500 HV.

The surface treatment described above includes the hardening, carburizing, nitriding or carbonitriding as explained above in the fourth embodiment. The method of surface treatment of the steel material is similar to that described in the fourth embodiment.

In the case where the hardness in the neighborhood of the second sliding surface 101 is increased by the film-forming process, on the other hand, the thickness of the film thus formed is preferably 1 to 5 μm.

The types of the film formed on the second sliding surface 101 preferably include a chromium nitride (CrN) film, a diamond-like carbon (DLC) film and a titanium nitride (TiN) film.

The chromium nitride (CrN) film or the diamond-like carbon (DLC) film can be formed on the second sliding surface 101 by such a well-known method as PVC or CVD.

In the scroll compressor 11 according to this embodiment described above, the Vickers hardness of the second sliding surface 101 of the thrust bearing 53 is at least 500 HV higher than that of the first sliding surface 100. Even in the case where the sliding bearing 53 is used in the boundary or the mixed lubrication region at the time of starting or "liquid back" of the scroll compressor 11, therefore, the second sliding surface 101 develops only a small, shallow dent. As a result, the abrasion loss of the second sliding surface 101 is small, and therefore, the performance of the scroll compressor 11 is not substantially reduced.

Also, according to this embodiment, the hardness of the second sliding surface 101 can be increased appropriately in keeping with the operating conditions of the thrust bearing 53 by the surface treatment such as hardening or the film-forming process described above. Specifically, by adjusting the conditions for surface treatment, an area having the desired hardness can be formed to a predetermined depth from the second sliding surface 101. Also, by adjusting the conditions for the film-forming process, a film having the desired hardness and a predetermined thickness can be formed on the second sliding surface 101.

The scroll compressor 11 according to the fourth or fifth embodiment described above can be used under various operating conditions suited to a particular application. Especially, the thrust bearing 53 of the scroll compressor 11 is desirably used exclusively in the fluid lubrication region to secure the durability thereof.

From this viewpoint, in the scroll compressor 11 according to each of the embodiments described above, the sliding surfaces 100 and 101 of the thrust bearing constituting the sliding bearing 53 are supplied with a mixed fluid containing the lubricating oil and the refrigerant, while the sliding speed of the pressure receiving portions 83 with respect to the second sliding surface 101 is set to not lower than 0.5 m/sec. Then, the load of 0.5 to 20 MPa in average contact pressure is imposed on the pressure receiving portions 83, and the kinematic viscosity of the mixed fluid in operation is maintained at 0.1 to 10 cst. The lubricating oil is desirably contained in the oil described above.

The operating conditions of this scroll compressor 11 are further explained. In the scroll compressor 11 according to each of the embodiments described above, the mixed fluid is supplied to the sliding surfaces 100 and 101 of the thrust bearing 53 by the oil supply means.

Also, with the orbiting of the movable scroll 32, the first sliding surface 100 fixed on the movable scroll 32 slides with respect to the second sliding surface 101 fixed on the middle housing 15. This sliding speed with the second sliding surface 101 is not less than 0.5 m/sec or preferably 0.6 to 5 m/sec.

Also, in this thrust bearing 53, a load is imposed on the pressure receiving portions 83 toward the second sliding surface 101 by the difference between the reaction force of the compressed refrigerant and the force in thrust direction due to the pressure on the movable scroll back surface 32*a*. The average contact pressure of the pressure receiving portions 83 under this load is 0.5 to 20 MPa or preferably 2 to 15 MPa.

Further, the kinematic viscosity of the mixed fluid on the sliding surfaces 100 and 101 of the thrust bearing 53 under the operating conditions of the scroll compressor 11 described above is 0.1 to 10 cst, or preferably, 4 to 10 cst, where 1 cst equals about $1\times10^{-6}$ $m^2$/sec.

By using the scroll compressor 11 according to each of the embodiments described above under the operating conditions described above, an oil film is formed between the pressure receiving portions 83 and the second sliding surface 101 in opposed relation to the pressure receiving portions 83, and therefore, the thrust bearing 53 can be used exclusively in the state of hydrodynamic lubrication. As a result, the wear of the thrust bearing is prevented and the performance of the scroll compressor 11 can be maintained for a long service life.

The preferred embodiments of the invention are explained above, and the invention is not limited to such embodiments.

Although the pressure receiving portions 83 are each substantially circular in the embodiments described above, the pressure receiving portions 83 may alternatively be, for example, oblong, elliptic, triangular, rectangular or otherwise polygonal. Also, each of the pressure receiving portions 83, though formed substantially in a circle and in staggered fashion in the aforementioned embodiments, may alternatively be formed in the shape of a cocoon or linearly.

Also, according to the fourth embodiment described above, the portion where the amount of the retained austenite is not less than 5 volume % covers the whole of the first sliding surface 100. As an alternative, the portion with the retained austenite amount of not less than 5 volume % may be only in the neighborhood of the surface of the pressure receiving portions 83.

Further, according to the fifth embodiment described above, the first and second sliding surfaces 100 and 101 may be both formed of a steel material and the retained austenite amount in the neighborhood of the sliding surfaces 100 and 101 may be not less than 5 volume %.

According to the embodiments described above, the outer peripheral seal portion 81, the pressure receiving portions 83 and the grooves 85 are formed on the scroll-side plate 53*a*. The invention, however, is not limited to this configuration, and they may be formed on the fixed-side sliding surface 53*b* of the scroll accommodation depression 31. In other words, the second sliding surface 101 may be fixed on the movable scroll 38.

Also, according to the embodiments described above, an oil supply means is employed to supply the oil to the thrust bearing 53 taking advantage of the pressure difference between the oil separated by the oil separator 63 and the portion where the thrust bearing 53 is arranged. Nevertheless, the invention is not limited to this configuration, and any other configuration whereby the oil is led to the thrust bearing 53 may be used and the oil supply means is not necessarily required to utilize the pressure difference.

The requirements of any one of the embodiments described above may be replaced with the corresponding requirements of any other other embodiments appropriately.

EXAMPLES

The operational effects of the sliding surfaces 100 and 101 of the scroll compressor 11 according to the invention are further explained with reference to examples of the invention and comparative examples for comparison with this invention. The invention, however, is not limited to these examples.

Example 1

The first example is produced by using SUJ2 (nitriding hardening-tempering process) as a test piece of the scroll-side plate 53*a* having the first sliding surface 100, and similarly, by using SUJ2 (nitriding hardening-tempering process) as a test piece of the housing-side plate 53*b* having the second sliding surface 101. The retained austenite amount in the neighborhood of the first sliding surface 100 is 10 volume %, while the retained austenite amount in the neighborhood of the second sliding surface 101 is also 10 volume %. These retained austenite amounts are measured by the method described above.

Example 2

The second example is produced similarly to the first example by using SCr415 (carbonitriding hardening process) as a test piece of the scroll-side plate 53*a* having the first sliding surface 100, and by using SUJ2 (hardening-tempering process) as a test piece of the housing-side plate 53*b* having the second sliding surface 101. The retained austenite amount in the neighborhood of the first sliding surface 100 is 8 volume %, while the retained austenite amount in the neighborhood of the second sliding surface 101 is 10 volume %.

Example 3

As a test piece of the scroll-side plate 53*a* having the first sliding surface 100, SUJ2 (nitriding hardening-tempering process) is used, while as a test piece of the housing-side plate 53*b* having the second sliding surface 101, SUJ2 (nitriding hardening-tempering process) is used. Then, a CrN film is formed to the thickness of 3±1 μm on the second sliding surface 101. In this way, the third example is obtained.

The Vickers hardness of the first sliding surface 100 is 700 HV, the Vickers hardness of the second sliding surface 101 is 1500 HV, and the difference of Vickers hardness between the two sliding surfaces is 800 HV.

Example 4

Except that a DLC film is formed to the thickness of 2±1 μm on the second sliding surface 101, the fourth example is obtained similarly to the third example.

The Vickers hardness of the first sliding surface is 700 HV, the Vickers hardness of the second sliding surface 101 is 2000 HV, and the difference of Vickers hardness between the two sliding surfaces is 1300 HV.

Comparative Example 1

The first comparative example is produced similarly to the first example by using SK5 (hardening-tempering process) as a test piece of the scroll-side plate 53*a* having the first sliding surface 100, and by using SUJ2 (hardening-tempering process) as a test piece of the housing-side plate 53*b* having the second sliding surface 101. The retained austenite amount in the neighborhood of the first sliding surface 100 is 4 volume %, while the retained austenite amount in the neighborhood of the second sliding surface 101 is 10 volume %. The Vickers hardness of the first sliding surface 100 is 650 HV, the Vickers hardness of the second sliding surface 101 is 700 HV, and the difference of Vickers hardness between the two sliding surfaces is 50 HV.

[Evaluation of Abrasion Loss]

With reference to the first to fourth examples and the first comparative example described above, the abrasion loss is evaluated as described below.

Figure 18:
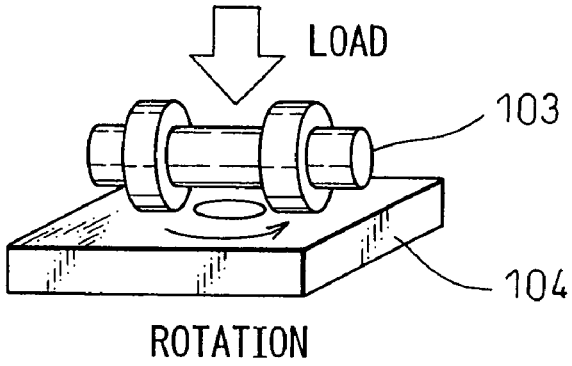
FIG. 18 is a schematic diagram for explaining the method of evaluating the abrasion loss.

The abrasion loss is evaluated using the barbell plate tester shown in FIG. 18. The barbell plate tester includes a barbell 103 with a pair of disks fixed on a cylindrical shaft in spaced relationship to each other and a plate 104 with the barbell mounted thereon.

The pair of the disks is each fabricated from a test piece of the housing-side plate 53*b* and the plate 104 is fabricated from the test piece of the scroll-side plate 53*a* as a combination (hereinafter referred to also as a set A). Similarly, the pair of the disks is each fabricated from a test piece of the scroll-side plate 53*a* and the plate 104 is fabricated from the test piece of the housing-side plate 53*b* as a combination (hereinafter referred to also as a set B).

Each disk of the disk pair is 14 mm in outer diameter and 5 mm thick. The distance between the pair of the disks of the barbell 103 is 21 mm. The four sides of the plate 104 each have the length of 30 mm, and the thickness of the plate 104 is 1.5 to 6 mm, which is varied from one test piece to another.

The plate 104 is immersed in the lubricating oil, and the sliding surfaces between the barbell 103 and the plate 104 are also immersed in the lubricating oil. The test is conducted in such a manner that with a predetermined load imposed on the barbell 103 from above, the plate 104 is rotated at a predetermined rotational speed for a predetermined time, after which the abrasion loss of the test pieces of the barbell 103 and the plate 104 is measured.

A plurality of the measurement conditions combining the load and the rotational speed are used. Also, the measurement conditions are appropriately adjusted for each test piece. Specifically, the load is in the range of 0 to 1000 N (0 to 500 MPa in contact pressure), and the rotational speed in the range of 0 to 2000 rpm (0 to 2 m/sec in sliding speed).

First, the specific abrasion loss of the first example is measured as described below.

The measurement is conducted a plurality of times for different products of contact pressure and sliding distance using the barbell plate tester thereby to measure the abrasion loss of the test piece of the barbell 103 and the abrasion loss of the test piece of the plate 104. The sliding distance is determined from the product of the rotational speed and time. The abrasion loss is assumed to be the volume reduced by the wear of the test piece. The measurement is conducted for the set A and the set B of the first example. The barbell 103 and the plate 104 are lubricated in boundary.

The measurement result is plotted with the product of the contact pressure and the sliding distance as an abscissa and the abrasion loss as an ordinate, and from the inclination of the curve, the specific abrasion loss is determined. The specific abrasion loss is determined for each of the first and second sliding surfaces 100 and 101.

Next, the estimated abrasion loss according to the first example is determined as described below. The estimated abrasion loss is a value of the abrasion loss estimated for an actual machine using the specific abrasion loss.

Using the contact pressure and the sliding distance of the thrust bearing 53 in the operation of an actual machine under predetermined conditions, the abrasion loss A under the boundary lubrication conditions is determined from the product of specific abrasion loss, contact pressure and the sliding distance. Taking the oil film parameter into consideration, the estimated abrasion loss in the mixed lubrication state is determined from the abrasion loss A. The estimated abrasion loss is determined for each of the first and second sliding surfaces 100 and 101.

The estimated abrasion loss is determined similarly for the second to fourth examples and the first comparative example. The result is shown in Table 1.

TABLE 1

| | | Example | | | | Comparative |
|---|---|---|---|---|---|---|
| | | 1 | 2 | 3 | 4 | Example 1 |
| Austenite amount in volume % | First sliding surface | 10 | 8 | — | — | 4 |
| | Second sliding surface | 10 | 10 | — | — | 10 |
| Vickers hardness difference HV | | | | 800 | 1300 | 50 |
| Estimated abrasion loss in μm | First sliding surface | 0.35 | 0.40 | 0.20 | 0.20 | 6.0 |
| | Second sliding surface | 0.40 | 0.50 | 0.00 | 0.00 | 2.00 |
| | Total | 0.75 | 0.90 | 0.20 | 0.20 | 8.0 |

The estimated abrasion loss according to the first to fourth examples, as shown in Table 1, is known to be smaller than that of the first comparative example. Especially, the abrasion loss is minimal and wear resistance high in the third and fourth examples.

Sixth Embodiment

The sixth embodiment of the invention will be explained below with reference to FIGS. 19 to 25. The components similar to or identical with those of the embodiments described above are designated by the same reference numerals, respectively.

Figure 19:
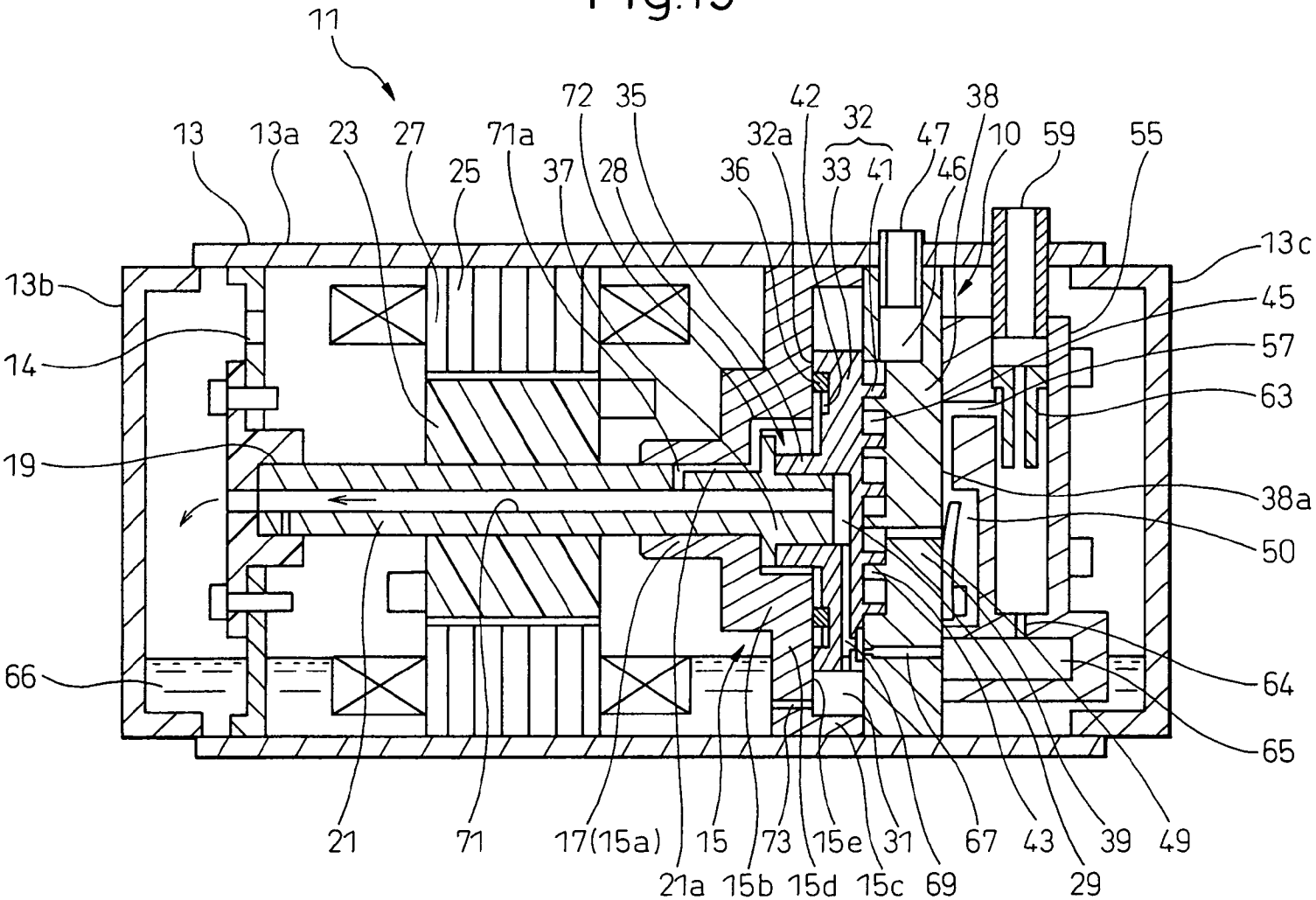
FIG. 19 is a longitudinal sectional view showing a scroll compressor according to a sixth embodiment of the invention.

FIG. 19 is a longitudinal sectional view showing the scroll compressor 11 according to the sixth embodiment. A compressor operated in a refrigeration circuit using the carbon dioxide refrigerant with the pressure of the discharged carbon dioxide exceeding the critical pressure is explained as an example. The invention, however, is not limited to this configuration.

The scroll compressor 11 according to this embodiment is a motor driven hermetic compressor accommodating a motor unit 27 and a compression mechanism 10 in a closed container 13.

The closed container 13 includes a cylindrical case 13*a*, a motor-side end case 13*b* assembled at the ends of the cylindrical case 13*a* and a compression mechanism-side end case 13*c*.

The motor unit 27 includes a stator 25 fixed on the inner peripheral surface of the cylindrical case 13*a* and a rotor 23 fixed on the shaft 21 rotationally driven by the motor unit 27.

The compression mechanism 10 includes a bearing member 15 fixed at a position adjacent to the stator 25 in the cylindrical case 13*a*, a movable scroll 32 orbited by the crank mechanism 28 supported on the main bearing 17 arranged on the bearing member 15, and a fixed scroll 38 fixed on the cylindrical case 13*a* in opposed relation to the movable scroll 32 to form a compression chamber 45, described later, together with the movable scroll 32.

The shaft 21 is supported horizontally by the auxiliary bearing 19 fixed on the discal support member 14 arranged in the vicinity of the motor-side end case 13*b* and the main bearing 17.

The movable scroll 32 includes a discal movable-side plate 33, a movable-side spiral blade 41 erected in an involute curve toward the fixed scroll 38 from the end surface of the movable-side plate 33, and a boss 35 erected cylindrically toward the bearing member 15 from the end surface of the movable-side plate 33 far from the movable-side spiral blade 41.

The fixed scroll 38 includes a fixed-side plate 39 fixed on the cylindrical case 13*a*, and a fixed-side spiral blade 43 arranged in an involute curve on the end surface of the fixed-side plate 39 near to the movable scroll 32.

The bearing member 15 assumes the shape of a triple-cylinder with the diameter thereof progressively increased toward the fixed scroll 39 from the motor unit 27. The small-diameter cylindrical portion 15*a* near to the motor unit 27 makes up a main bearing 17, the middle-diameter cylindrical portion 15*b* adjacent to the small-diameter cylindrical portion 15*a* makes up a crank chamber 29 for accommodating the crank mechanism 28, and the large-diameter cylindrical portion 15*c* near to the fixed scroll 38 makes up a scroll accommodation unit 31 for accommodating the movable scroll 32 therein while at the same time being fixed by a fixing means such as shrink fitting on the inner peripheral surface of the cylindrical case 13*a*.

The crank mechanism 28 is comprised of a boss 35 of the movable scroll 32 and an eccentric shaft 37 integrally formed at the end portion of the shaft 21 near to the compression mechanism 10. The eccentric shaft 37 is decentered a given amount from the axial center of the main bearing 17 and the auxiliary bearing 19.

An Oldham ring 36 for preventing the rotation of the movable scroll 32 is arranged between the discal portion 15*d* connecting the large-diameter cylindrical portion 15*c* and the middle-diameter cylindrical portion 15*b* making up the bearing member 15 on the one hand and the movable scroll 32 on the other hand. As a result, the movable scroll 32 is permitted only to orbit. In the compression mechanism 10, the compression chamber 45 formed by the movable-side spiral blade 41 and the fixed-side spiral blade 43 in mesh with each other are reduced in volume by the revolution of the movable scroll 32 with respect to the fixed scroll 38, thereby compressing the refrigerant supplied from the intake tube 47 into the intake chamber 46 communicating with the outermost peripheral side of the fixed-side spiral blade 43.

Figure 20:
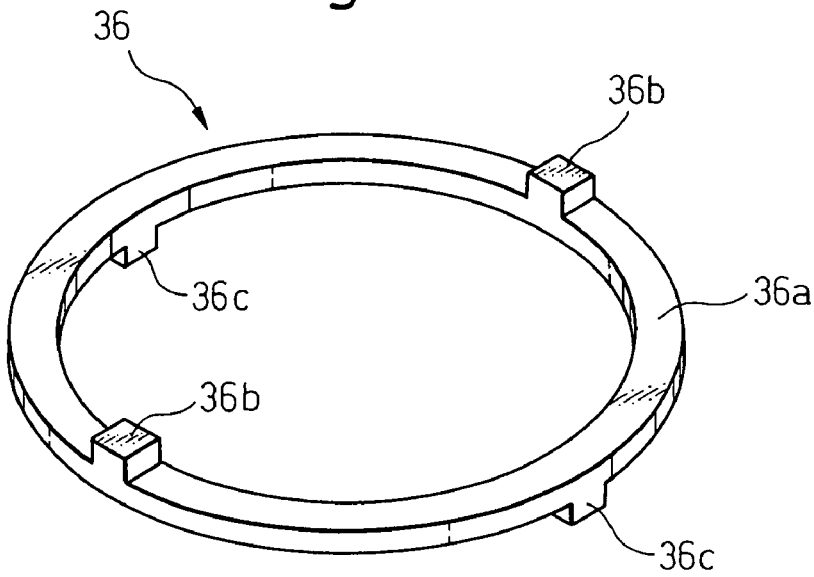
FIG. 20 is a perspective view of the Oldham ring used with the scroll compressor described above.

According to this embodiment, the Oldham ring 36, as shown in FIG. 20, includes a pair of first key portions 36*b* protruded along the normal to one of the surfaces of an annular plate 36*a* and a pair of second key portions 36*c* protruded from the other surface thereof. The line segment connecting the pair of the first key portions 36*b* is orthogonal to the line segment connecting the pair of the second key portions 36*c*. The first key portions 36*b*, as shown in FIG. 19, is received in a pair of oblong first key slot portions 42 formed on the back surface 32 of the movable scroll, while the second key portions 36*c* are received in a pair of oblong second way portions, not shown, formed on the discal unit 15*d* of the bearing member. The key portions 36*b*, 36*c* and the key slot portions 42 are formed in such a manner that the key portions 36*b*, 36*c* are fitted and slide within the key slots radially of the Oldham ring 36.

The movable scroll 32 is subjected to the axial force (in this embodiment, the force pushing the movable-side plate 33 toward the discal portion 15*d* from the fixed scroll 38 side) received by the movable-side plate 33 due the difference between the reaction force of the compressed refrigerant and the force along the thrust direction under the pressure on the back surface 32 of the movable scroll. In order to orbit the movable scroll while at the same time stably supporting this axial force (thrust), a thrust support surface 15*e* is formed at the end surface of the discal portion 15*c* in opposed relation to the movable scroll 32, while a sliding surface 34*a* adapted to slide in contact with the thrust support surface 15*e* is formed on the back surface 32 of the movable scroll.

A discharge port 49 is formed axially through the fixed-side plate 39 at the central portion of the fixed-side spiral blade 43, and the refrigerant compressed by the movable scroll 32 and the fixed scroll 38 is discharged into the discharge chamber 50 from the discharge port 49.

The high-temperature high-pressure refrigerant discharged into the discharge chamber 50 is led to the centrifugal oil separator 63 through the refrigerant path 57 extending upward from the discharge chamber 50. The refrigerant that has flowed into the oil separator 63, after being centrifugally separated from the oil contained in the refrigerant, is sent to an external refrigerant circuit through the discharge tube 59.

The oil that has been separated by the oil separator 63, on the other hand, is moved downward under gravitation and stored in the high-pressure oil storage 65 through the small-diameter hole 64.

The oil relatively high in pressure that has been stored in the high-pressure oil storage 65 is led to the oil path 69 formed in the movable-side plate 33 by way of the oil return path 47 formed through the fixed-side plate 39. Then, through the oil path 69, the oil flows into the space between the end portion of the shaft 21 and the bottom surface of the boss 35, and further, into the oil path 71 formed axially through the shaft 21.

Part of the oil that has flowed into the oil path 71 flows into the shaft groove 21*a* formed on the shaft 21 from a diametrical hole 71*a*, and after lubricating the main bearing 17, the crank mechanism 28, the thrust support surface 15*e* and the sliding surface 34*a*, reaches the scroll housing unit 31. Incidentally, the middle-diameter cylindrical portion 15*b* is formed with an oil groove 72 for establishing communication between the diametrical hole 71*a* and the thrust support surface 15*e* above the shaft 21 to lead the oil to the thrust support surface 15*e* above the shaft 21.

Also, part of the oil that has flowed leftward in FIG. 19 through the oil path 71 lubricates the auxiliary bearing 19, while major part of the oil drops into the low-pressure oil storage 66 expanding downward of the whole internal area of the closed container 13 from the end of the oil path 71. The oil stored in the low-pressure oil storage 66 reaches the scroll housing unit 31 through the oil return hole 73 formed in the lower part of the bearing member 15, and being supplied to the sliding surfaces of the movable scroll 32 and the fixed scroll 38, compressed together with the refrigerant in the compression chamber 45.

Figure 21:
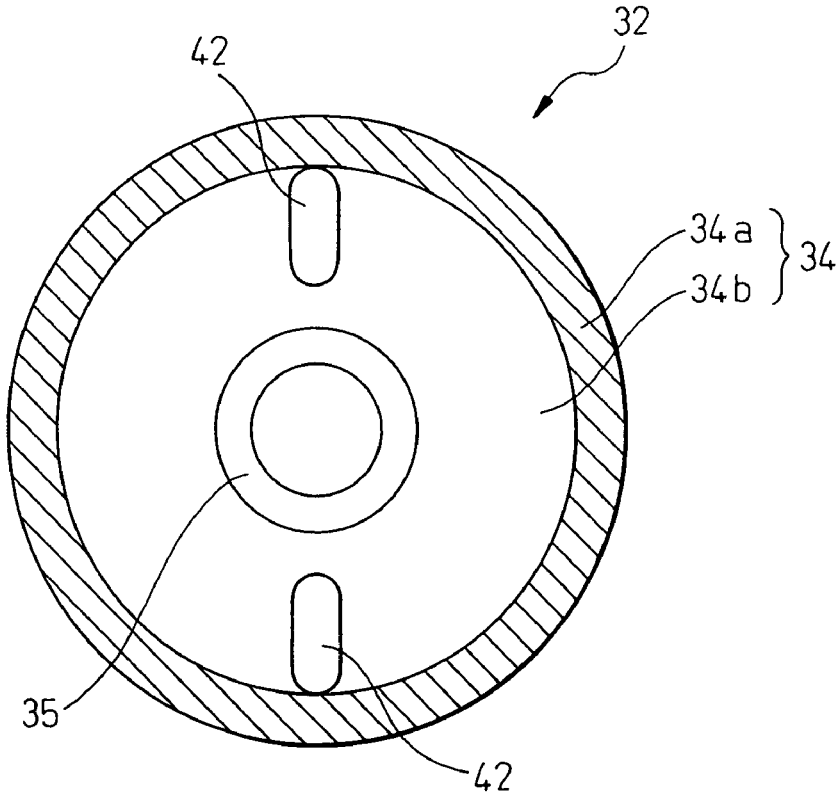
FIG. 21 is a front view showing the sliding surface side of the movable scroll of the scroll compressor shown in FIG. 19.

Next, with reference to FIG. 21, the back surface 32 of the movable scroll is explained in detail. According to this embodiment, the back surface of the movable scroll has a circular contour of which the central portion is formed with a boss 35 coupled with an eccentric shaft 37 (not shown). An annular sliding surface 34*a* hatched in FIG. 21 is formed radially outward of the center line of the boss 35, and a depressed surface 34*b* lower in level than the sliding surface 34*a* is formed in the area between the sliding surface 34*a* and the boss 35 (this depressed surface, not in contact with the thrust support surface 15*e* of the bearing member, is hereinafter referred to as the non-contact surface 34*b*). Also, the pair of the oblong first key slot portions 42 are formed on the non-contact surface 34*b* so that the radially outward end thereof may be in contact with the inner peripheral edge of the sliding surface 34*a*. As a result, the area adjacently in contact with the first key slot portion 42, except for the area adjacent to the radial outer end of the center line, constitutes the non-contact surface 34*b* in its entirety.

Figure 26:
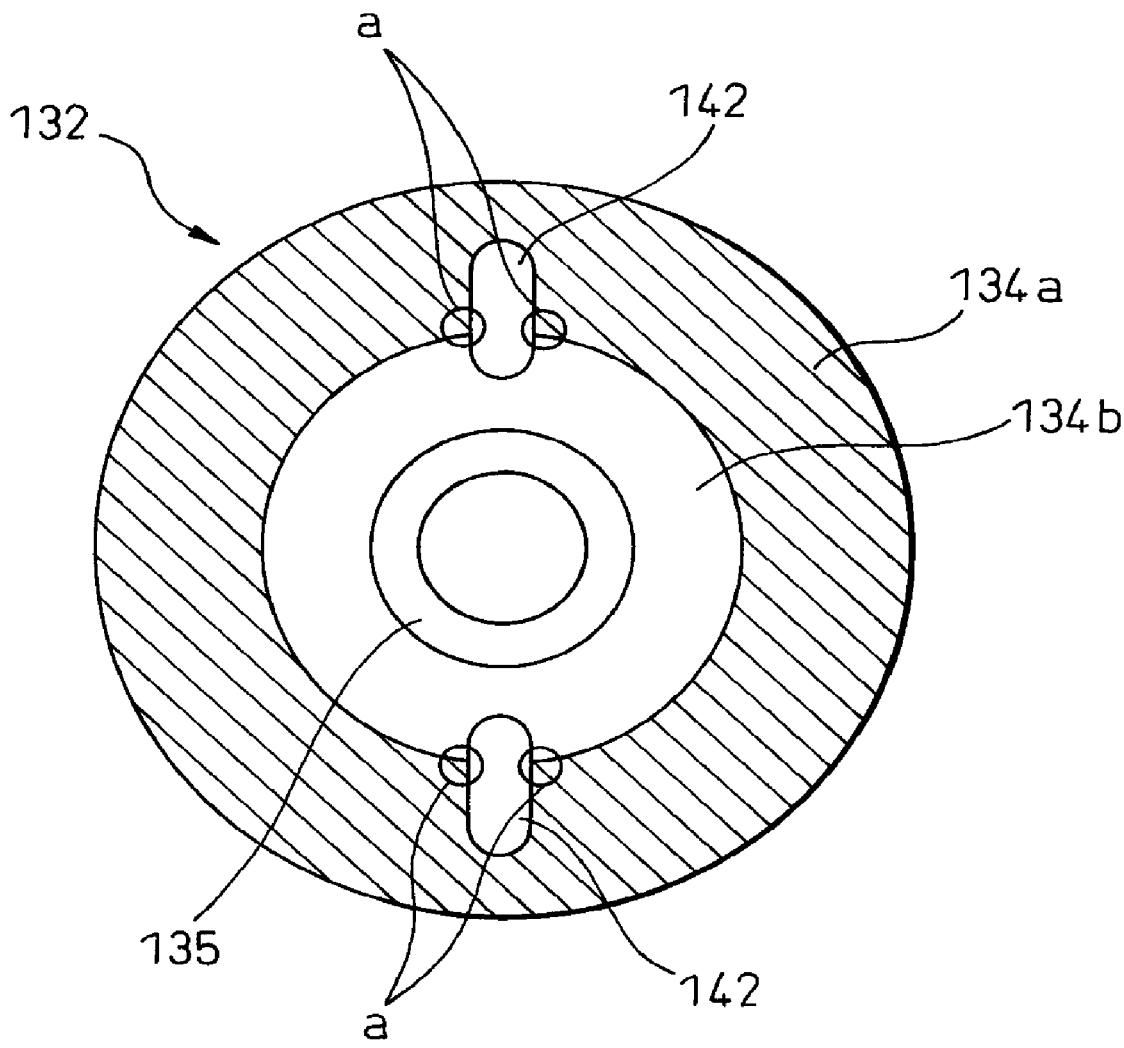
Fig.26 Prior art
FIG. 26 is a front view showing the sliding surface side of the movable scroll of the conventional scroll compressor.

In the case where the sliding surface 34*a* is formed in this way, as shown by a in FIG. 26, a corner portion adjacent to the first key slot portion 42 is not formed, and therefore, the generation of an area where the contact pressure is locally high and which is liable to cut the oil film is suppressed. Incidentally, the radially outward end of the first key slot portion 42, though in contact with the inner peripheral edge of the sliding surface 34*a* according to the aforementioned embodiments, may be completely spaced from the sliding surface 34*a* according to this invention.

Seventh Embodiment

Figure 22:
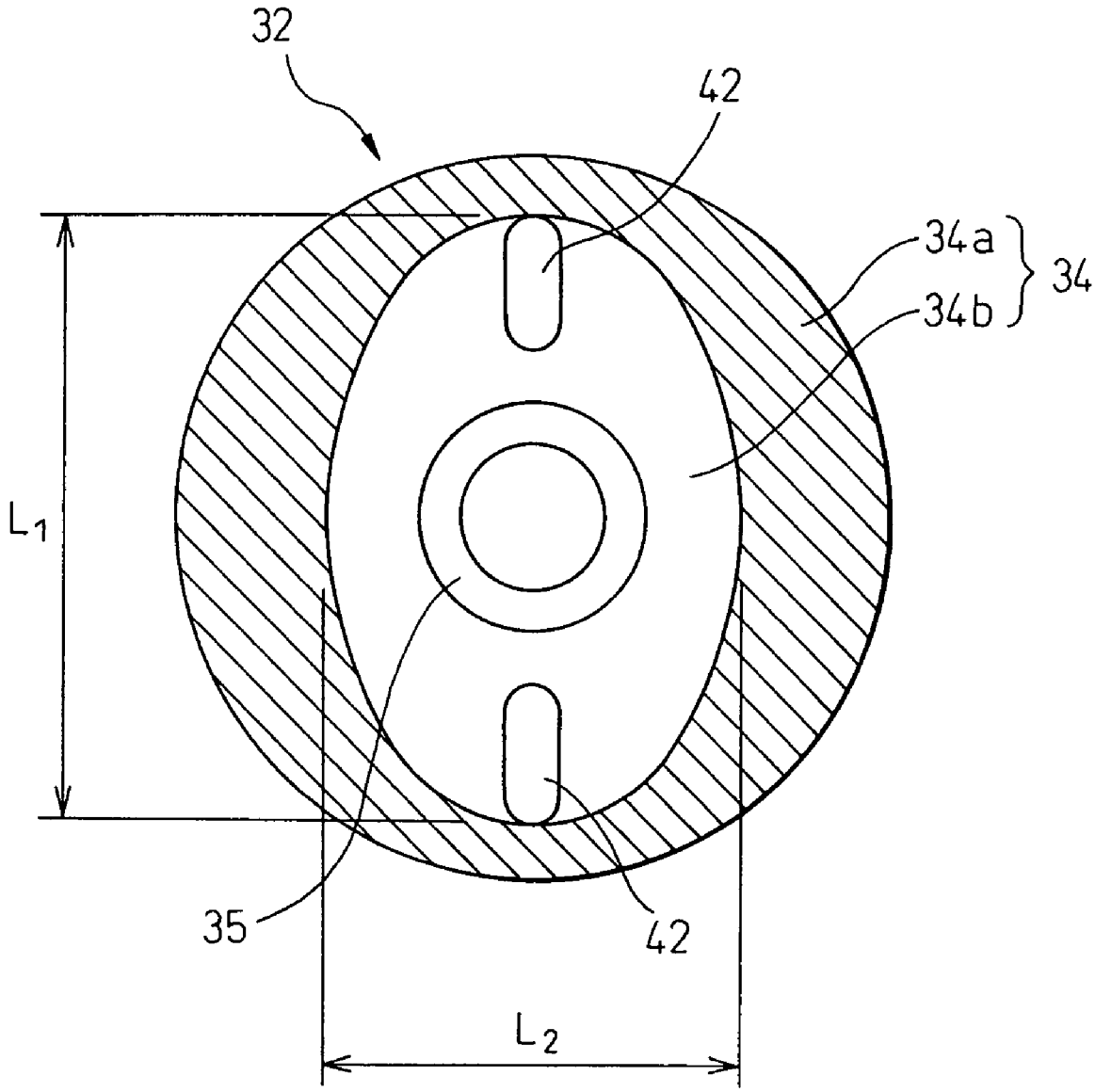
FIG. 22 is a front view showing the sliding surface side of the movable scroll of the scroll compressor according to a seventh embodiment.

Next, the sliding surface 34*a* of the movable scroll according to the seventh embodiment will be explained with reference to FIG. 22. The sliding surface 34*a* according to this embodiment, though annular, has an internal peripheral boundary not circular but substantially elliptic. As a result, the sliding surface 34*a* is formed in such a manner that the diameter $L_1$ of the boundary line in the first direction to connect the pair of the first key slot portions (vertical direction in FIG. 22) is larger than the diameter $L_2$ of the boundary line in the direction perpendicular to the first direction (horizontal direction in FIG. 22).

Eighth Embodiment

Figure 23:
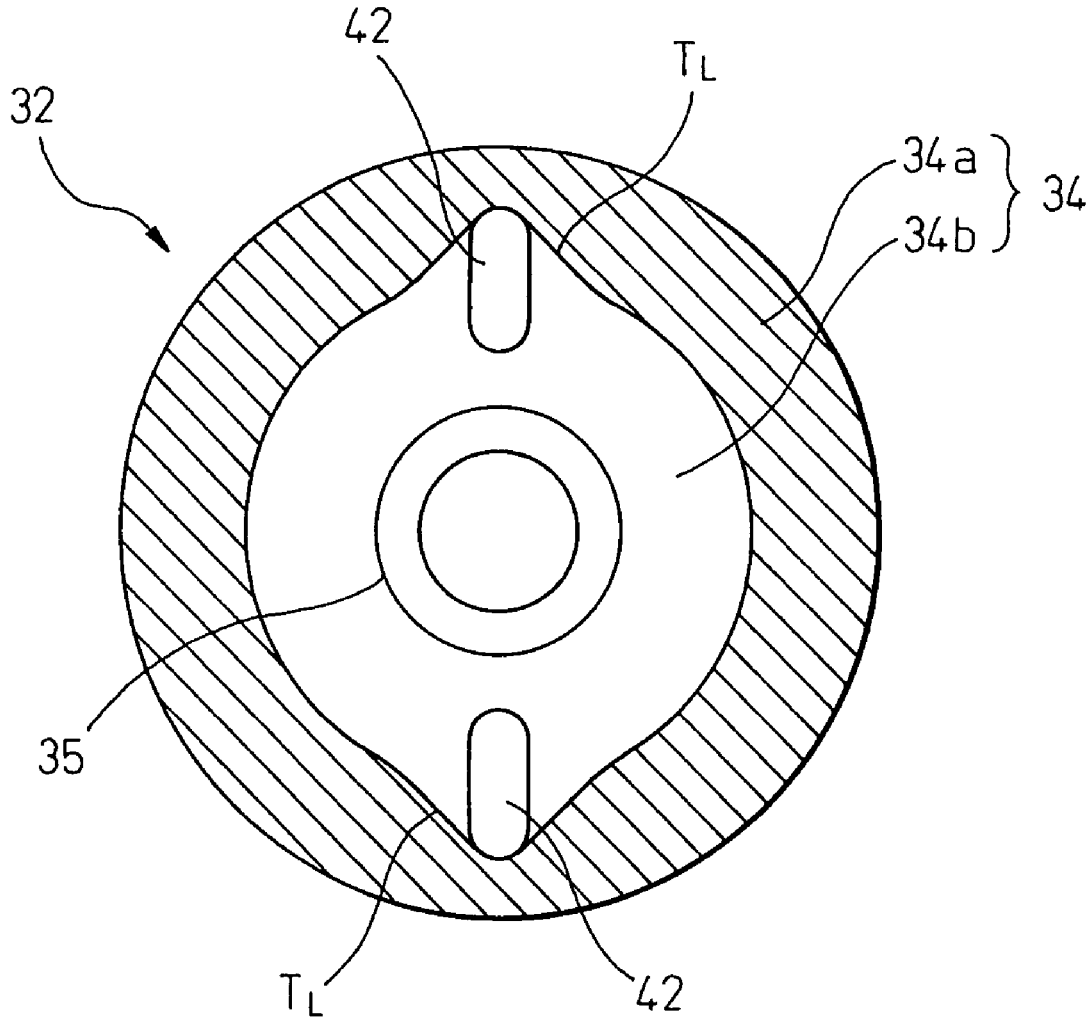
FIG. 23 is a front view showing the sliding surface side of the movable scroll of the scroll compressor according to an eighth embodiment.

Next, the sliding surface 34*a* of the movable scroll according to the eighth embodiment will be explained with reference to FIG. 23. The greater part of the inner peripheral boundary of the sliding surface 34*a* according to this embodiment is circular and passes inside of the radially outer end of the first key slot portions 42. The boundary line of the portion in contact with the pair of the first key slot portions 42, however, merges with the arc of the first key slot portions 42 as a tangential line $T_L$ at about 45 degrees to the line segment connecting the pair of the first key slot portions 42 according to this embodiment.

Ninth Embodiment

Figure 24:
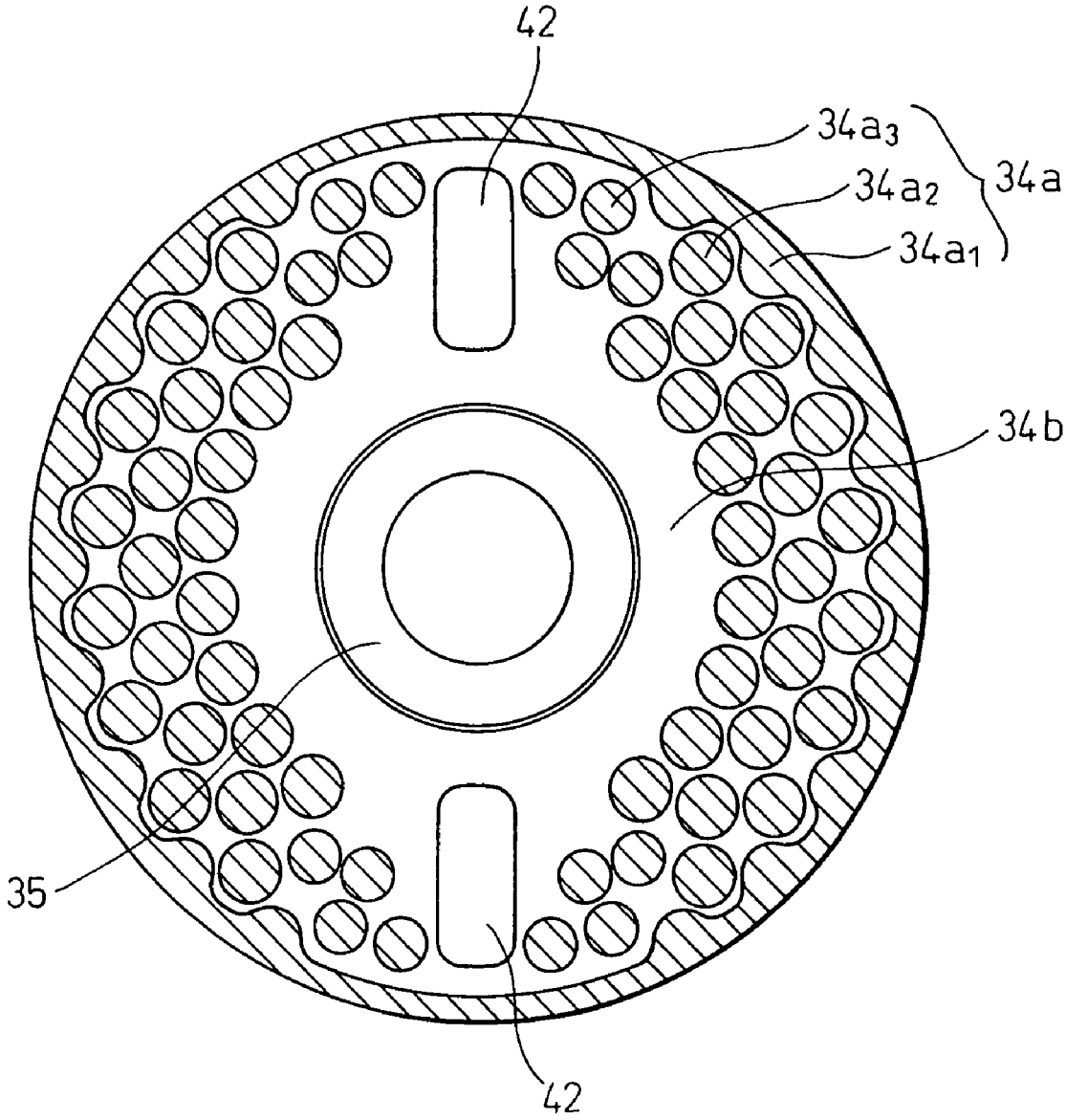
FIG. 24 is a front view showing the sliding surface side of the movable scroll of the scroll compressor according to a ninth embodiment.

Next, the sliding surface 34*a* of the movable scroll according to the ninth embodiment will be explained with reference to FIG. 24. The sliding surface 34*a* according to this embodiment is comprised of an annular sliding surface 34$a_1$ formed on the outer peripheral edge of the back surface 34 of the movable scroll, a plurality of first insular sliding surfaces 34$a_2$ formed radially inside of the annular sliding surface 34$a_1$ and a plurality of second insular sliding surfaces 34$a_3$ smaller in diameter than the first insular sliding surfaces 34$a_2$. The top of the first and second insular sliding surfaces 34$a_2$, 34$a_3$ and the top of the annular sliding surface 34$a_1$ are flush with each other. The first and second insular sliding surfaces 34$a_2$, 34$a_3$ are in spaced relation with each other and the annular sliding surface 34$a_1$. The lubricating oil can thus flow through the gaps or the grooves formed by the spaced relation. Also, according to this embodiment, the first key slot portions 42 are in the shape of a rectangle having four arcuate corners, and each have a radially outward end in spaced relation with the sliding surface (annular sliding surface 34$a_1$).

Although the sliding surface contains an annular sliding surface in this embodiment, the sliding surface may alternatively be comprised of insular sliding surfaces.

Tenth Embodiment

Figure 25:
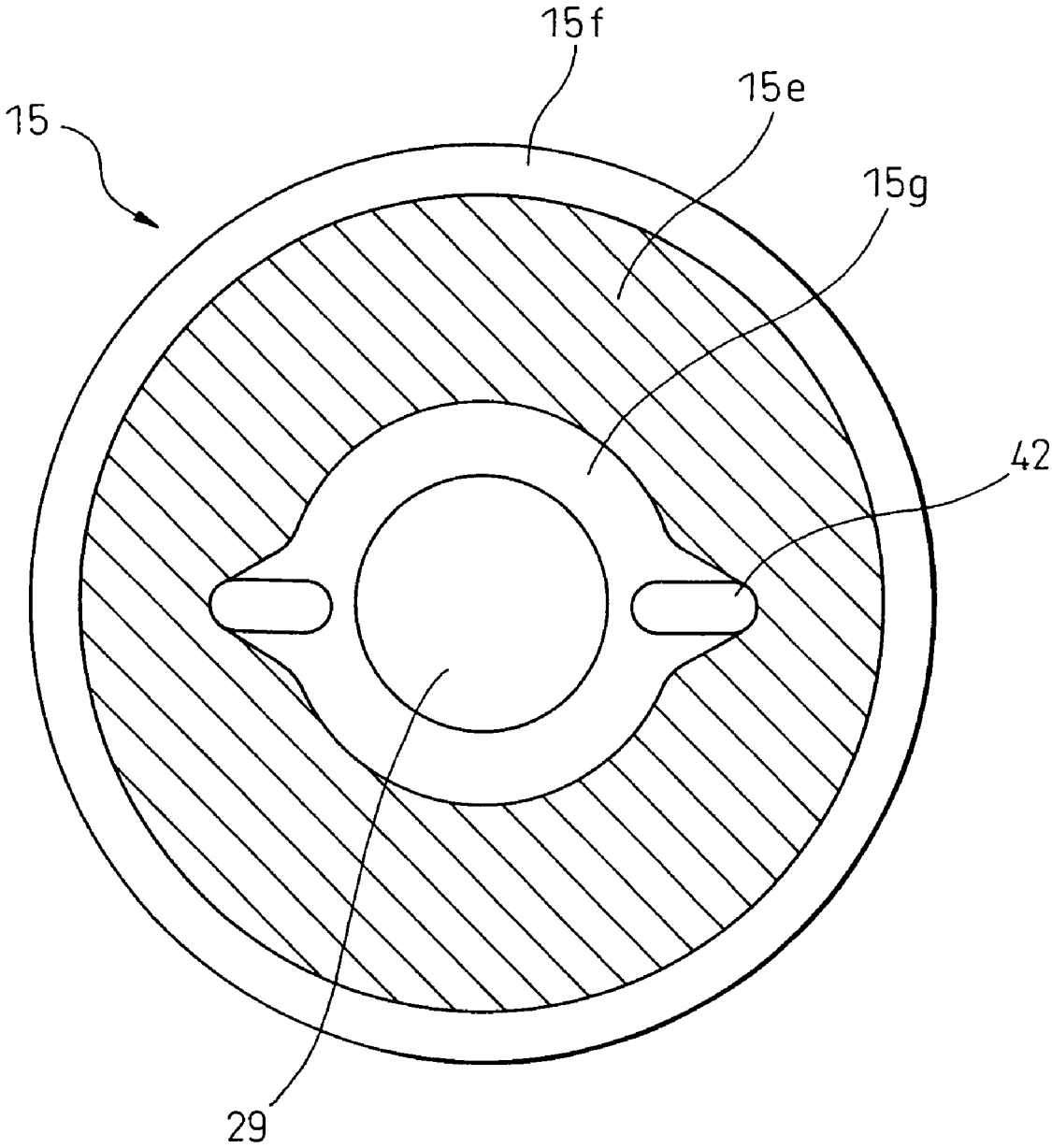
FIG. 25 is a front view showing the surface of the bearing member on the side in opposed relation to the movable scroll of the scroll compressor according to a tenth embodiment.

Next, the tenth embodiment will be explained with reference to FIG. 25. FIG. 25 will be a diagram showing the surface of the bearing member on the side in opposed relation to the movable scroll. This surface is comprised of an end surface 15*f* of a large-diameter cylindrical portion 15*c* on the outermost periphery, a circular crank chamber 29 at the central portion, a thrust support surface 15*e* adjacent to the end surface 15*f* of the large-diameter cylindrical portion 15*c*, and a bearing member-side non-contact surface 15*g* depressed and lower in level than the thrust support surface 15*e* inside of the thrust support surface 15*e*, while a pair of oblong second key slot portions 42 are formed on the non-contact surface 15*g*. The inner peripheral edge of the thrust support surface 15*e*, though arcuate for the most part, is not arcuate and tangentially merges with the arc of the radially outer end of the second key slot portions 42 at about 30 degrees in the neighborhood of the second key slot portions 42. As a result, the area adjacent to the second key slot portions 42, except for the area adjacent to the radially outer end described above, constitutes the non-contact surface 15*g* in its entirety.

The sliding surface 34*a* and the thrust support surface 15*e* according to this invention may assume various shapes other than those shown in the aforementioned embodiments, and the first and second key slot portions are not limited to an oblong or rectangle.

Also, according to the embodiments described above, the back surface of the movable scroll 32 is formed with the sliding surface 34*a* in sliding contact with the thrust support surface 15*e* and the non-contact surface 34*b* not in contact with the thrust support surface 15*e* inside the sliding surface 34*a*. Nevertheless, the present invention is not limited to this configuration, but the thrust support surface may be arranged between the movable scroll and the fixed scroll, and the non-contact surface and the sliding surface may be formed on the outer periphery of the spiral blade of the movable scroll.

While the invention has been described by reference to specific embodiments chosen for purposes of illustration, it should be apparent that numerous modifications could be made thereto by those skilled in the art without departing from the basic concept and scope of the invention.

The invention claimed is:

1. A scroll compressor comprising:

a fixed scroll fixed on a housing;

a movable scroll arranged in opposed relation to the fixed scroll and adapted to revolve with respect to the fixed scroll on a rotary shaft thereby to compress a fluid;

a thrust bearing arranged on the back surface of the movable scroll for receiving the axial force; and a lubricating oil supply means for supplying the lubricating oil to the thrust bearing;

wherein the thrust bearing includes a donut-shaped first member formed with a plurality of grooves and a plurality of pressure receiving portions defined by the plurality of the grooves and a donut-shaped second member in sliding contact with the first member, wherein the plurality of the pressure receiving portions are arranged only on radially outside an envelope plotted by an inner peripheral edge of the second member by the relative motion of the first member and the second member, and wherein the plurality of the pressure receiving portions are formed on a surface that faces the second member.

2. The scroll compressor according to claim 1, wherein the plurality of the grooves are arranged in meshes and communicate with each other.

3. The scroll compressor according to claim 2, wherein the intersections of the plurality of the grooves in meshes have a larger groove width than the other parts.

4. The scroll compressor according to claim 3, wherein the plurality of pressure receiving portions are substantially circular in shape and arranged in staggered fashion.

5. The scroll compressor according to claim 1, further comprising an oil separating means for separating the lubricating oil from the fluid, wherein the lubricating oil supply means supplies the lubricating oil to the thrust bearing by the pressure difference between the lubricating oil separated by the oil separating means and the portion where the thrust bearing is arranged.

6. The scroll compressor according to claim 1, wherein the fluid is carbon dioxide and the pressure of the carbon dioxide discharged exceeds the critical pressure.

7. The scroll compressor according to claim 1, wherein the donut-shaped first member is fixed on the back surface of the movable scroll.

8. A scroll compressor comprising:

a fixed scroll fixed on a housing;

a movable scroll arranged in opposed relation to the fixed scroll and adapted to revolve with respect to the fixed scroll on a rotary shaft thereby to compress a fluid;

a thrust bearing arranged on the back surface of the movable scroll for receiving the force in axial direction; and a lubricating oil supply means for supplying the lubricating oil to the thrust bearing;

wherein the thrust bearing includes a donut-shaped first member formed with a plurality of grooves and a plurality of pressure receiving portions defined by the plurality of the grooves and a donut-shaped second member in sliding contact with the first member;

wherein the plurality of the pressure receiving portions are arranged only on radially inside an envelope plotted by an outer peripheral edge of the second member by the relative motion of the first member and the second member, and wherein the plurality of the pressure receiving portions are formed on a surface that faces the second member.

9. The scroll compressor according to claim 8, wherein the donut-shaped first member is fixed on the back surface of the movable scroll.

10. A scroll compressor comprising:

a fixed scroll fixed on a housing;

a movable scroll arranged in opposed relation to the fixed scroll and adapted to revolve with respect to the fixed scroll on a rotary shaft thereby to compress a fluid;

a thrust bearing for receiving the axial force received by the movable scroll; and a lubricating oil supplier for supplying the lubricating oil to the thrust bearing, wherein the thrust bearing includes a plurality of grooves formed on a sliding surface thereof and communicating with each other, wherein the plurality of the grooves include an outermost peripheral groove, which extends along an outer peripheral edge of the thrust bearing, and wherein the thrust bearing includes an annular sealing portion between the outermost peripheral groove and the outer peripheral edge of the thrust bearing.

11. The scroll compressor according to claim 10, wherein areas defined by the plurality of the grooves communicating with each other constitute insular pressure receiving portions independent of each other, and the pressure receiving portions occupy at least one half of the area of the sliding surface.

12. The scroll compressor according to claim 11, wherein the plurality of the grooves are arranged in meshes.

13. The scroll compressor according to claim 12, wherein the insular pressure receiving portions are each substantially circular in shape.

14. The scroll compressor according to claim 13, wherein the insular pressure receiving portions are arranged in staggered fashion.

15. The scroll compressor according to claim 12, wherein the insular pressure receiving portions are each polygonal.

16. The scroll compressor according to claim 11, wherein the entire peripheral edge portion of each of the pressure receiving portions is rounded or tapered.

17. The scroll compressor according to claim 11, further comprising an oil separating means for separating the lubricating oil from the fluid, wherein the lubricating oil is supplied to the thrust bearing by the pressure difference between the lubricating oil separated by the oil separating means and the portion at which the thrust bearing is arranged.

18. The scroll compressor according to claim 11, wherein the fluid is carbon dioxide, and the pressure of the carbon dioxide discharged exceeds the critical pressure thereof.

19. A scroll compressor comprising:

a fixed scroll fixed on a housing;

a movable scroll arranged in opposed relation to the fixed scroll and adapted to revolve with respect to the fixed scroll on a rotary shaft thereby to compress a fluid;

a thrust bearing for receiving the axial force received by the movable scroll; and a lubricating oil supplier for supplying the lubricating oil to the thrust bearing, wherein the thrust bearing includes a plurality of grooves formed on a sliding surface thereof and communicating with each other to define a plurality of insular pressure receiving portions independent each other, and wherein a bottom surface of the grooves is formed to a higher degree of roughness than the insular pressure receiving portions.

* * * * *